US008887944B2

(12) United States Patent
Deane et al.

(10) Patent No.: US 8,887,944 B2
(45) Date of Patent: Nov. 18, 2014

(54) TEMPERATURE-STABILIZED STORAGE SYSTEMS CONFIGURED FOR STORAGE AND STABILIZATION OF MODULAR UNITS

(75) Inventors: Geoffrey F. Deane, Bellevue, WA (US); Lawrence Morgan Fowler, Pound Ridge, NY (US); William Gates, Redmond, WA (US); Jenny Ezu Hu, Seattle, WA (US); Roderick A. Hyde, Redmond, WA (US); Edward K. Y. Jung, Bellevue, WA (US); Jordin T. Kare, Seattle, WA (US); Mark K. Kuiper, Seattle, WA (US); Nathan P. Myhrvold, Bellevue, WA (US); Nathan Pegram, Bellevue, WA (US); Nels R. Peterson, Bellevue, WA (US); Clarence T. Tegreene, Bellevue, WA (US); Mike Vilhauer, Kirkland, WA (US); Charles Whitmer, North Bend, WA (US); Lowell L. Wood, Jr., Bellevue, WA (US); Ozgur Emek Yildirim, Bellevue, WA (US)

(73) Assignee: Tokitae LLC, Bellevue, WA (US)

( * ) Notice: Subject to any disclaimer, the term of this patent is extended or adjusted under 35 U.S.C. 154(b) by 797 days.

(21) Appl. No.: 13/135,126

(22) Filed: Jun. 23, 2011

(65) Prior Publication Data

US 2012/0000918 A1 Jan. 5, 2012

Related U.S. Application Data

(63) Continuation-in-part of application No. 12/001,757, filed on Dec. 11, 2007, and a continuation-in-part of (Continued)

(51) Int. Cl.
*B65D 6/28* (2006.01)

(Continued)

(52) U.S. Cl.
CPC ..... *B65D 81/3802* (2013.01); *B65D 81/3818* (2013.01); *B65D 81/3806* (2013.01);

(Continued)

(58) Field of Classification Search
CPC ..... A47J 41/02; B65D 81/38; B65D 81/3806; B65D 25/00; F25D 25/00; F25D 2303/082; F25D 2303/08222; F25D 2700/08; F25D 2700/123
USPC ..... 220/592.2, 592.21, 592.26, 4.27, 220/560.12, 23.87, 23.88, 23.89, 212, 220/212.5; 206/499, 500; 62/457.2, 457.5, 62/457.1
See application file for complete search history.

(56) References Cited

U.S. PATENT DOCUMENTS 520,584 A 5/1894 Turner
2,161,295 A 6/1939 Hirschberg (Continued)

FOREIGN PATENT DOCUMENTS

CN 2414742 Y 1/2001
CN 2460457 Y 11/2001

(Continued)

OTHER PUBLICATIONS

3M Monitor Mark™; "Time Temperature Indicators—Providing a visual history of time temperature exposure"; 3M Microbiology; bearing a date of 2006; pp. 1-4; located at 3M.com/microbiology.

(Continued)

*Primary Examiner* — Fenn Mathew
*Assistant Examiner* — Andrew T Kirsch

(57) ABSTRACT

Apparatus for use with substantially thermally sealed storage containers are described herein. These include an apparatus comprising a stored material module, a stabilizer unit, a stored material module cap and a central stabilizer unit. The apparatus also include a transportation stabilizer unit with dimensions corresponding to a substantially thermally sealed storage container with a flexible conduit.

36 Claims, 40 Drawing Sheets

Related U.S. Application Data application No. 12/006,088, filed on Dec. 27, 2007, now Pat. No. 8,215,518, and a continuation-in-part of application No. 12/006,089, filed on Dec. 27, 2007, and a continuation-in-part of application No. 12/008,695, filed on Jan. 10, 2008, now Pat. No. 8,377,030, and a continuation-in-part of application No. 12/012,490, filed on Jan. 31, 2008, now Pat. No. 8,069,680, and a continuation-in-part of application No. 12/077,322, filed on Mar. 17, 2008, now Pat. No. 8,215,835, and a continuation-in-part of application No. 12/152,465, filed on May 13, 2008, now Pat. No. 8,485,387, and a continuation-in-part of application No. 12/152,467, filed on May 13, 2008, now Pat. No. 8,211,516, and a continuation-in-part of application No. 12/220,439, filed on Jul. 23, 2008, now Pat. No. 8,603,598, and a continuation-in-part of application No. 12/658,579, filed on Feb. 8, 2010, and a continuation-in-part of application No. 12/927,981, filed on Nov. 29, 2010, and a continuation-in-part of application No. 12/927,982, filed on Nov. 29, 2010.

(51) Int. Cl.

| | |
|---|---|
| ***B65D 8/18*** | (2006.01) |
| ***B65D 21/02*** | (2006.01) |
| ***F17C 1/00*** | (2006.01) |
| ***F17C 3/00*** | (2006.01) |
| ***F17C 13/00*** | (2006.01) |
| ***A47J 39/00*** | (2006.01) |
| ***A47J 41/00*** | (2006.01) |
| ***B65D 81/38*** | (2006.01) |
| ***B65D 83/72*** | (2006.01) |
| ***B65D 21/00*** | (2006.01) |
| ***B65D 85/62*** | (2006.01) |

(52) U.S. Cl.

CPC ..... *B65D 81/3823* (2013.01); *B65D 81/3811* (2013.01); *B65D 81/3825* (2013.01); *B65D 2203/10* (2013.01); *B65D 81/3834* (2013.01); *B65D 81/3813* (2013.01)

USPC ..... 220/592.26; 220/592.2; 220/592.21; 220/4.27; 220/560.12; 220/23.89; 206/499; 206/500; 62/457.1; 62/457.2; 62/457.5

(56) References Cited

U.S. PATENT DOCUMENTS

| | | | | |
|---|---|---|---|---|
| 2,496,296 | A | | 2/1950 | Lobl |
| 2,717,937 | A | | 9/1955 | Lehr et al. |
| 2,967,152 | A | | 1/1961 | Matsch et al. |
| 3,034,845 | A | | 5/1962 | Haumann |
| 3,069,045 | A | | 12/1962 | Haumann et al. |
| 3,108,840 | A | | 10/1963 | Conrad et al. |
| 3,921,844 | A | | 11/1975 | Walles |
| 4,003,426 | A | | 1/1977 | Best et al. |
| 4,034,129 | A | | 7/1977 | Kittle |
| 4,057,029 | A | | 11/1977 | Seiter |
| 4,057,101 | A | | 11/1977 | Ruka et al. |
| 4,094,127 | A | | 6/1978 | Romagnoli |
| 4,184,601 | A | | 1/1980 | Stewart et al. |
| 4,312,669 | A | | 1/1982 | Boffito et al. |
| 4,358,490 | A | | 11/1982 | Nagai |
| 4,388,051 | A | | 6/1983 | Dresler et al. |
| 4,402,927 | A | | 9/1983 | Von Dardel et al. |
| 4,428,854 | A | | 1/1984 | Enjo et al. |
| 4,481,779 | A | | 11/1984 | Barthel |
| 4,481,792 | A | | 11/1984 | Groeger et al. |
| 4,482,465 | A | | 11/1984 | Gray |
| 4,526,015 | A | | 7/1985 | Laskaris |
| 4,726,974 | A | | 2/1988 | Nowobilski et al. |
| 4,796,432 | A | | 1/1989 | Fixsen et al. |
| 4,810,403 | A | | 3/1989 | Bivens et al. |
| 4,955,204 | A | | 9/1990 | Pehl et al. |
| 4,956,976 | A | | 9/1990 | Kral et al. |
| 4,969,336 | A | | 11/1990 | Knippscheer et al. |
| 4,974,423 | A | * | 12/1990 | Pring ..... 62/371 |
| 4,976,308 | A | | 12/1990 | Faghri |
| 5,012,102 | A | | 4/1991 | Gowlett |
| 5,103,337 | A | | 4/1992 | Schrenk et al. |
| 5,116,105 | A | | 5/1992 | Hong |
| 5,138,559 | A | | 8/1992 | Kuehl et al. |
| 5,245,869 | A | | 9/1993 | Clarke et al. |
| 5,261,241 | A | | 11/1993 | Kitahara et al. |
| 5,277,031 | A | | 1/1994 | Miller et al. |
| 5,277,959 | A | | 1/1994 | Kourtides et al. |
| 5,330,816 | A | | 7/1994 | Rusek, Jr. |
| 5,355,684 | A | | 10/1994 | Guice |
| 5,376,184 | A | | 12/1994 | Aspden |
| 5,390,734 | A | | 2/1995 | Voorhes et al. |
| 5,444,223 | A | | 8/1995 | Blama |
| 5,452,565 | A | | 9/1995 | Blom et al. |
| 5,505,046 | A | | 4/1996 | Nelson et al. |
| 5,548,116 | A | | 8/1996 | Pandelisev |
| 5,563,182 | A | | 10/1996 | Epstein et al. |
| 5,573,133 | A | | 11/1996 | Park |
| 5,580,522 | A | | 12/1996 | Leonard et al. |
| 5,590,054 | A | | 12/1996 | McIntosh |
| 5,600,071 | A | | 2/1997 | Sooriakumar et al. |
| 5,633,077 | A | | 5/1997 | Olinger |
| 5,671,856 | A | * | 9/1997 | Lisch ..... 220/4.27 |
| 5,679,412 | A | | 10/1997 | Kuehnle et al. |
| 5,709,472 | A | | 1/1998 | Prusik et al. |
| 5,782,344 | A | | 7/1998 | Edwards et al. |
| 5,800,905 | A | | 9/1998 | Sheridan et al. |
| 5,846,224 | A | | 12/1998 | Sword et al. |
| 5,857,778 | A | | 1/1999 | Ells |
| 5,900,554 | A | | 5/1999 | Baba et al. |
| 5,915,283 | A | | 6/1999 | Reed et al. |
| 6,030,580 | A | | 2/2000 | Raasch et al. |
| 6,042,264 | A | | 3/2000 | Prusik et al. |
| 6,050,598 | A | | 4/2000 | Upton |
| 6,209,343 | B1 | | 4/2001 | Owen |
| 6,212,904 | B1 | | 4/2001 | Arkharov et al. |
| 6,213,339 | B1 | | 4/2001 | Lee |
| 6,234,341 | B1 | | 5/2001 | Tattam |
| 6,272,679 | B1 | | 8/2001 | Norin |
| 6,287,652 | B2 | | 9/2001 | Speckhals et al. |
| 6,337,052 | B1 | | 1/2002 | Rosenwasser |
| 6,438,992 | B1 | | 8/2002 | Smith et al. |
| 6,453,749 | B1 | | 9/2002 | Petrovic et al. |
| 6,467,642 | B2 | * | 10/2002 | Mullens et al. ..... 220/560.1 |
| 6,485,805 | B1 | | 11/2002 | Smith et al. |
| 6,521,077 | B1 | | 2/2003 | McGivern et al. |
| 6,571,971 | B1 | | 6/2003 | Weiler |
| 6,584,797 | B1 | | 7/2003 | Smith et al. |
| 6,673,594 | B1 | | 1/2004 | Owen et al. |
| 6,688,132 | B2 | | 2/2004 | Smith et al. |
| 6,692,695 | B1 | | 2/2004 | Bronshtein et al. |
| 6,701,724 | B2 | | 3/2004 | Smith et al. |
| 6,742,650 | B2 | * | 6/2004 | Yang et al. ..... 206/0.7 |
| 6,742,673 | B2 | | 6/2004 | Credle, Jr. et al. |
| 6,751,963 | B2 | | 6/2004 | Navedo et al. |
| 6,771,183 | B2 | | 8/2004 | Hunter |
| 6,813,330 | B1 | | 11/2004 | Barker et al. |
| 6,841,917 | B2 | | 1/2005 | Potter |
| 6,877,504 | B2 | | 4/2005 | Schreff et al. |
| 6,967,051 | B1 | | 11/2005 | Augustynowicz et al. |
| 7,001,656 | B2 | | 2/2006 | Maignan et al. |
| 7,038,585 | B2 | * | 5/2006 | Hall et al. ..... 340/539.22 |
| 7,128,807 | B2 | | 10/2006 | Mörschner et al. |
| 7,240,513 | B1 | | 7/2007 | Conforti |
| 7,253,788 | B2 | | 8/2007 | Choi et al. |
| 7,258,247 | B2 | | 8/2007 | Marquez |
| 7,267,795 | B2 | | 9/2007 | Ammann et al. |
| 7,278,278 | B2 | | 10/2007 | Wowk et al. |
| 7,596,957 | B2 | | 10/2009 | Fuhr et al. |
| 7,789,258 | B1 | | 9/2010 | Anderson |
| 7,807,242 | B2 | | 10/2010 | Soerensen et al. |

(56) References Cited

U.S. PATENT DOCUMENTS

| | | | |
|---|---|---|---|
| 7,982,673 | B2 | 7/2011 | Orton et al. |
| 8,211,516 | B2 | 7/2012 | Bowers et al. |
| 2002/0050514 | A1 | 5/2002 | Schein |
| 2002/0083717 | A1 | 7/2002 | Mullens et al. |
| 2002/0084235 | A1 | 7/2002 | Lake |
| 2002/0130131 | A1 | 9/2002 | Zucker et al. |
| 2002/0187618 | A1 | 12/2002 | Potter |
| 2003/0039446 | A1 | 2/2003 | Hutchinson et al. |
| 2003/0072687 | A1 | 4/2003 | Nehring et al. |
| 2003/0148773 | A1 | 8/2003 | Spriestersbach et al. |
| 2003/0160059 | A1 | 8/2003 | Credle, Jr. et al. |
| 2004/0035120 | A1 | 2/2004 | Brunnhofer |
| 2004/0055313 | A1 | 3/2004 | Navedo et al. |
| 2004/0055600 | A1 | 3/2004 | Izuchukwu |
| 2004/0103302 | A1 | 5/2004 | Yoshimura et al. |
| 2005/0009192 | A1 | 1/2005 | Page |
| 2005/0067441 | A1 | 3/2005 | Alley |
| 2005/0143787 | A1 | 6/2005 | Boveja et al. |
| 2005/0247312 | A1 | 11/2005 | Davies |
| 2005/0274378 | A1 | 12/2005 | Bonney et al. |
| 2006/0021355 | A1 | 2/2006 | Boesel et al. |
| 2006/0071585 | A1 | 4/2006 | Wang |
| 2006/0150662 | A1 | 7/2006 | Lee et al. |
| 2006/0191282 | A1 | 8/2006 | Sekiya et al. |
| 2006/0196876 | A1 | 9/2006 | Rohwer |
| 2006/0259188 | A1 | 11/2006 | Berg |
| 2007/0041814 | A1 | 2/2007 | Lowe |
| 2007/0210090 | A1 | 9/2007 | Sixt et al. |
| 2008/0060215 | A1 | 3/2008 | Reilly et al. |
| 2008/0164265 | A1 | 7/2008 | Conforti |
| 2008/0184719 | A1 | 8/2008 | Lowenstein |
| 2008/0186139 | A1 | 8/2008 | Butler et al. |
| 2008/0233391 | A1 | 9/2008 | Sterzel et al. |
| 2008/0269676 | A1 | 10/2008 | Bieberich et al. |
| 2008/0272131 | A1 | 11/2008 | Roberts et al. |
| 2009/0275478 | A1 | 11/2009 | Atkins et al. |
| 2009/0301125 | A1 | 12/2009 | Myles et al. |
| 2010/0016168 | A1 | 1/2010 | Atkins et al. |
| 2010/0028214 | A1 | 2/2010 | Howard et al. |
| 2010/0287963 | A1 | 11/2010 | Billen et al. |
| 2011/0117538 | A1 | 5/2011 | Niazi |

FOREIGN PATENT DOCUMENTS

| | | | |
|---|---|---|---|
| CN | 1496537 | A | 5/2004 |
| CN | 1756912 | A | 4/2006 |
| CN | 1827486 | A | 9/2006 |
| CN | 101073524 | A | 11/2007 |
| FR | 2 621 685 | | 10/1987 |
| GB | 2 441 636 | A | 3/2008 |
| WO | WO 94/15034 | | 7/1994 |
| WO | WO 99/36725 | A1 | 7/1999 |
| WO | WO 2005/084353 | A2 | 9/2005 |
| WO | WO 2007/039553 | A2 | 4/2007 |

OTHER PUBLICATIONS

Adams, R. O.; "A review of the stainless steel surface"; The Journal of Vacuum Science and Technology A; Bearing a date of Jan.-Mar. 1983; pp. 12-18; vol. 1, No. 1; American Vacuum Society.

Arora, Anubhav; Hakim, Itzhak; Baxter, Joy; Rathnasingham, Ruben; Srinivasan, Ravi; Fletcher, Daniel A.; "Needle-Free Delivery of Macromolecules Across the Skin by Nanoliter-Volume Pulsed Microjets"; PNAS Applied Biological Sciences; Mar. 13, 2007; pp. 4255-4260; vol. 104; No. 11; The National Academy of Sciences USA.

Bang, Abhay T.; Bang, Rani A.; Baitule, Sanjay B.; Reddy, M. Hanimi; Deshmukh, Mahesh D.; "Effect of Home-Based Neonatal Care and Management of Sepsis on Neonatal Mortality: Field Trial in Rural India"; The Lancet; Dec. 4, 1999; pp. 1955-1961; vol. 354; SEARCH (Society for Education, Action, and Research in Community Health).

Bapat, S. L. et al.; "Experimental investigations of multilayer insulation"; *Cryogenics*; Bearing a date of Aug. 1990; pp. 711-719; vol. 30.

Bapat, S. L. et al.; "Performance prediction of multilayer insulation"; *Cryogenics*; Bearing a date of Aug. 1990; pp. 700-710; vol. 30.

Barth, W. et al.; "Experimental investigations of superinsulation models equipped with carbon paper"; *Cryogenics*; Bearing a date of May 1988; pp. 317-320; vol. 28.

Barth, W. et al.; "Test results for a high quality industrial superinsulation"; *Cryogenics*; Bearing a date of Sep. 1988; pp. 607-609; vol. 28.

Bartl, J., et al.; "Emissivity of aluminium and its importance for radiometric measurement"; Measurement Science Review; Bearing a date of 2004; pp. 31-36; vol. 4, Section 3.

Beavis, L. C.; "Interaction of Hydrogen with the Surface of Type 304 Stainless Steel"; The Journal of Vacuum Science and Technology; Bearing a date of Mar.-Apr. 1973; pp. 386-390; vol. 10, No. 2; American Vacuum Society.

Benvenuti, C.; "Decreasing surface outgassing by thin film getter coatings"; *Vacuum*; Bearing a date of 1998; pp. 57-63; vol. 50; No. 1-2; Elsevier Science Ltd.

Benvenuti, C.; "Nonevaporable getter films for ultrahigh vacuum applications"; *Journal of Vacuum Science Technology A Vacuum Surfaces, and Films*; Bearing a date of Jan./Feb. 1998; pp. 148-154; vol. 16; No. 1; American Chemical Society.

Benvenuti, C. et al.; "Obtention of pressures in the $10^{-14}$ torr range by means of a Zr V Fe non evaporable getter"; *Vacuum*; Bearing a date of 1993; pp. 511-513; vol. 44; No. 5-7; Pergamon Press Ltd.

Benvenuti, C., et al.; "Pumping characteristics of the St707 nonevaporable getter (Zr 70 V 24.6-Fe 5.4 wt %)"; The Journal of Vacuum Science and Technology A; Bearing a date of Nov.-Dec. 1996; pp. 3278-3282; vol. 14, No. 6; American Vacuum Society.

Berman, A.; "Water vapor in vacuum systems"; *Vacuum*; Bearing a date of 1996; pp. 327-332; vol. 47; No. 4; Elsevier Science Ltd.

Bernardini, M. et al.; "Air bake-out to reduce hydrogen outgassing from stainless steel"; *Journal of Vacuum Science Technology*; Bearing a date of Jan./Feb. 1998; pp. 188-193; vol. 16; No. 1; American Chemical Society.

Bo, H. et al.; "Tetradecane and hexadecane binary mixtures as phase change materials (PCMs) for cool storage in district cooling systems"; *Energy*; Bearing a date of 1999; vol. 24; pp. 1015-1028; Elsevier Science Ltd.

Boffito, C. et al.; "A nonevaporable low temperature activatable getter material"; *Journal of Vacuum Science Technology*; Bearing a date of Apr. 1981; pp. 1117-1120; vol. 18; No. 3; American Vacuum Society.

Brenzel, Logan; Wolfson, Lara J.; Fox-Rushby, Julia; Miller, Mark; Halsey, Neal A.; "Vaccine-Preventable Diseases—Chapter 20"; Disease Control Priorities in Developing Countries; printed on Oct. 15, 2007; pp. 389-411.

Brown, R.D.; "Outgassing of epoxy resins in vacumm."; *Vacuum*; Bearing a date of 1967; pp. 25-28; vol. 17; No. 9; Pergamon Press Ltd.

Burns, H. D.; "Outgassing Test for Non-metallic Materials Associated with Sensitive Optical Surfaces in a Space Environment"; MSFC-SPEC-1443; Bearing a date of Oct. 1987; pp. 1-10.

CDC; "Vaccine Management: Recommendations for Storage and Handling of Selected Biologicals"; Jan. 2007; 16 pages total; Department of Health & Human Services U.S.A.

Chen, Dexiang, et al.; "Opportunities and challenges of developing thermostable vaccines"; Expert Reviews Vaccines; 2009; pp. 547-557; vol. 8, No. 5; Expert Reviews Ltd.

Chen, G. et al.; "Performance of multilayer insulation with slotted shield"; *Cryogenics ICEC Supplement*; Bearing a date of 1994; pp. 381-384; vol. 34.

Chen, J. R.; "A comparison of outgassing rate of 304 stainless steel and A6063-EX aluminum alloy vacuum chamber after filling with water"; *Journal of Vacuum Science Technology A Vacuum Surfaces and Film*; Bearing a date of Mar. 1987; pp. 262-264; vol. 5; No. 2; American Chemical Society.

Chen, J. R. et al.; "An aluminum vacuum chamber for the bending magnet of the SRRC synchrotron light source"; *Vacuum*; Bearing a date of 1990; pp. 2079-2081; vol. 41; No. 7-9; Pergamon Press PLC.

(56) References Cited

OTHER PUBLICATIONS

Chen, J. R. et al.; "Outgassing behavior of A6063-EX aluminum alloy and SUS 304 stainless steel"; *Journal of Vacuum Science Technology*; Bearing a date of Nov./Dec. 1987; pp. 3422-3424; vol. 5; No. 6; American Vacuum Society.
Chen, J. R. et al.; "Outgassing behavior on aluminum surfaces: Water in vacuum systems"; *Journal of Vacuum Science Technology*; Bearing a date of Jul./Aug. 1994; pp. 1750-1754; vol. 12; No. 4; American Vacuum Society.
Chen, J. R. et al.; "Thermal outgassing from aluminum alloy vacuum chambers"; *Journal of Vacuum Science Technology*; Bearing a date of Nov./Dec. 1985; pp. 2188-2191; vol. 3; No. 6; American Vacuum Society.
Chiggiato, P.; "Production of extreme high vacuum with non evaporable getters" *Physica Scripta*; Bearing a date of 1997; pp. 9-13; vol. T71.
Chiritescu, Catalin; Cahill, David G.; Nguyen, Ngoc; Johnson, David; Bodapati, Arun; Keblinski, Pawel; Zschack, Paul; "Ultralow Thermal Conductivity in Disordered, Layered WSe2 Crystals; Science"; Jan. 19, 2007; pp. 351-353; vol. 315; The American Association for the Advancement of Science.
Cho, B.; "Creation of extreme high vacuum with a turbomolecular pumping system: A baking approach"; *Journal of Vacuum Science Technology*; Bearing a date of Jul./Aug. 1995; pp. 2228-2232; vol. 13; No. 4; American Vacuum Society.
Choi, S. et al.; "Gas permeability of various graphite/epoxy composite laminates for cryogenic storage systems"; *Composites Part B: Engineering*; Bearing a date of 2008; pp. 782-791; vol. 39; Elsevier Science Ltd.
Chun, I. et al.; "Effect of the Cr-rich oxide surface on fast pumpdown to ultrahigh vacuum"; *Journal of Vacuum Science Technology A Vacuum, Surfaces, and Films*; Bearing a date of Sep./Oct. 1997; pp. 2518-2520; vol. 15; No. 5; American Vacuum Society.
Chun, I. et al.; "Outgassing rate characteristic of a stainless-steel extreme high vacuum system"; *Journal of Vacuum Science Technology*; Bearing a date of Jul./Aug. 1996; pp. 2636-2640; vol. 14; No. 4; American Vacuum Society.
Cohen, Sharon; Hayes, Janice S. Tordella, Tracey; Puente, Ivan; "Thermal Efficiency of Prewarmed Cotton, Reflective, and Forced—Warm-Air Inflatable Blankets in Trauma Patients"; International Journal of Trauma Nursing; Jan.-Mar. 2002; pp. 4-8; vol. 8; No. 1; The Emergency Nurses Association.
Cole-Parmer; "Temperature Labels and Crayons"; www.coleparmer.com; bearing a date of 1971 and printed on Sep. 27, 2007; p. 1.
Cornell University Coop; "The Food Keeper"; printed on Oct. 15, 2007; 7 pages total (un-numbered).
Crawley, D J. et al.; "Degassing Characteristics of Some 'O' Ring Materials"; *Vacuum*; Bearing a date of 1963; pp. 7-9; vol. 14; Pergamon Press Ltd.
Csernatony, L.; "The Properties of Viton 'A' Elastomers II. The influence of permeation, diffusion and solubility of gases on the gas emission rate from an O-ring used as an atmospheric seal or high vacuum immersed"; *Vacuum*; Bearing a date of 1965; pp. 129-134; vol. 16; No. 3; Pergamon Press Ltd.
Daryabeigi, Kamran; "Thermal Analysis and Design Optimization of Multilayer Insulation for Reentry Aerodynamic Heating"; Journal of Spacecraft and Rockets; Jul.-Aug. 2002; pp. 509-514; vol. 39; No. 4; American Institute of Aeronautics and Astronautics Inc.
Day, C.; "The use of active carbons as cryosorbent"; *Colloids and Surfaces A Physicochemical and Engineering Aspects*; Bearing a date of 2001; pp. 187-206; vol. 187-188; Elsevier Science.
Della Porta, P.; "Gas problem and gettering in sealed-off vacuum devices"; *Vacuum*; Bearing a date of 1996; pp. 771-777; vol. 47; No. 6-8 Elsevier Science Ltd.
Demko, J. A., et al.; "Design Tool for Cryogenic Thermal Insulation Systems"; Advances in Cryogenic Engineering: Transactions of the Cryogenic Engineering Conference—CEC; Bearing a date of 2008; pp. 145-151; vol. 53; American institute of Physics.
Department of Health and Social Services, Division of Public Health, Section of Community Health and EMS, State of Alaska; Cold Injuries Guidelines—Alaska Multi-Level 2003 Version; bearing dates of 2003 and Jan. 2005; pp. 1-60; located at http://www.chems.alaska.gov.
Dylla, H. F. et al.; "Correlation of outgassing of stainless steel and aluminum with various surface treatments"; *Journal of Vacuum Science Technology*; Bearing a date of Sep./Oct. 1993; pp. 2623-2636; vol. 11; No. 5; American Vacuum Society.
Elsey, R. J. "Outgassing of vacuum material I"; *Vacuum*; Bearing a date of 1975; pp. 299-306; vol. 25; No. 7; Pergamon Press Ltd.
Elsey, R. J. "Outgassing of vacuum materials II" *Vacuum*; Bearing a date of 1975; pp. 347-361; vol. 25; No. 8; Pergamon Press Ltd.
Engelmann, G. et al.; "Vacuum chambers in composite material"; *Journal of Vacuum Science Technology*; Bearing a date of Jul./Aug. 1987; pp. 2337-2341; vol. 5; No. 4; American Vacuum Society.
Ette, Ene I.; "Conscience, the Law, and Donation of Expired Drugs"; The Annals of Pharmacotherapy; Jul./Aug. 2004; pp. 1310-1313; vol. 38.
Eyssa, Y. M. et al.; "Thermodynamic optimization of thermal radiation shields for a cryogenic apparatus"; *Cryogenics*; Bearing a date of May 1978; pp. 305-307; vol. 18; IPC Business Press.
Ferrotec; "Ferrofluid: Magnetic Liquid Technology"; bearing dates of 2001-2008; printed on Mar. 10, 2008; found at http://www.ferrotec.com/technology/ferrofluid.php.
Fricke, Jochen; Emmerling, Andreas; "Aerogels—Preparation, Properties, Applications"; Structure and Bonding; 1992; pp. 37-87; vol. 77; Springer-Verlag Berlin Heidelberg.
Glassford, A. P. M. et al.; "Outgassing rate of multilayer insulation"; 1978; Bearing a date of 1978; pp. 83-106.
Greenbox Systems; "Thermal Management System"; 2010; Printed on: Feb. 3, 2011; p. 1 of 1; located at http://www.greenboxsystems.com.
Gupta, A. K. et al.; "Outgassing from epoxy resins and methods for its reduction"; *Vacuum*; Bearing a date of 1977; pp. 61-63; vol. 27; No. 12; Pergamon Press Ltd.
Halaczek, T. et al.; "Flat-plate cryostat for measurements of multilayer insulation thermal conductivity"; *Cryogenics*; Bearing a date of Oct. 1985; pp. 593-595; vol. 25; Butterworth & Co. Ltd.
Halaczek, T. et al.; "Unguarded cryostat for thermal conductivity measurements of multilayer insulations"; *Cryogenics*; Bearing a date of Sep. 1985; pp. 529-530; vol. 25; Butterworth & Co. Ltd.
Halaczek, T. L. et al.; "Heat transport in self-pumping multilayer insulation"; *Cryogenics*; Bearing a date of Jun. 1986; pp. 373-376; vol. 26; Butterworth & Co. Ltd.
Halaczek, T. L. et al.; "Temperature variation of thermal conductivity of self-pumping multilayer insulation"; *Cryogenics*; Bearing a date of Oct. 1986; pp. 544-546.; vol. 26; Butterworth & Co. Ltd.
Halldórsson, Árni, et al.; "The sustainable agenda and energy efficiency: Logistics solutions and supply chains in times of climate change"; *International Journal of Physical Distribution & Logistics Management*; Bearing a date of 2010; pp. 5-13; vol. 40; No. ½; Emerald Group Publishing Ltd.
Halliday, B. S.; "An introduction to materials for use in vacuum"; *Vacuum*; Bearing a date of 1987; pp. 583-585; vol. 37; No. 8-9; Pergamon Journals Ltd.
Hedayat, A., et al.; "Variable Density Multilayer Insulation for Cryogenic Storage"; Bearing a date of 2000; pp. 1-10.
Hirohata, Y.; "Hydrogen desorption behavior of aluminium materials used for extremely high vacuum chamber"; *Journal of Vacuum Science Technology*; Bearing a date of Sep./Oct. 1993; pp. 2637-2641; vol. 11; No. 5; American Vacuum Society.
Holtrop, K. L. et al.; "High temperature outgassing tests on materials used in the DIII-D tokamak"; *Journal of Vacuum Science Technology*; Bearing a date of Jul./Aug. 2006; pp. 1572-; vol. 24; No. 4; American Vacuum Society.
Hong, S. et al.; "Investigation of gas species in a stainless steel ultrahigh vacuum chamber with hot cathode ionization gauges"; *Measurement Science and Technology*; Bearing a date of 2004; pp. 359-364; vol. 15; IOP Science.
Horgan, A. M., et al.; "Hydrogen and Nitrogen Desorption Phenomena Associated with a Stainless Steel 304 Low Energy Electron Diffraction (LEED) and Molecular Beam Assembly"; The Journal of Vacuum Science and Technology; Bearing a date of Jul.-Aug. 1972; pp. 1218-1226; vol. 9, No. 4.

(56) References Cited

OTHER PUBLICATIONS

Ishikawa, Y.; "An overview of methods to suppress hydrogen outgassing rate from austenitic stainless steel with reference to UHV and EXV"; *Vacuum*; Bearing a date of 2003; pp. 501-512; vol. 69; No. 4; Elsevier Science Ltd.
Ishikawa, Y. et al.; "Reduction of outgassing from stainless surfaces by surface oxidation"; *Vacuum*; Bearing a date of 1990; pp. 1995-1997; vol. 4; No. 7-9; Pergamon Press PLC.
Ishimaru, H.; "All-aluminum-alloy ultrahigh vacuum system for a large-scale electron-positron collider"; *Journal of Vacuum Science Technology*; Bearing a date of Jun. 1984; pp. 1170-1175; vol. 2; No. 2; American Vacuum Society.
Ishimaru, H.; "Aluminium alloy-sapphire sealed window for ultrahigh vacuum"; *Vacuum*; Bearing a date of 1983; pp. 339-340.; vol. 33; No. 6; Pergamon Press Ltd.
Ishimaru, H.; "Bakeable aluminium vacuum chamber and bellows with an aluminium flange and metal seal for ultra-high vacuum"; *Journal of Vacuum Science Technology*; Bearing a date of Nov./Dec. 1978; pp. 1853-1854; vol. 15; No. 6; American Vacuum Society.
Ishimaru, H.; "Ultimate pressure of the order of $10^{-13}$ Torr in an aluminum alloy vacuum chamber"; *Journal of Vacuum Science and Technology*; Bearing a date of May/Jun. 1989; pp. 2439-2442; vol. 7; No. 3; American Vacuum Society.
Ishimaru, H. et al.; "All Aluminum Alloy Vacuum System for the TRISTAN e+ e− Storage"; *IEEE Transactions on Nuclear Science*; Bearing a date of Jun. 1981; pp. 3320-3322; vol. NS-28; No. 3.
Ishimaru, H. et al.; "Fast pump-down aluminum ultrahigh vacuum system"; *Journal of Vacuum Science Technology*; Bearing a date of May/Jun. 1992; pp. 547-552 ; vol. 10; No. 3; American Vacuum Society.
Ishimaru, H. et al.; "Turbomolecular pump with an ultimate pressure of $10^{-12}$ Torr"; *Journal of Vacuum Science Technology*; Bearing a date of Jul./Aug. 1994; pp. 1695-1698; vol. 12; No. 4; American Vacuum Society.
Jacob, S. et al.; "Investigations into the thermal performance of multilayer insulation (300-77 K) Part 1: Calorimetric studies"; *Cryogenics*; Bearing a date of 1992; pp. 1137-1146; vol. 32; No. 12; Butterworth-Heinemann Ltd.
Jacob, S. et al.; "Investigations into the thermal performance of multilayer insulation (300-77 K) Part 2: Thermal analysis"; *Cryogenics*; Bearing a date of 1992; pp. 1147-1153; vol. 32; No. 12; Butterworth-Heinemann Ltd.
JAMC; "Preventing Cold Chain Failure: Vaccine Storage and Handling"; JAMC; Oct. 26, 2004; p. 1050; vol. 171; No. 9; Canadian Medical Association.
Jenkins, C. H. M.; "Gossamer spacecraft: membrane and inflatable structures technology for space applications"; AIAA; Bearing a date of 2000; pp. 503-527; vol. 191.
Jhung, K. H. C. et al.; "Achievement of extremely high vacuum using a cryopump and conflat aluminium"; *Vacuum*; Bearing a date of 1992; pp. 309-311; vol. 43; No. 4; Pergamon Press PLC.
Jorgensen, Pernille; Chanthap, Lon; Rebueno, Antero; Tsuyuoka, Reiko; Bell, David; "Malaria Rapid Diagnostic Tests in Tropical Climates: The Need for a Cool Chain"; American Journal of Tropical Medicine and Hygiene; 2006; pp. 750-754; vol. 74; No. 5; The American Society of Tropical Medicine and Hygiene.
Kato, S. et al.; "Achievement of extreme high vacuum in the order of $10^{-10}$ Pa without baking of test chamber"; *Journal of Vacuum Science Technology*; Bearing a date of May/Jun. 1990; pp. 2860-2864; vol. 8 ; No. 3; American Vacuum Society.
Keller, C. W., et al.; "Thermal Performance of Multilayer Insulations, Final Report, Contract NAS 3-14377"; Bearing a date of Apr. 5, 1974; pp. 1-446.
Keller, K. et al.; "Application of high temperature multilayer insulations"; *Acta Astronautica* ; Bearing a date of 1992; pp. 451-458; vol. 26; No. 6; Pergamon Press Ltd.
Kishiyama, K., et al.; "Measurement of Ultra Low Outgassing Rates for NLC UHV Vacuum Chambers"; Proceedings of the 2001 Particle Accelerator Conference, Chicago; Bearing a date of 2001; pp. 2195-2197; IEEE.
Koyatsu, Y. et al. "Measurements of outgassing rate from copper and copper alloy chambers"; *Vacuum*; Bearing a date of 1996; pp. 709-711; vol. 4; No. 6-8; Elsevier Science Ltd.
Kristensen, D. et al.; "Stabilization of vaccines: Lessons learned"; *Human Vaccines*; Bearing a date of Mar. 2010; pp. 227-231; vol. 6; No. 3; Landes Bioscience.
Kropschot, R. H.; "Multiple layer insulation for cryogenic applications"; *Cryogenics*; Bearing a date of Mar. 1961; pp. 135-135; vol. 1.
Levin, Carol E.; Nelson, Carib M.; Widjaya, Anton; Moniaga, Vanda; Anwar, Chairiyah; "The Costs of Home Delivery of a Birth Dose of Hepatitis B Vaccine in a Prefilled Syringe in Indonesia"; Bulletin of the World Health Organization; Jun. 2005; pp. 456-461 + 1 pg. Addenda; vol. 83; No. 6.
Li, Y.; "Design and pumping characteristics of a compact titanium—vanadium non-evaporable getter pump"; *Journal of Vacuum Science Technology*; Bearing a date of May/Jun. 1998; pp. 1139-1144; vol. 16; No. 3; American Vacuum Society.
Little, Arthur D.; "Liquid Propellant Losses During Space Flight, Final Report on Contract No. NASw-615"; Bearing a date of Oct. 1964; pp. 1-315.
Liu, Y. C. et al.; "Thermal outgassing study on aluminum surfaces"; *Vacuum*; Bearing a date of 1993; pp. 435-437; vol. 44; No. 5-7; Pergamon Press Ltd.
Llanos-Cuentas, A.; Campos, P.; Clendenes, M.; Canfield. C.J.; Hutchinson, D.B.A.; "Atovaquone and Proguanil Hydrochloride Compared with Chloroquine or Pyrimethamine/Sulfadoxine for Treatment of Acute Plasmodium Falciparum Malaria in Peru"; The Brazilian Journal of Infectious Diseases; 2001; pp. 67-72; vol. 5; No. 2; The Brazilian Journal of Infectious Diseases and Contexto Publishing.
Lockheed Missiles & Space Company; "High-Performance Thermal Protection Systems, Contract NAS 8-20758, vol. II"; Bearing a date of Dec. 31, 1969; pp. 1-117.
Lockman, Shahin; Ndase, P.; Holland, D.; Shapiro, R.; Connor, J.; Capparelli, E.; "Stability of Didanosine and Stavudine Pediatric Oral Solutions and Kaletra Capsules at Temperatures from 4° C. to 55° C."; 12th Conference on Retroviruses and Opportunistic Infections, Boston, Massachusetts; Feb. 22-25, 2005; p. 1; Foundation for Retrovirology and Human Health.
Londer, H. et al.; "New high capacity getter for vacuum insulated mobile $LH_2$ storage tank systems"; *Vacuum*; Bearing a date of 2008; pp. 431-434; vol. 82; No. 4; Elsevier Ltd.
Ma, Kun-Quan; and Liu, Jing; "Nano liquid-metal fluid as ultimate coolant"; Physics Letters A; bearing dates of Jul. 10, 2006, Sep. 9, 2006, Sep. 18, 2006, Sep. 26, 2006, and Jan. 29, 2007; pp. 252-256; vol. 361, Issue 3; Elsevier B.V.
Matsuda, A. et al.; "Simple structure insulating material properties for multilayer insulation"; *Cryogenics*; Bearing a date of Mar. 1980; pp. 135-138; vol. 20; IPC Business Press.
Matthias, Dipika M., et al.; "Freezing temperatures in the vaccine cold chain: A systematic literature review"; Vaccine; 2007; pp. 3980-3986; vol. 25; Elsevier Ltd.
Mikhalchenko, R. S. et al.; "Study of heat transfer in multilayer insulations based on composite spacer materials."; *Cryogenics*; Bearing a date of Jun. 1983; pp. 309-311; vol. 23; Butterworth & Co. Ltd.
Mikhalchenko, R. S. et al.; "Theoretical and experimental investigation of radiative-conductive heat transfer in multilayer insulation"; *Cryogenics*; Bearing a date of May 1985; pp. 275-278; vol. 25; Butterworth & Co. Ltd.
Miki, M. et al.; "Characteristics of extremely fast pump-down process in an aluminum ultrahigh vacuum system"; *Journal of Vacuum Science Technology*; Bearing a date of Jul./Aug. 1994; pp. 1760-1766; vol. 12; No. 4; American Vacuum Society.
Mohri, M. et al.; "Surface study of Type 6063 aluminium alloys for vacuum chamber materials"; *Vacuum*; Bearing a date of 1984; pp. 643-647; vol. 34; No. 6; Pergamon Press Ltd.
Moonasar, Devanand; Goga, Ameena Ebrahim; Frean, John; Kruger, Philip; Chandramohan; Daniel; "An Exploratory Study of Factors that Affect the Performance and Usage of Rapid Diagnostic Tests for Malaria in the Limpopo Province, South Africa"; Malaria Journal; Jun. 2007; pp. 1-5; vol. 6; No. 74; Moonasar et al.; licensee BioMed Central Ltd.

(56) References Cited

OTHER PUBLICATIONS

Moshfegh, B.; "A New Thermal Insulation System for Vaccine Distribution; Journal of Thermal Insulation"; Jan. 1992; pp. 226-247; vol. 15; Technomic Publishing Co., Inc.
Mukugi, K. et al.; "Characteristics of cold cathode gauges for outgassing measurements in uhv range"; *Vacuum*; Bearing a date of 1993; pp. 591-593; vol. 44; No. 5-7; Pergamon Press Ltd.
Nemanič, V.; "Outgassing of thin wall stainless steel chamber"; *Vacuum*; Bearing a date of 1998; pp. 431-437; vol. 50; No. 3-4; Elsevier Science Ltd.
Nemanič, V.; "Vacuum insulating panel"; *Vacuum*; bearing a date of 1995; pp. 839-842; vol. 46; No. 8-10; Elsevier Science Ltd.
Nemanič, V. et al.; "Anomalies in kinetics of hydrogen evolution from austenitic stainless steel from 300 to 1000° C."; *Journal of Vacuum Science Technology*; Bearing a date of Jan./Feb. 2001; pp. 215-222; vol. 19; No. 1; American Vacuum Society.
Nemanič, V. et al.; "Outgassing in thin wall stainless steel cells"; *Journal of Vacuum Science Technology*; Bearing a date of May/Jun. 1999; pp. 1040-1046; vol. 17; No. 3; American Vacuum Society.
Nemanič, Vincenc, et al.; "A study of thermal treatment procedures to reduce hydrogen outgassing rate in thin wall stainless steel cells"; Vacuum; Bearing a date of 1999; pp. 277-280; vol. 53; Elsevier Science Ltd.
Nemanič, Vincenc, et al.; "Experiments with a thin-walled stainless-steel vacuum chamber"; The Journal of Vacuum Science and Technology A; Bearing a date of Jul.-Aug. 2000; pp. 1789-1793; vol. 18, No. 4; American Vacuum Society.
Nemanič, Vincenc, et al.; "Outgassing of a thin wall vacuum insulating panel"; Vacuum; Bearing a date of 1998; pp. 233-237; vol. 49, No. 3; Elsevier Science Ltd.
Nolan, Timothy D. C.; Hattler, Brack G.; Federspiel, William J.; "Development of a Balloon Volume Sensor for Pulsating Balloon Catheters"; ASAIO Journal; 2004; pp. 225-233; vol. 50; No. 3; American Society of Artificial Internal Organs.
Odaka, K.; "Dependence of outgassing rate on surface oxide layer thickness in type 304 stainless steel before and after surface oxidation in air"; *Vacuum*; Bearing a date of 1996; pp. 689-692; vol. 47; No. 6-8; Elsevier Science Ltd.
Odaka, K. et al.;"Effect of baking temperature and air exposure on the outgassing rate of type 316L stainless steel"; *Journal of Vacuum Science Technology*; Bearing a date of Sep./Oct. 1987; pp. 2902-2906; vol. 5; No. 5; American Vacuum Society.
Okamura, S. et al.; "Outgassing measurement of finely polished stainless steel"; *Journal of Vacuum Science Technology*; Bearing a date of Jul./Aug. 1991; pp. 2405-2407; vol. 9; No. 4; American Vacuum Society.
PATH—A Catalyst for Global Health; "Uniject™ Device—The Radically Simple Uniject™ Device—Rethinking the Needle to Improve Immunization"; bearing dates of 1995-2006; printed on Oct. 11, 2007; pp. 1-2; located at http://www.path.org/projects/uniject.php; PATH Organization.
Patrick, T. J.; "Outgassing and the choice of materials for space instrumentation"; *Vacuum*; Bearing a date of 1973; pp. 411-413; vol. 23; No. 11; Pergamon Press Ltd.
Patrick, T. J.; "Space environment and vacuum properties of spacecraft materials"; *Vacuum*; Bearing a date of 1981; pp. 351-357; vol. 31; No. 8-9; Pergamon Press Ltd.
Pau, Alice K.; Moodley, Neelambal K.; Holland, Diane T.; Fomundam, Henry; Matchaba, Gugu U.; and Capparelli, Edmund V.; "Instability of lopinavir/ritonavir capsules at ambient temperatures in sub-Saharan Africa: relevance to WHO antiretroviral guidelines"; AIDS; Bearing dates of 2005, Mar. 29, 2005, and Apr. 20, 2005; pp. 1229-1236; vol. 19, No. 11; Lippincott Williams & Wilkins.
PCT International Search Report; International App. No. PCT/US09/01715; Jan. 8, 2010; pp. 1-2.
PCT International Search Report; International App. No. PCT/US08/13646; Apr. 9, 2009; pp. 1-2.
PCT International Search Report; International App. No. PCT/US08/13648; Mar. 13, 2009; pp. 1-2.
PCT International Search Report; International App. No. PCT/US08/13642; Feb. 26, 2009; pp. 1-2.
PCT International Search Report; International App. No. PCT/US08/13643; Feb. 20, 2009; pp. 1-2.
Pekala, R. W.; "Organic Aerogels From the Polycondensation of Resorcinol With Formaldehyde"; Journal of Materials Science; Sep. 1989; pp. 3221-3227; vol. 24; No. 9; Springer Netherlands.
Pickering, Larry K.; Wallace, Gregory; Rodewald, Lance; "Too Hot, Too Cold: Issues with Vaccine Storage"; Pediatrics®—Official Journal of the American Academy of Pediatrics; 2006; pp. 1738-1739 (4 pages total, incl. cover sheet and end page); vol. 118; American Academy of Pediatrics.
Poole, K. F. et al.; "Hialvac and Teflon outgassing under ultra-high vacuum conditions"; *Vacuum*; Bearing a date of Jun. 30, 1980; pp. 415-417; vol. 30; No. 10; Pergamon Press Ltd.
Post, Richard F.; "Maglev: A New Approach"; Scientific American; Jan. 2000; pp. 82-87; Scientific American, Inc.
Program for Appropriate Technology in Health (PATH); "The Radically Simple Uniject Device"; PATH—Reflections on Innovations in Global Health; printed on Jan. 26, 2007; pp. 1-4; located at www.path.org.
Pure Temp; "Technology"; Printed on: Feb. 9, 2011; p. 1-3; located at http://puretemp.com/technology.html.
Redhead, P. A.; "Recommended practices for measuring and reporting outgassing data"; *Journal of Vacuum Science Technology*; Bearing a date of Sep./Oct. 2002; pp. 1667-1675; vol. 20; No. 5; American Vacuum Society.
Reeler, Anne V.; Simonsen, Lone; Health Access International; "Unsafe Injections, Fatal Infections"; Bill and Melinda Gates Children's Vaccine Program Occasional Paper #2; May 2000; pp. 1-8; located at www.ChildrensVaccine.org/html/safe_injection.htm.
Risha, Peter G.; Shewiyo, Danstan; Msami, Amani; Masuki, Gerald; Vergote, Geert; Vervaet, Chris; Remon, Jean Paul; "In vitro Evaluation of the Quality of Essential Drugs on the Tanzanian Market"; Tropical Medicine and International Health; Aug. 2002; pp. 701-707; vol. 7; No. 8; Blackwell Science Ltd.
Rutherford, S; "The Benefits of Viton Outgassing"; Bearing a date of 1997; pp. 1-5; Duniway Stockroom Corp.
Saito, K. et al.; "Measurement system for low outgassing materials by switching between two pumping paths"; *Vacuum*; Bearing a date of 1996; pp. 749-752; vol. 47; No. 6-8; Elsevier Science Ltd.
Saitoh, M. et al.; "Influence of vacuum gauges on outgassing rate measurements"; *Journal of Vacuum Science Technology*; Bearing a date of Sep./Oct. 1993; pp. 2816-2821; vol. 11; No. 5; American Vacuum Society.
Santhanam, S. M. T. J. et al. ;"Outgassing rate of reinforced epoxy and its control by different pretreatment methods"; *Vacuum*; Bearing a date of 1978; pp. 365-366; vol. 28; No. 8-9; Pergamon Press Ltd.
Sasaki, Y. T.; "Reducing SS 304/316 hydrogen outgassing to $2\times10^{-15}$torr $\sqrt{cm}$ $^{2}$s"; *Journal of Vacuum Science Technology*; Bearing a date of Jul./Aug. 2007; pp. 1309-1311; vol. 25; No. 4; American Vacuum Society.
Sasaki, Y. Tito; "A survey of vacuum material cleaning procedures: A subcommittee report of the American Vacuum Society Recommended Practices Committee"; The Journal of Vacuum Science and Technology A; Bearing a date of May-Jun. 1991; pp. 2025-2035; vol. 9, No. 3; American Vacuum Society.
Scurlock, R. G. et al.; "Development of multilayer insulations with thermal conductivities below 0.1 μW $cm^{-1}$ $K^{-1}$"; *Cryogenics*; Bearing a date of May 1976; pp. 303-311; vol. 16.
Setia, S. et al.; "Frequency and causes of vaccine wastage"; *Vaccine* ; Bearing a date of 2002; pp. 1148-1156; vol. 20; Elsevier Science Ltd.
Seto, Joyce; Marra, Fawziah; "Cold Chain Management of Vaccines"; Continuing Pharmacy Professional Development Home Study Program; Feb. 2005; pp. 1-19; University of British Columbia.
Shockwatch; "Environmental Indicators"; printed on Sep. 27, 2007; pp. 1-2; located at www.shockwatch.com.
Shu, Q. S. et al.; "Heat flux from 277 to 77 K through a few layers of multilayer insulation"; *Cryogenics*; Bearing a date of Dec. 1986; pp. 671-677; vol. 26; Butterworth & Co. Ltd.

(56) References Cited

OTHER PUBLICATIONS

Shu, Q. S. et al.; "Systematic study to reduce the effects of cracks in multilayer insulation Part 1: Theoretical model"; *Cryogenics*; Bearing a date of May 1987; pp. 249-256; vol. 27; Butterworth & Co. Ltd.
Shu, Q. S. et al.; "Systematic study to reduce the effects of cracks in multilayer insulation Part 2: experimental results"; *Cryogenics*; Bearing a date of Jun. 1987; pp. 298-311; vol. 27; No. 6; Butterworth & Co. Ltd.
Spur Industries Inc.; "The Only Way to Get Them Apart is to Melt Them Apart"; 2006; pp. 1-3; located at http://www.spurind.com/applications.php.
Suemitsu, M. et al.; "Development of extremely high vacuums with mirror-polished Al-alloy chambers"; *Vacuum*; Bearing a date of 1993; pp. 425-428; vol. 44; No. 5-7; Pergamon Press Ltd.
Suemitsu, M. et al.; "Ultrahigh-vacuum compatible mirror-polished aluminum-alloy surface: Observation of surface-roughness-correlated outgassing rates"; *Journal of Vacuum Science Technology*; Bearing a date of May/Jun. 1992; pp. 570-572; vol. 10; No. 3; American Vacuum Society.
Suttmeier, Chris; "Warm Mix Asphalt: A Cooler Alternative"; Material Matters—Around the Hot Mix Industry; Spring 2006; pp. 21-22; Peckham Materials Corporation.
Tatenuma, K. et al.; "Acquisition of clean ultrahigh vacuum using chemical treatment"; *Journal of Vacuum Science Technology*; Bearing a date of Jul./Aug. 1998; pp. 2693-2697; vol. 16; No. 4; American Vacuum Society.
Tatenuma, K.; "Quick acquisition of clean ultrahigh vacuum by chemical process technology"; *Journal of Vacuum Science Technology*; Bearing a date of Jul./Aug. 1993; pp. 2693-2697; vol. 11; No. 4; American Vacuum Society.
Thompson, Marc T.; "Eddy current magnetic levitation—Models and experiments"; IEEE Potentials; Feb./Mar. 2000; pp. 40-46; IEEE.
Tripathi, A. et al.; "Hydrogen intake capacity of ZrVFe alloy bulk getters"; *Vacuum*; Bearing a date of Aug. 6, 1997; pp. 1023-1025; vol. 48; No. 12; Elsevier Science Ltd.
"Two Wire Gage / Absolute Pressure Transmitters—Model 415 and 440"; Honeywell Sensotec; printed 2007; pp. 1-2; Located at www.sensotec.com and www.honeywell.com/sensing.
UNICEF Regional Office for Latin America & the Carribean (UNICEF-TACRO); Program for Appropriate Technology in Health (PATH); "Final Report Cold Chain Workshop," Panama City, May 31-Jun. 2, 2006; pp. 1-4 plus cover sheet, table of contents, and annexes A, B and C (22 pages total).
U.S. Department of Health and Human Services, Centers for Disease Control and Prevention; "Recommended Immunization Schedule for Persons Aged 0 Through 6 Years—United States"; Bearing a date of 2009; p. 1.
Vesel, Alenka, et al.; "Oxidation of AISI 304L stainless steel surface with atomic oxygen"; Applied Surface Science; Bearing a date of 2002; pp. 94-103; vol. 200; Elsevier Science B.V.
Watanabe, S. et al.; "Reduction of outgassing rate from residual gas analyzers for extreme high vacuum measurements"; *Journal of Vacuum Science Technology*; Bearing a date of Nov./Dec. 1996; pp. 3261-3266; vol. 14; No. 6; American Vacuum Society.
Wiedemann, C. et al.; "Multi-layer Insulation Literatures Review"; *Advances*; Printed on May 2, 2011; pp. 1-10; German Aerospace Center.
Williams, Preston; "Greenbox Thermal Management System Refrigerate-able 2 to 8 C Shipping Containers"; Printed on: Feb. 9, 2011; p. 1; located at http://www.puretemp.com/documents/Refrigerate-able%202%20to%208%20C%20Shipping%20Containers.pdf.
Wirkas, Theo, et al.; "A vaccine cold chain freezing study in PNG highlights technology needs for hot climate countries"; Vaccine; 2007; pp. 691-697; vol. 25; Elsevier Ltd.
World Health Organization; "Getting started with vaccine vial monitors; Vaccines and Biologicals"; World Health Organization; Dec. 2002; pp. 1-20 plus cover sheets, end sheet, contents pages, abbreviations page; revision history page and acknowledgments page (29 pages total); World Health Organization; located at www.who.int/vaccines-documents.
World Health Organization; "Getting started with vaccine vial monitors—Questions and answers on field operations"; Technical Session on Vaccine Vial Monitors, Mar. 27, 2002, Geneva; pp. 1-17 (p. 2 left intentionally blank); World Health Organization.
World Health Organization; "Preventing Freeze Damage to Vaccines: Aide-memoire for prevention of freeze damage to vaccines"; 2007; pp. 1-4; WHO/IVB/07.09; World Health Organization.
World Health Organization; "Temperature sensitivity of vaccines"; Department of Immunization, Vaccines and Biologicals, World Health Organization; Aug. 2006; pp. 1-62 plus cover sheet, pp. i-ix, and end sheet (73 pages total); WHO/IVB/06.10; World Health Organization.
Yamakage, Michiaki; Sasaki, Hideaki; Jeong, Seong-Wook; Iwasaki, Sohshi; Namiki, Akiyoshi; "Safety and Beneficial Effect on Body Core Temperature of Prewarmed Plasma Substitute Hydroxyethyl Starch During Anesthesia" [Abstract]; Anesthesiology; 2004; p. A-1285; vol. 101; ASA.
Yamazaki, K. et al.; "High-speed pumping to UHV"; *Vacuum* ; Bearing a date of 2010; pp. 756-759; vol. 84; Elsevier Science Ltd.
Young, J. R.; "Outgassing Characteristics of Stainless Steel and Aluminum with Different Surface Treatments"; The Journal of Vacuum Science and Technology; Bearing a date of Oct. 14, 1968; pp. 398-400; vol. 6, No. 3.
Zajec, Bojan, et al.; "Hydrogen bulk states in stainless-steel related to hydrogen release kinetics and associated redistribution phenomena"; Vacuum; Bearing a date of 2001; pp. 447-452; vol. 61; Elsevier Science Ltd.
Zalba, B. et al.; "Review on thermal energy storage with phase change: materials, heat transfer analysis and applications"; *Applied Thermal Engineering*; Bearing a date of 2003; pp. 251-283; vol. 23; Elsevier Science Ltd.
Zhitomirskij, I.S. et al.; "A theoretical model of the heat transfer processes in multilayer insulation"; *Cryogenics*; Bearing a date of May 1979; pp. 265-268; IPC Business Press.
Zhu, Z. Q.; Howe, D.; "Halbach Permanent Magnet Machines and Applications: A Review"; IEE Proceedings—Electric Power Applications; Jul. 2001; pp. 299-308; vol. 148; No. 4; University of Sheffield, Department of Electronic & Electrical Engineering, Sheffield, United Kingdom.
Saes Getters; "St707 Getter Alloy for Vacuum Systems"; printed on Sep. 22, 2011; pp. 1-2; located at http://www.saegetters.com/default.aspx?idPage=212.
U.S. Appl. No. 13/200,555, Chou et al.
U.S. Appl. No. 13/199,439, Hyde et al.
U.S. Appl. No. 13/385,088, Hyde et al.
U.S. Appl. No. 13/374,218, Hyde et al.
PCT International Search Report; Application No. PCT/US2011/001939; Mar. 27, 2012; pp. 1-2.
U.S. Appl. No. 13/489,058, Bowers et al.
Chinese State Intellectual Property Office; Office Action; Chinese Application No. 200980109399.4; dated Aug. 29, 2012; pp. 1-12 (No translation provided).
Winn, Joshua N. et al.; "Omnidirectional reflection from a one-dimensional photonic crystal"; Optics Letters; Oct. 15, 1998; pp. 1573-1575; vol. 23, No. 20; Optical Society of America.
Chinese State Intellectual Property Office; Chinese Office Action; App. No. 200880119777.2; Jan. 7, 2013 (received by our agent on Jan. 9, 2013); pp. 1-12; No English Translation Available.
Chinese State Intellectual Property Office; Office Action; App. No. 200880120366.5; Feb. 17, 2013 (received by our agent Feb. 19, 2013); pp. 1-3 (No English Translation Available).
Chinese State Intellectual Property Office, Office Action; App. No. 200880119918.0; Sep. 18, 2013 (rec'd by our agent Sep. 20, 2013); pp. 1-10 (No English translation available).
Cabeza, L. F. et al.; "Heat transfer enhancement in water when used as PCM in thermal energy storage"; Applied Thermal Engineering; 2002; pp. 1141-1151; vol. 22; Elsevier Science Ltd.
Chen, Dexiang et al.; "Characterization of the freeze sensitivity of a hepatitis B vaccine"; Human Vaccines; Jan. 2009; pp. 26-32; vol. 5, Issue 1; Landes Bioscience.
Edstam, James S. et al.; "Exposure of hepatitis B vaccine to freezing temperatures during transport to rural health centers in Mongolia";

(56) References Cited

OTHER PUBLICATIONS

Preventive Medicine; 2004; pp. 384-388; vol. 39; The Institute for Cancer Prevention and Elsevier Inc.
Efe, Emine et al.; "What do midwives in one region in Turkey know about cold chain?"; Midwifery; 2008; pp. 328-334; vol. 24; Elsevier Ltd.
Günter, M. M. et al.; "Microstructure and bulk reactivity of the nonevaporable getter $Zr_{57}V_{36}Fe_7$"; J. Vac. Sci. Technol. A; Nov./Dec. 1998; pp. 3526-3535; vol. 16, No. 6; American Vacuum Society.
Hipgrave, David B. et al ; "Immunogenicity of a Locally Produced Hepatitis B Vaccine With the Birth Dose Stored Outside the Cold Chain in Rural Vietnam"; Am. J. Trop. Med. Hyg.; 2006; pp. 255-260; vol. 74, No. 2; The American Society of Tropical Medicine and Hygiene.
Hipgrave, David B. et al.; "Improving birth dose coverage of hepatitis B vaccine"; Bulletin of the World Health Organization; Jan. 2006; pp. 65-71; vol. 84, No. 1; World Health Organization.
Hobson, J. P. et al.; "Pumping of methane by St707 at low temperatures"; J. Vac. Sci. Technol. A; May/Jun. 1986; pp. 300-302; vol. 4, No. 3; American Vacuum Society.
Kendal, Alan P. et al.; "Validation of cold chain procedures suitable for distribution of vaccines by public health programs in the USA"; Vaccine; 1997; pp. 1459-1465; vol. 15, No. 12/13; Elsevier Science Ltd.
Khemis, O. et al.; "Experimental analysis of heat transfers in a cryogenic tank without lateral insulation"; Applied Thermal Engineering; 2003; pp. 2107-2117; vol. 23; Elsevier Ltd.
Li, Yang et al.; "Study on effect of liquid level on the heat leak into vertical cryogenic vessels"; Cryogenics; 2010; pp. 367-372; vol. 50; Elsevier Ltd.
Magennis, Teri et al. "Pharmaceutical Cold Chain: A Gap in the Last Mile—Part 1. Wholesaler/Distributer: Missing Audit Assurance"; Pharmaceutical & Medical Packaging News; Sep. 2010; pp. 44, 46-48, and 50; pmpnews.com.
Matolin, V. et al.; "Static SIMS study of TiZrV NEG activation"; Vacuum; 2002; pp. 177-184; vol. 67; Elsevier Science Ltd.
Nelson, Carib M. et al.; "Hepatitis B vaccine freezing in the Indonesian cold chain: evidence and solutions"; Bulletin of the World Health Organization; Feb. 2004; pp. 99-105 (plus copyright page); vol. 82, No. 2; World Health Organization.
Ren, Qian et al.; "Evaluation of an Outside-The-Cold-Chain Vaccine Delivery Strategy in Remote Regions of Western China"; Public Health Reports; Sep.-Oct. 2009; pp. 745-750; vol. 124.
Rogers, Bonnie et al.; "Vaccine Cold Chain—Part 1. Proper Handling and Storage of Vaccine"; AAOHN Journal; 2010; pp. 337-344 (plus copyright page); vol. 58, No. 8; American Association of Occupational Health Nurses, Inc.
Rogers, Bonnie et al.; Vaccine Cold Chain—Part 2. Training Personnel and Program Management; AAOHN Journal; 2010; pp. 391-402 (plus copyright page); vol. 58, No. 9; American Association of Occupational Health Nurses, Inc.
Techathawat, Sirirat et al.; "Exposure to heat and freezing in the vaccine cold chain in Thailand"; Vaccine; 2007; p. 1328-1333; vol. 25; Elsevier Ltd.
Thakker, Yogini et al.; "Storage of Vaccines in the Community: Weak Link in the Cold Chain?"; British Medical Journal; Mar. 21, 1992; pp. 756-758; vol. 304, No. 6829; BMJ Publishing Group.
Wang, Lixia et al.; "Hepatitis B vaccination of newborn infants in rural China: evaluation of a village-based, out-of-cold-chain delivery strategy"; Bulletin of the World Health Organization; Sep. 2007; pp. 688-694; vol. 85, No. 9; World Health Organization.
Wei, Wei et al.; "Effects of structure and shape on thermal performance of Perforated Multi-Layer Insulation Blankets"; Applied Thermal Engineering; 2009; pp. 1264-1266; vol. 29; Elsevier Ltd.
World Health Organization; "Guidelines on the international packaging and shipping of vaccines"; Department of Immunization, Vaccines and Biologicals; Dec. 2005; 40 pages; WHO/IVB/05.23.
Chinese State Intellectual Property Office; App. No. 200880119777.2; Mar. 30, 2012; pp. 1-10 (no translation available).
Chinese Office Action; Application No. 200880120367.X; Oct. 25. 2012 (received by our agent on Oct. 29, 2012); pp. 1-5; No English Translation Provided.
Intellectual Property Office of the People's Republic of China; Office Action; Chinese Application No. 200880119918.0; Dec. 12, 2012; pp. 1-11.
U.S. Appl. No. 13/720,328, Hyde et al.
U.S. Appl. No. 13/720,256, Hyde et al.
Chinese State Intellectual Property Office; Office Action; App. No. 200880120366.5; Jun. 1, 2012; pp. 1-19 (no English translation available).
Chinese State Intellectual Property Office; Office Action; App. No. 200880119918.0; May 27, 2013 (received by our agent on May 29, 2013); 9 pages (No English Translation Available).
BINE INFORMATIONSDIENST; "Zeolite/water refrigerators, Projekt*info* 16/10"; BINE Information Service; printed on Feb. 12, 2013; pp. 1-4; FIZ Karlsruhe, Germany; located at: http://www.bine.info/fileadmin/content/Publikationen/Englische_Infos/projekt_1610_engl_internetx.pdf.
Conde-Petit, Manuel R.; "Aqueous solutions of lithium and calcium chlorides:—Property formulations for use in air conditioning equipment design"; 2009; pp. 1-27 plus two cover pages; M. Conde Engineering, Zurich, Switzerland.
Cool-System KEG GMBH; "Cool-System presents: CoolKeg® The world's first self-chilling Keg!"; printed on Feb. 6, 2013; pp. 1-5; located at: http://www.coolsystem.de/.
U.S. Appl. No. 13/853,245, Eckhoff et al.
Dawoud, et al.; "Experimental study on the kinetics of water vapor sorption on selective water sorbents, silica gel and alumina under typical operating conditions of sorption heat pumps"; International Journal of Heat and Mass Transfer; 2003; pp. 273-281; vol. 46; Elsevier Science Ltd.
Dometic S.A.R.L.; "Introduction of Zeolite Technology into refrigeration systems, LIFE04 ENV/LU/000829, Layman's Report"; printed on Feb. 6, 2013; pp. 1-10; located at: http://ec.europa.eu/environment/life/project/Projects/index.cfm?fuseaction=home.showFile&rep=file&fil=LIFE04_ENV_LU_000829_LAYMAN.pdf.
Dow Chemical Company; "Calcium Chloride Handbook: A Guide to Properties, Forms, Storage and Handling"; Aug. 2003; pp. 1-28.
Gast Manufacturing, Inc.; "Vacuum and Pressure Systems Handbook"; printed on Jan. 3, 2013; pp. 1-20; located at: http://www.gastmfg.com/vphb/vphb_s1.pdf.
Gea Wiegand; "Pressure loss in vacuum lines with water vapour"; printed on Mar. 13, 2013; pp. 1-2; located at: http://produkte.gea-wiegand.de/GEA/GEACategory/139/index_en.html.
Hall, Larry D.; "Building Your Own Larry Hall Icyball"; printed on Mar. 27, 2013; pp. 1-4; located at: http://crosleyautoclub.com/IcyBall/HomeBuilt/HallPlans/IB_Directions.html.
Kozubal, et al.; "Desiccant Enhanced Evaporative Air-Conditioning (DEVap): Evaluation of a New Concept in Ultra Efficient Air Conditioning, Technical Report NERL/TP-5500-49722"; National Renewable Energy Laboratory; Jan. 2011; pp. i-vii, 1-60, plus three cover pages and Report Documentation Page.
machine-history.com; "Refrigeration Machines"; printed on Mar. 27, 2013; pp. 1-10; located at: http://www.machine-history.com/Refrigeration%20Machines.
Marquardt, Niels; "Introduction to the Principles of Vacuum Physics"; 1999; pp. 1-24; located at: http://www.cientificosaficionados.com/libros/CERN/vaciol-CERN.pdf.
Modern Mechanix; "Icyball Is Practical Refrigerator for Farm or Camp Use (Aug. 1930)"; bearing a date of Aug. 1930; printed on Mar. 27, 2013; pp. 1-3; located at: http://blog.modernmechanix.com/icyball-is-practical-refrigerator-for-farm-or-camp-use/.
NSM Archive; "Band structure and carrier concentration"; date of Jan. 22, 2004 provided by examiner, printed on Feb. 16, 2013; pp. 1-10, 1 additional page of archive information; located at: http://web.archive.org/20040122200811/http://www.ioffe.rssi.ru/SVA/NSM/Semicond/SiC/bandstr.html.
Oxychem; "Calcium Chloride, A Guide to Physical Properties"; printed on Jan. 3, 2013; pp. 1-9, plus two cover pages and back page; Occidental Chemical Corporation; located at: http://www.cal-chlor.com/PDF/GUIDE-physical-properties.pdf.

(56) References Cited

OTHER PUBLICATIONS

Restuccia, et al.; "Selective water sorbent for solid sorption chiller: experimental results and modeling"; International Journal of Refrigeration; 2004; pp. 284-293; vol. 27; Elsevier Ltd and IIR.
Rezk, et al.; "Physical and operating conditions effects on silica gel/water adsorption chiller performance"; Applied Energy; 2012; pp. 142-149; vol. 89; Elsevier Ltd.
Rietschle Thomas; "Calculating Pipe Size & Pressure Drops in Vacuum Systems, Section 9—Technical Reference"; printed on Jan. 3, 2013; pp. 9-5 through 9-7; located at: http://www.ejglobalinc.com/Tech.htm.
Saha, et al.; "A new generation of cooling device employing $CaCl_2$-in-silica gel-water system"; International Journal of Heat and Mass Transfer; 2009; pp. 516-524; vol. 52; Elsevier Ltd.
Uop; "An Introduction to Zeolite Molecular Sieves"; printed on Jan. 10, 2013; pp. 1-20; located at: http://www.eltrex.pl/pdf/karty/adsorbenty/ENG-Introduction%20to%20Zeolite%20Molecular%20Sieves.pdf.
Wang, et al.; "Study of a novel silica gel-water adsorption chiller. Part I. Design and performance prediction"; International Journal of Refrigeration; 2005; pp. 1073-1083; vol. 28; Elsevier Ltd and IIR.
Wikipedia; "Icyball"; Mar. 14, 2013; printed on Mar. 27, 2013; pp. 1-4; located at: http://en.wikipedia.org/wiki/Icyball.
Chinese State Intellectual Property Office; Office Action; App. No. 200880120366.5; Jun. 27, 2013; 3 pages (no English translation available).
Abdul-Wahab et al.; "Design and experimental investigation of portable solar thermoelectric refrigerator"; Renewable Energy; 2009; pp. 30-34; vol. 34; Elsevier Ltd.
Astrain et al.; "Computational model for refrigerators based on Peltier effect application"; Applied Thermal Engineering; 2005; pp. 3149-3162; vol. 25; Elsevier Ltd.
Azzouz et al.; "Improving the energy efficiency of a vapor compression system using a phase change material"; Second Conference on Phase Change Material & Slurry: Scientific Conference & Business Forum; Jun. 15-17, 2005; pp. 1-11; Yverdon-les-Bains, Switzerland.
Chatterjee et al.; "Thermoelectric cold-chain chests for storing/transporting vaccines in remote regions"; Applied Energy; 2003; pp. 415-433; vol. 76; Elsevier Ltd.
Chiu et al.; "Submerged finned heat exchanger latent heat storage design and its experimental verification"; Applied Energy; 2012; pp. 507-516; vol. 93; Elsevier Ltd.
Conway et al.; "Improving Cold Chain Technologies through the Use of Phase Change Material"; Thesis, University of Maryland; 2012; pp. ii-xv and 16-228.
Dai et al.; "Experimental investigation and analysis on a thermoelectric refrigerator driven by solar cells"; Solar Energy Materials & Solar Cells; 2003; pp. 377-391; vol. 77; Elsevier Science B.V.
U.S. Appl. No. 13/907,470, Bowers et al.
U.S. Appl. No. 13/906,909, Bloedow et al.
Ghoshal et al.; "Efficient Switched Thermoelectric Refrigerators for Cold Storage Applications"; Journal of Electronic Materials; 2009; pp. 1-6; doi: 10.1007/s11664-009-0725-3.
Groulx et al.; "Solid-Liquid Phase Change Simulation Applied to a Cylindrical Latent Heat Energy Storage System"; Excerpt from the Proceedings of the COMSOL Conference, Boston; 2009; pp. 1-7.
Jiajitsawat, Somchai; "A Portable Direct-PV Thermoelectric Vaccine Refrigerator with Ice Storage Through Heat Pipes"; Dissertation, University of Massachusetts, Lowell; 2008; three cover pages, pp. ii-x, 1-137.
Kempers et al.; "Characterization of evaporator and condenser thermal resistances of a screen mesh wicked heat pipe"; International Journal of Heat and Mass Transfer; 2008; pp. 6039-6046; vol. 51; Elsevier Ltd.
Mohamad et al.; "An Analysis of Sensitivity Distribution Using Two Differential Excitation Potentials in ECT"; IEEE Fifth International Conference on Sensing Technology; 2011; pp. 575-580; IEEE.
Mohamad et al.; "A introduction of two differential excitation potentials technique in electrical capacitance tomography"; Sensors and Actuators A; 2012; pp. 1-10; vol. 180; Elsevier B.V.
Mughal et al.; "Review of Capacitive Atmospheric Icing Sensors"; The Sixth International Conference on Sensor Technologies and Applications (SENSORCOMM); 2012; pp. 42-47; IARIA.
Omer et al.; "Design optimization of thermoelectric devices for solar power generation"; Solar Energy Materials and Solar Cells; 1998; pp. 67-82; vol. 53; Elsevier Science B.V.
Omer et al.; "Experimental investigation of a thermoelectric refrigeration system employing a phase change material integrated with thermal diode (thermosyphons)"; Applied Thermal Engineering; 2001; pp. 1265-1271; vol. 21; Elsevier Science Ltd.
Oró et al.; "Review on phase change materials (PCMs) for cold thermal energy storage applications"; Applied Energy; 2012; pp. 1-21; doi: 10.1016/j.apenergy.2012.03.058; Elsevier Ltd.
Owusu, Kwadwo Poku; "Capacitive Probe for Ice Detection and Accretion Rate Measurement: Proof of Concept"; Master of Science Thesis, Department of Mechanical Engineering, University of Manitoba; 2010; pp. i-xi, 1-95.
Peng et al.; "Determination of the optimal axial length of the electrode in an electrical capacitance tomography sensor"; Flow Measurement and Instrumentation; 2005; pp. 169-175; vol. 16; Elsevier Ltd.
Peng et al.; "Evaluation of Effect of Number of Electrodes in ECT Sensors on Image Quality"; IEEE Sensors Journal; May 2012; pp. 1554-1565; vol. 12, No. 5; IEEE.
Riffat et al.; "A novel thermoelectric refrigeration system employing heat pipes and a phase change material: an experimental investigation"; Renewable Energy; 2001; pp. 313-323; vol. 23; Elsevier Science Ltd.
Robak et al.; "Enhancement of latent heat energy storage using embedded heat pipes"; International Journal of Heat and Mass Transfer; 2011; pp. 3476-3483; vol. 54; Elsevier Ltd.
Rodríguez et al.; "Development and experimental validation of a computational model in order to simulate ice cube production in a thermoelectric ice maker"; Applied Thermal Engineering; 2009; one cover page and pp. 1-28; doi: 10.1016/j.applthermaleng.2009.03.005.
Russel et al.; "Characterization of a thermoelectric cooler based thermal management system under different operating conditions"; Applied Thermal Engineering; 2012; two cover pages and pp. 1-29; doi: 10.1016/j.applthermaleng.2012.05.002.
Sharifi et al.; "Heat pipe-assisted melting of a phase change material"; International Journal of Heat and Mass Transfer; 2012; pp. 3458-3469; vol. 55; Elsevier Ltd.
Stampa et al.; "Numerical Study of Ice Layer Growth Around a Vertical Tube"; Engenharia Térmica (Thermal Engineering); Oct. 2005; pp. 138-144; vol. 4, No. 2.
Vián et al.; "Development of a thermoelectric refrigerator with two-phase thermosyphons and capillary lift"; Applied Thermal Engineering; 2008; one cover page and pp. 1-16 doi: 10.1016/j.applthermaleng.2008.09.018.
Ye et al.; "Evaluation of Electrical Capacitance Tomography Sensors for Concentric Annulus"; IEEE Sensors Journal; Feb. 2013; pp. 446-456; vol. 13, No. 2; IEEE.
Yu et al.; "Comparison Study of Three Common Technologies for Freezing-Thawing Measurement"; Advances in Civil Engineering; 2010; pp. 1-10; doi: 10.1155/2010/239651.
U.S. Appl. No. 14/098,886, Bloedow et al.
U.S. Appl. No. 14/070,892, Hyde et al.
U.S. Appl. No. 14/070,234, Hyde et al.
PCT International Search Report; International App. No. PCT/US 11/00234; Jun. 9, 2011; pp. 1-4.
Chinese State Intellectual Property Office; First Office Action; App No. 200880119918.0; Jul. 13, 2011.
U.S. Appl. No. 12/927,982, Deane et al.
U.S. Appl. No. 12/927,981, Chou et al.
U.S. Appl. No. 12/658,579, Deane et al.
U.S. Appl. No. 12/220,439, Hyde et al.
U.S. Appl. No. 12/152,467, Bowers et al.
U.S. Appl. No. 12/152,465, Bowers et al.
U.S. Appl. No. 12/077,322, Hyde et al.
U.S. Appl. No. 12/012,490, Hyde et al.
U.S. Appl. No. 12/008,695, Hyde et al.
U.S. Appl. No. 12/006,089, Hyde et al.

(56) References Cited

OTHER PUBLICATIONS

U.S. Appl. No. 12/006,088, Hyde et al.
U.S. Appl. No. 12/001,757, Hyde et al.
Chinese State Intellectual Property Office, Office Action; App. No. 201180016103.1 (based on PCT Patent Application No. PCT/US2011/000234); Jun. 23, 2014 (received by our Agent on Jun. 25, 2014); pp. 1-23.
"About Heat Leak—Comparison"; Technifab Products, Inc.; printed on Jun. 25, 2014; 2 pages; located at www.technifab.com/cryogenic-resource-library/about-heat-leak.html.

* cited by examiner

TEMPERATURE-STABILIZED STORAGE SYSTEMS CONFIGURED FOR STORAGE AND STABILIZATION OF MODULAR UNITS

CROSS-REFERENCE TO RELATED APPLICATIONS

The present application is related to and claims the benefit of the earliest available effective filing date(s) from the following listed application(s) (the "Related Applications") (e.g., claims earliest available priority dates for other than provisional patent applications or claims benefits under 35 USC §119(e) for provisional patent applications, for any and all parent, grandparent, great-grandparent, etc. applications of the Related Application(s)). All subject matter of the Related Applications and of any and all parent, grandparent, great-grandparent, etc. applications of the Related Applications, including any priority claims, is incorporated herein by reference to the extent such subject matter is not inconsistent herewith.

RELATED APPLICATIONS

For purposes of the USPTO extra-statutory requirements, the present application constitutes a continuation-in-part of U.S. patent application Ser. No. 12/001,757, entitled TEMPERATURE-STABILIZED STORAGE CONTAINERS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed Dec. 11, 2007, which is currently co-pending, or is an application of which a currently co-pending application is entitled to the benefit of the filing date.

For purposes of the USPTO extra-statutory requirements, the present application constitutes a continuation-in-part of U.S. patent application Ser. No. 12/006,088, entitled TEMPERATURE-STABILIZED STORAGE CONTAINERS WITH DIRECTED ACCESS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed Dec. 27, 2007 now U.S. Pat. No. 8,215,518, or is an application of which a currently co-pending application is entitled to the benefit of the filing date.

For purposes of the USPTO extra-statutory requirements, the present application constitutes a continuation-in-part of U.S. patent application Ser. No. 12/006,089, entitled TEMPERATURE-STABILIZED STORAGE SYSTEMS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed Dec. 27, 2007, which is currently co-pending, or is an application of which a currently co-pending application is entitled to the benefit of the filing date.

For purposes of the USPTO extra-statutory requirements, the present application constitutes a continuation-in-part of U.S. patent application Ser. No. 12/008,695, entitled TEMPERATURE-STABILIZED STORAGE CONTAINERS FOR MEDICINALS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed Jan. 10, 2008 now U.S. Pat. No. 8,377,030, or is an application of which a currently co-pending application is entitled to the benefit of the filing date.

For purposes of the USPTO extra-statutory requirements, the present application constitutes a continuation-in-part of U.S. patent application Ser. No. 12/012,490, entitled METHODS OF MANUFACTURING TEMPERATURE-STABILIZED STORAGE CONTAINERS, naming Roderick A. Hyde; Edward K. Y. Jung; Nathan P. Myhrvold; Clarence T. Tegreene; William H. Gates, III; Charles Whitmer; and Lowell L. Wood, Jr. as inventors, filed Jan. 31, 2008 now U.S. Pat. No. 8,069,680, or is an application of which a currently co-pending application is entitled to the benefit of the filing date.

For purposes of the USPTO extra-statutory requirements, the present application constitutes a continuation-in-part of U.S. patent application Ser. No. 12/077,322, entitled TEMPERATURE-STABILIZED MEDICINAL STORAGE SYSTEMS, naming Roderick A. Hyde; Edward K. Y. Jung; Nathan P. Myhrvold; Clarence T. Tegreene; William Gates; Charles Whitmer; and Lowell L. Wood, Jr. as inventors, filed Mar. 17, 2008 now U.S. Pat. No. 8,215,835, or is an application of which a currently co-pending application is entitled to the benefit of the filing date.

For purposes of the USPTO extra-statutory requirements, the present application constitutes a continuation-in-part of U.S. patent application Ser. No. 12/152,465, entitled STORAGE CONTAINER INCLUDING MULTI-LAYER INSULATION COMPOSITE MATERIAL HAVING BANDGAP MATERIAL AND RELATED METHODS, naming Jeffrey A. Bowers; Roderick A. Hyde; Muriel Y. Ishikawa; Edward K. Y. Jung; Jordin T. Kare; Eric C. Leuthardt; Nathan P. Myhrvold; Thomas J. Nugent Jr.; Clarence T. Tegreene; Charles Whitmer; and Lowell L. Wood Jr. as inventors, filed May 13, 2008 now U.S. Pat. No. 8,485,387, or is an application of which a currently co-pending application is entitled to the benefit of the filing date.

For purposes of the USPTO extra-statutory requirements, the present application constitutes a continuation-in-part of U.S. patent application Ser. No. 12/152,467, entitled MULTI-LAYER INSULATION COMPOSITE MATERIAL INCLUDING BANDGAP MATERIAL, STORAGE CONTAINER USING SAME, AND RELATED METHODS, naming Jeffrey A. Bowers; Roderick A. Hyde; Muriel Y. Ishikawa; Edward K. Y. Jung; Jordin T. Kare; Eric C. Leuthardt; Nathan P. Myhrvold; Thomas J. Nugent Jr.; Clarence T. Tegreene; Charles Whitmer; and Lowell L. Wood Jr. as inventors, filed May 13, 2008 now U.S. Pat. No. 8,211,516, or is an application of which a currently co-pending application is entitled to the benefit of the filing date.

For purposes of the USPTO extra-statutory requirements, the present application constitutes a continuation-in-part of U.S. patent application Ser. No. 12/220,439, entitled MULTI-LAYER INSULATION COMPOSITE MATERIAL HAVING AT LEAST ONE THERMALLY-REFLECTIVE LAYER WITH THROUGH OPENINGS, STORAGE CONTAINER USING SAME, AND RELATED METHODS, naming Roderick A. Hyde; Muriel Y. Ishikawa; Jordin T. Kare; and Lowell L. Wood, Jr. as inventors, filed Jul. 23, 2008 now U.S. Pat. No. 8,603,598, or is an application of which a currently co-pending application is entitled to the benefit of the filing date.

For purposes of the USPTO extra-statutory requirements, the present application constitutes a continuation-in-part of U.S. patent application Ser. No. 12/658,579, entitled TEMPERATURE-STABILIZED STORAGE SYSTEMS, naming Geoffrey F. Deane; Lawrence Morgan Fowler; William Gates; Zihong Guo; Roderick A. Hyde; Edward K. Y. Jung; Jordin T. Kare; Nathan P. Myhrvold; Nathan Pegram; Nels R. Peterson; Clarence T. Tegreene; Charles Whitmer; and Lowell L. Wood, Jr. as inventors, filed Feb. 8, 2010, which is currently co-pending, or is an application of which a currently co-pending application is entitled to the benefit of the filing date.

For purposes of the USPTO extra-statutory requirements, the present application constitutes a continuation-in-part of U.S. patent application Ser. No. 12/927,981, entitled TEMPERATURE-STABILIZED STORAGE SYSTEMS WITH FLEXIBLE CONNECTORS, naming Fong-Li Chou; Geoffrey F. Deane; William Gates; Zihong Guo; Roderick A. Hyde; Edward K. Y. Jung; Nathan P. Myhrvold; Nels R. Peterson; Clarence T. Tegreene; Charles Whitmer; and Lowell L. Wood, Jr. as inventors, filed Nov. 29, 2010, which is currently co-pending, or is an application of which a currently co-pending application is entitled to the benefit of the filing date.

For purposes of the USPTO extra-statutory requirements, the present application constitutes a continuation-in-part of U.S. patent application Ser. No. 12/927,982, entitled TEMPERATURE-STABILIZED STORAGE SYSTEMS INCLUDING STORAGE STRUCTURES CONFIGURED FOR INTERCHANGEABLE STORAGE OF MODULAR UNITS, naming Geoffrey F. Deane; Lawrence Morgan Fowler; William Gates; Jenny Ezu Hu; Roderick A. Hyde; Edward K. Y. Jung; Jordin T. Kare; Nathan P. Myhrvold; Nathan Pegram; Nels R. Peterson; Clarence T. Tegreene; Charles Whitmer; and Lowell L. Wood, Jr. as inventors, filed Nov. 29, 2010, which is currently co-pending, or is an application of which a currently co-pending application is entitled to the benefit of the filing date.

The United States Patent Office (USPTO) has published a notice to the effect that the USPTO's computer programs require that patent applicants reference both a serial number and indicate whether an application is a continuation, continuation-in-part, or divisional of a parent application. Stephen G. Kunin, *Benefit of Prior-Filed Application*, USPTO Official Gazette Mar. 18, 2003. The present. Applicant Entity (hereinafter "Applicant") has provided above a specific reference to the application(s) from which priority is being claimed as recited by statute. Applicant understands that the statute is unambiguous in its specific reference language and does not require either a serial number or any characterization, such as "continuation" or "continuation-in-part," for claiming priority to U.S. patent applications. Notwithstanding the foregoing, Applicant understands that the USPTO's computer programs have certain data entry requirements, and hence Applicant has provided designation(s) of a relationship between the present application and its parent application(s) as set forth above, but expressly points out that such designation(s) are not to be construed in any way as any type of commentary and/or admission as to whether or not the present application contains any new matter in addition to the matter of its parent application(s).

SUMMARY

Described herein is an apparatus for use with a substantially thermally sealed storage container, the apparatus including: a stored material module including a plurality of storage units configured for storage of medicinal units, the stored material module including a surface configured to reversibly mate with a surface of a storage structure within a substantially thermally sealed storage container and including a surface configured to reversibly mate with a surface of a stabilizer unit; a stabilizer unit configured to reversibly mate with the surface of the stored material module; a stored material module cap configured to reversibly mate with a surface of at least one of the plurality of storage units within the stored material module and configured to reversibly mate with a surface of the at least one stabilizer unit; and a central stabilizer unit configured to reversibly mate with a surface of the stored material module cap, wherein the central stabilizer unit is of a size and shape to substantially fill a conduit in the substantially thermally sealed storage container.

Also described herein is transportation stabilizer unit with dimensions corresponding to a substantially thermally sealed storage container with a flexible conduit, the transportation stabilizer unit including: a lid of a size and shape configured to substantially cover an external opening in an outer wall of a substantially thermally sealed storage container including a flexible conduit, the lid including a surface configured to reversibly mate with an external surface of the substantially thermally sealed storage container adjacent to the external opening in the outer wall; an aperture in the lid; a wall substantially defining a tubular structure with a diameter in cross-section less than a minimal diameter of the flexible conduit of the substantially thermally sealed storage container, an end of the tubular structure operably attached to the lid; an aperture in the wall, wherein the aperture includes an edge at a position on the tubular structure less than a maximum length of the flexible conduit from the end of the tubular structure operably attached to the lid; a positioning shaft with a diameter in cross-section less than a diameter in cross-section of the central aperture in the lid, the positioning shaft of a length greater than the thickness of the lid in combination with the length of the wall between the surface of the lid and the edge of the aperture in the wall; an interior surface of the wall, the interior surface substantially defining a substantially thermally sealed region; a pivot unit operably attached to a terminal region of the positioning shaft and positioned within the substantially thermally sealed region; a support unit operably attached to the pivot unit, the support unit of a size and shape to fit within the substantially thermally sealed region when the pivot unit is rotated in one direction, and to protrude through the aperture in the wall when the pivot unit is rotated approximately 90 degrees in the other direction; an end region of a size and shape configured to reversibly mate with the interior surface of an indentation in a storage structure within the substantially thermally sealed storage container; a base grip at the terminal end of the end region; and a tensioning unit for the base grip, configured to maintain pressure on the base grip against an interior wall in a direction substantially perpendicular to the surface of the lid.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
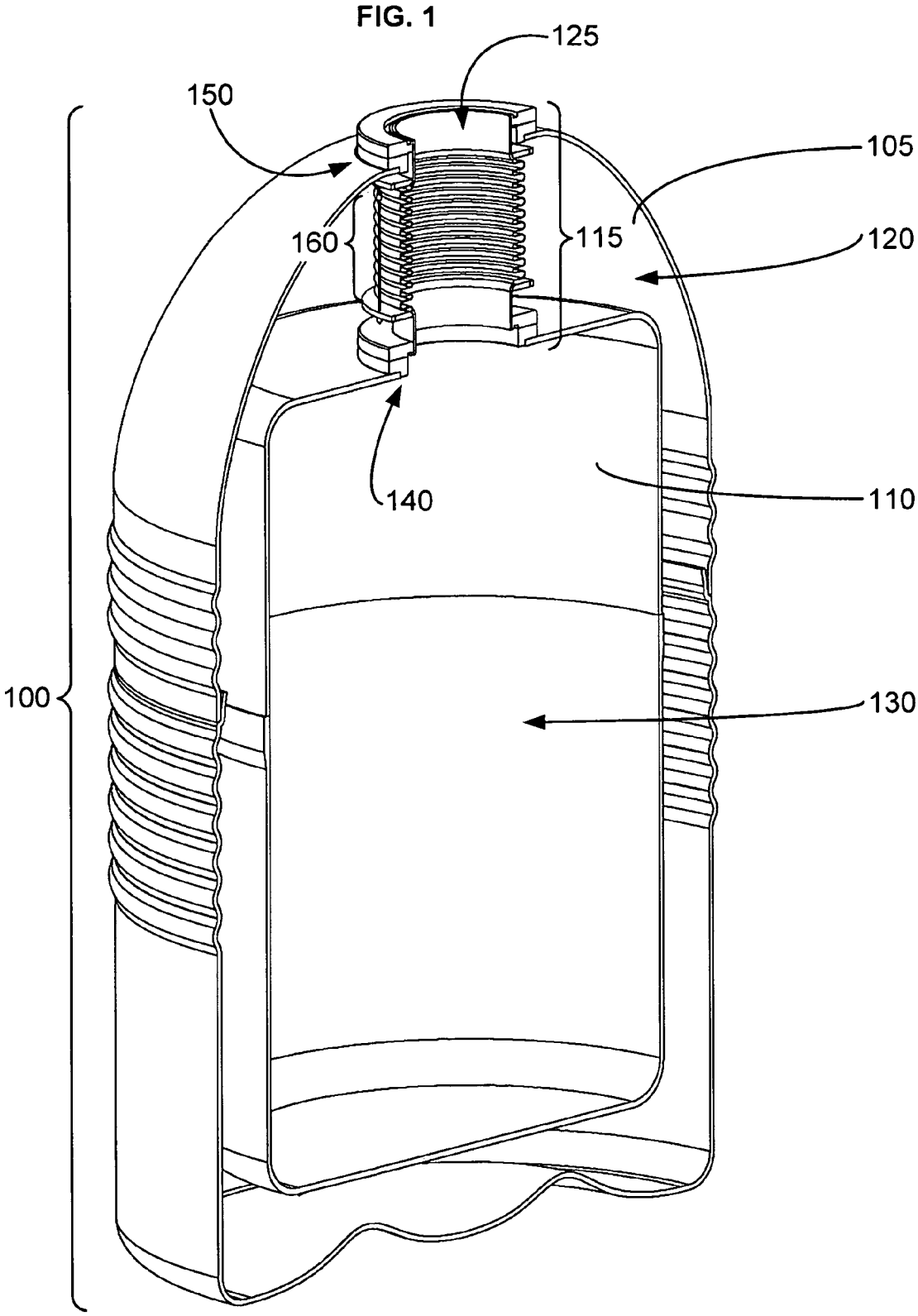
FIG. 1 depicts a substantially thermally sealed storage container in cross-section.

In the following detailed description, reference is made to the accompanying drawings, which form a part hereof. In the drawings, similar symbols typically identify similar components, unless context dictates otherwise. The use of the same symbols in different drawings typically indicates similar or identical items. The illustrative embodiments described in the detailed description, drawings, and claims are not meant to be limiting. Other embodiments may be utilized, and other changes may be made, without departing from the spirit or scope of the subject matter presented here.

Containers and apparatus such as those described herein have a variety of potential uses. In particular, containers and apparatus such as those described herein are useful for stable maintenance of stored materials within a predetermined temperature range without reliance on external power sources to maintain the temperature range within the storage area. For example, containers and apparatus such as those described herein are suitable for maintenance of stored materials within a predetermined temperature range in locations with minimal municipal power, or unreliable municipal power sources, such as remote locations or in emergency situations. Containers and apparatus such as those described herein may be useful for the transport and storage of materials that are sensitive to temperature changes that can occur during shipment and storage. For example, the storage systems described herein are useful for the shipment and storage of medicinal agents, including vaccines. Many medicinal agents, including vaccines, currently in regular use are highly sensitive to temperature variations, and must be maintained in a temperature range to preserve potency. For example, many vaccines must be stored within 2 degrees Centigrade and 8 degrees Centigrade to preserve efficacy. Storage and transport of medicinal agents, including vaccines, within a temperature range, such as within 2 degrees Centigrade and 8 degrees Centigrade, is often referred to as the "cold chain." Health care providers and clinics who use vaccines regularly must follow established protocols and procedures for maintenance of the cold chain, including during transport and in times of emergency and in power failures, to ensure vaccine potency. See: Rodgers et al., "Vaccine Cold Chain Part 1 Proper Handling and Storage of Vaccine," *AAOHN Journal* 58 (8) 337-344 (2010); Rodgers et al., "Vaccine Cold Chain Part 2: Training Personnel and Program Management," *AAOHN Journal* 8 (9): 391-402 (2010); Magennis et al., "Pharmaceutical Cold Chain" A Gap in the Last Mile," *Pharmaceutical & Medical Packaging News,* 44-50 (September 2010); and Kendal et al., "Validation of Cold Chain Procedures Suitable for Distribution of Vaccines by Public Health Programs in the USA," *Vaccine* 15 (12/13): 1459-1465 (1997) which are herein incorporated by reference. However, failure to follow established protocols and procedures for maintenance of the cold chain, even during periods of normal use in developed countries, lead to significant levels of vaccine wastage due to exposure to both excessively high and excessively low temperatures. See: Thakker and Woods, "Storage of Vaccines in the Community: Weak Link in the Cold Chain?" *British Medical Journal* 304: 756-758 (1992); Matthias et al., "Freezing Temperatures in the Vaccine Cold Chain: A Systematic Literature Review," *Vaccine* 25: 3980-3986 (2007); Edsam et al., "Exposure of Hepatitis B Vaccine to Freezing Temperatures During Transport to Rural Health Centers in Mongolia," *Preventative Medicine* 39: 384-388 (2004); Techathawat et al., "Exposure to Heat and Freezing in the Vaccine Cold Chain in Thailand," *Vaccine* 25: 1328-1333 (2007); and Setia et al., "Frequency and Causes of Vaccine Wastage," *Vaccine* 20: 1148-1156 (2002), which are herein incorporated by reference. Although some breaks in cold chain maintenance, such as frozen vaccine vials and vials containing precipitants due to improper temperature exposure may be readily apparent, vaccines with reduced potency due to breaks in cold chain maintenance may not be readily detectable. See: Chen et al., "Characterization of the Freeze Sensitivity of a Hepatitis B Vaccine," *Human Vaccines* 5 (1): 26-32 (2009), which is herein incorporated by reference. Vaccine stocks with reduced potency due to exposure to excessively high temperatures may not be immediately identifiable and sensitivity varies widely depending on the specific vaccine. See: Kristensen and Chen, "Stabilization of Vaccines: Lessons Learned," *Human Vaccines* 6 (3): 229-230 (2010), which is herein incorporated by reference. Issues related to the maintenance of cold chain are even more significant in less well developed regions of the world. See: Wirkas et al., "A Vaccine Cold Chain Freezing Study in PNG Highlights Technology Needs for Hot Climate Countries," *Vaccine* 25: 691-697 (2007); and Nelson et al., "Hepatitis B Vaccine Freezing in the Indonesian Cold Chain: Evidence and Solutions," *Bulletin of the World Health Organization,* 82 (2): 99-105 (2004), which are incorporated by reference. In addition, approaches to the cold chain that require less energy may be desirable for ongoing cost and climate considerations. See Halldórsson and Kovács, "The Sustainable Agenda and Energy Efficiency: Logistics Solutions and Supply Chains in Times of Climate Change," *International Journal of Physical Distribution & Logistics Management* 40 (1/2): 5-13 (2010), which is incorporated by reference.

With reference now to FIG. 1, shown is an example of a substantially thermally sealed storage container 100 that may serve as a context for introducing one or more apparatuses described herein. For the purposes of illustration in FIG. 1, the container 100 is depicted in cross-section to view interior aspects. FIG. 1 depicts a vertically upright, substantially thermally sealed storage container 100 including an outer wall 105, an inner wall 110 and a connector 115. FIG. 1 depicts the container 100 as including a connector 115 with a flexible segment 160, configured to form a flexible connector. In a given embodiment, the connector 115 with a flexible segment 160 as illustrated in FIG. 1 is fabricated with materials sufficient to support the mass of the inner wall 110 and any material internal to the inner wall 110. In some embodiments, however, a substantially thermally sealed storage container 100 may include a connector 115 without a flexible segment, or a connector 115 with fixed segments.

Also as illustrated in FIG. 1, a substantially thermally sealed storage container 100 includes at least one substantially thermally sealed storage region 130 with extremely low heat conductance and extremely low heat radiation transfer between the outside environment of the container and the area internal to the at least one substantially thermally sealed storage region 130. A substantially thermally sealed storage container 100 is configured for extremely low heat conductance and extremely low heat radiation transfer between the outside environment of the substantially thermally sealed storage container 100 and the inside of a substantially thermally sealed storage region 130. For example, in some embodiments the heat leak between a substantially thermally sealed storage region 130 and the exterior of the substantially thermally sealed storage container 100 is less than 1 Watt (W) when the exterior of the container is at a temperature of approximately 40 degrees Centigrade (C) and the substantially thermally sealed storage region is maintained at a temperature between 0 degrees C. and 10 degrees C. For example, in some embodiments the heat leak between a substantially thermally sealed storage region 130 and the exterior of the substantially thermally sealed storage container 100 is less than 700 mW when the exterior of the container is at a temperature of approximately 40 degrees C. and the substantially thermally sealed storage region is maintained at a temperature between 0 degrees C. and 10 degrees C. For example, in some embodiments the heat leak between a substantially thermally sealed storage region 130 and the exterior of the substantially thermally sealed storage container 100 is less than 600 mW when the exterior of the container is at a temperature of approximately 40 degrees C. and the substantially thermally sealed storage region is maintained at a temperature between 0 degrees C. and 10 degrees C. For example, in some embodiments the heat leak between a substantially thermally sealed storage region 130 and the exterior of the substantially thermally sealed storage container 100 is approximately 500 mW when the exterior of the container is at a temperature of approximately 40 degrees C. and the substantially thermally sealed storage region is maintained at a temperature between 0 degrees C. and 10 degrees C.

A substantially thermally sealed storage container 100 may be configured for transport and storage of material in a predetermined temperature range within a substantially thermally sealed storage region 130 for a period of time without active cooling activity or an active cooling unit. For example, a substantially thermally sealed storage container 100 in an environment with an external temperature of approximately 40 degrees C. may be configured for transport and storage of material in a temperature range between 0 degrees C. and 10 degrees C. within a substantially thermally sealed storage region 130 for up to three months. For example, a substantially thermally sealed storage container 100 in an environment with an external temperature of approximately 40 degrees C. may be configured for transport and storage of material in a temperature range between 0 degrees C. and 10 degrees C. within a substantially thermally sealed storage region 130 for up to two months. For example, a substantially thermally sealed storage container 100 in an environment with an external temperature of approximately 40 degrees C. may be configured for transport and storage of material in a temperature range between 0 degrees C. and 10 degrees C. within a substantially thermally sealed storage region 130 for up to one month. A substantially thermally sealed storage region 130 includes a minimal thermal gradient. The interior of a substantially thermally sealed storage region 130 is essentially the same temperature, for example with an internal thermal gradient (e.g. top to bottom or side to side) of no more than 5 degrees Centigrade, or of no more than 3 degrees Centigrade, or of no more than 1 degree Centigrade.

Specific thermal properties and storage capabilities of a substantially thermally sealed storage container 100 may vary depending on the embodiment. For example, the materials used in fabrication of the substantially thermally sealed storage container 100 may depend on factors including; the design of the container 100, the required temperature range within the storage region 130, and the expected external temperature for use of the container 100. A substantially thermally sealed storage container 100 as described herein includes a storage structure configured for receiving and storing at least one heat sink module and at least one stored material module. The choice of number and type of both the heat sink module(s) and the stored material module(s) will determine the specific thermal properties and storage capabilities of a substantially thermally sealed storage container 100 for a given intended time for length of storage in a given temperature range. For example, if a longer storage time in a temperature range between 0 degrees C. and 10 degrees C. is desired, relatively more heat sink module(s) may be included in the storage structure and relatively fewer stored material module(s) may be included. For example, if a shorter storage time in a temperature range between 0 degrees C. and 10 degrees C. is desired, relatively fewer heat sink module(s) may be included in the storage structure and relatively more stored material module(s) may be included.

The substantially thermally sealed storage container 100 may be of a portable size and shape, for example a size and shape within expected portability estimates for an individual person. The substantially thermally sealed storage container 100 may be configured for both transport and storage of material. The substantially thermally sealed storage container 100 may be configured of a size and shape for carrying, lifting or movement by an individual person. For example, in some embodiments the substantially thermally sealed storage container 100 and any internal structure has a mass that is less than approximately 50 kilograms (kg), or less than approximately 30 kg, or less than approximately 20 kg. For example, in some embodiments a substantially thermally sealed storage container 100 has a length and width that are less than approximately 1 meter (m). For example, implementations of a substantially thermally sealed storage container 100 may have external dimensions on the order of 45 centimeters (cm) in diameter and 70 cm in height. For example, in some embodiments a substantially thermally sealed storage container includes external handles, hooks, fixtures or other projections to assist in mobility of the container. For example, in some embodiments a substantially thermally sealed storage container includes external straps, bands, harnesses, or ropes to assist in transport of the container. In some embodiments, a substantially thermally sealed storage container includes external fixtures configured to secure the container to a surface, for example flanges, brackets, struts or clamps. The substantially thermally sealed storage container 100 illustrated in FIG. 1 is roughly configured as an oblong shape, however multiple shapes are possible depending on the embodiment. For example, a rectangular shape, or an irregular shape, may be utilized in some embodiments, depending on the intended use of the substantially thermally sealed storage container 100. For example, a substantially round or ball-like shape of a substantially thermally sealed storage container 100 may be utilized in some embodiments.

A substantially thermally sealed storage container, as described herein, includes zero active cooling units during routine use. No active cooling units are depicted in FIG. 1, for example. The term "active cooling unit," as used herein, includes conductive and radiative cooling mechanisms that require electricity from an external source to operate. For example, active cooling units may include one or more of: actively powered fans, actively pumped refrigerant systems, thermoelectric systems, active heat pump systems, active vapor-compression refrigeration systems and active heat exchanger systems. The external energy required to operate such mechanisms may originate, for example, from municipal electrical power supplies or electric batteries. A substantially thermally sealed storage container, as described herein includes, no active cooling units during regular use as described herein.

As depicted in FIG. 1, a substantially thermally sealed storage container 100 includes an outer assembly, including an outer wall 105. The outer wall 105 substantially defines the substantially thermally sealed storage container 100, and the outer wall 105 substantially defines a single outer wall aperture 150. As illustrated in FIG. 1, the substantially thermally sealed storage container 100 includes an inner wall 110. The inner wall 110 substantially defines a single inner wall aperture 140. As illustrated in FIG. 1, a substantially thermally sealed storage container 100 includes a gap 120 between the inner wall 110 and the outer wall 105. The inner wall 110 and the outer wall 105 are separated by a distance and substantially define a gap 120. The surfaces of the inner wall 110 and the outer wall 105 to not meet or come into thermal contact across the gap 120 when the container is in its usual position. At least one section of ultra efficient insulation material is included in the gap 120. Substantially evacuated space may be included in the gap 120, with the container segments sufficiently sealed to minimize gas leakage into the gap 120 from the region external to the container. The container 100 includes a connector 115 forming a conduit 125 connecting the single outer wall aperture 150 with the single inner wall aperture 140. Although the connector 115 illustrated in FIG. 1 is a flexible connector, in some embodiments the connector 115 may be not be a flexible connector. The container 100 includes a single access aperture to the substantially thermally sealed storage region 130, wherein the single access aperture is formed by an end of the connector 115. In some embodiments, the container 100 includes an outer assembly, including one or more sections of ultra efficient insulation material substantially defining at least one thermally sealed storage region, wherein the outer assembly and the one or more sections of ultra efficient insulation material substantially define a single access aperture to the at least one thermally sealed storage region. As will be illustrated in the following Figures, the container 100 includes an inner assembly within the substantially thermally sealed storage region 130, including a storage structure configured for receiving and storing at least one heat sink module and at least one stored material module.

As illustrated in FIG. 1, the substantially thermally sealed storage container 100 may be configured so that the outer wall aperture 150 is located at the top of the container during use of the container. The substantially thermally sealed storage container 100 may be configured so that an outer wall aperture 150 is at the top edge of the outer wall 105 during routine storage or use of the container. The substantially thermally sealed storage container 100 may be configured so that an aperture in the exterior of the container connecting to the conduit 125 is at the top edge of the container 100 during storage of the container 100. The substantially thermally sealed storage container 100 may be configured so that an outer wall aperture 150 is at an opposing face of the container 100 relative to a base or bottom support structure of the container 100. Embodiments wherein the substantially thermally sealed storage container 100 is configured so that an outer wall aperture 150 is at the top edge of the outer wall 105 during routine storage or use of the container may be configured for minimal passive transfer of thermal energy from the region exterior to the container. For example, a substantially thermally sealed storage container 100 configured so that an outer wall aperture 150 is at an opposing face of the container 100 as a base or bottom support structure of the container 100 may also be configured so that thermal energy radiating from a floor or surface under the container 100 does not directly radiate into the aperture in the outer wall 105.

In some embodiments, the inner wall 110 substantially defines a substantially thermally sealed storage region 130 within the substantially thermally sealed storage container 100. Although the substantially thermally sealed storage container 100 depicted in FIG. 1 includes a single substantially thermally sealed storage region 130, in some embodiments a substantially thermally sealed storage container 100 may include a plurality of substantially thermally sealed storage regions. In some embodiments, there may be a substantially thermally sealed storage container 100 including a plurality of storage regions (e.g. 130) within the container. In embodiments including a plurality of storage regions (e.g. 130) within the container, they may be associated with a single conduit to the region exterior to the container. In embodiments including a plurality of storage regions (e.g. 130) within the container, they may be associated with a plurality of conduits to the region external to the container. For example, each of the plurality of storage regions may be associated with a single, distinct conduit. For example, more than one storage region may be associated with a single conduit to the region external to the substantially thermally sealed storage container 100.

A plurality of storage regions may be, for example, of comparable size and shape or they may be of differing sizes and shapes as appropriate to the embodiment. Different storage regions may include, for example, various removable inserts, at least one layer including at least one metal on the interior surface of a storage region, or at least one layer of nontoxic material on the interior surface, in any combination or grouping. Although the substantially thermally sealed storage region 130 depicted in FIG. 1 is approximately cylindrical in shape, a substantially thermally sealed storage region 130 may be of a size and shape appropriate for a specific embodiment. For example, a substantially thermally sealed storage region 130 may be oblong, round, rectangular, square or of irregular shape. A substantially thermally sealed storage region 130 may vary in total volume, depending on the embodiment and the total dimensions of the container 100. For example, a substantially thermally sealed storage container 100 configured for portability by an individual person may include a single substantially thermally sealed storage region 130 with a total volume less than 30 liters (L), for example a volume of 25 L or 20 L. For example, a substantially thermally sealed storage container 100 configured for transport on a vehicle may include a single substantially thermally sealed storage region 130 with a total volume more than 30 L, for example 35 L or 40 L. A substantially thermally sealed storage region 130 may include additional structure as appropriate for a specific embodiment. For example, a substantially thermally sealed storage region may include stabilizing structures, insulation, packing material, or other additional components configured for ease of use or stable storage of material.

In some embodiments, a substantially thermally sealed container 100 includes at least one layer of nontoxic material on an interior surface of one or more substantially thermally sealed storage region 130. Nontoxic material may include, for example, material that does not produce residue that may be toxic to the contents of the at least one substantially thermally sealed storage region 130, or material that does not produce residue that may be toxic to the future users of contents of the at least one substantially thermally sealed storage region 130. Nontoxic material may include material that maintains the chemical structure of the contents of the at least one substantially thermally sealed storage region 130, for example nontoxic material may include chemically inert or non-reactive materials. Nontoxic material may include material that has been developed for use in, for example, medical, pharmaceutical or food storage applications. Nontoxic material may include material that may be cleaned or sterilized, for example material that may be irradiated, autoclaved, or disinfected. Nontoxic material may include material that contains one or more antibacterial, antiviral, antimicrobial, or antipathogen agents. For example, nontoxic material may include aldehydes, hypochlorites, oxidizing agents, phenolics, quaternary ammonium compounds, or silver. Nontoxic material may include material that is structurally stable in the presence of one or more cleaning or sterilizing compounds or radiation, such as plastic that retains its structural integrity after irradiation, or metal that does not oxidize in the presence of one or more cleaning or sterilizing compounds. Nontoxic material may include material that consists of multiple layers, with layers removable for cleaning or sterilization, such as for reuse of the at least one substantially thermally sealed storage region. Nontoxic material may include, for example, material including metals, fabrics, papers or plastics.

In some embodiments, a substantially thermally sealed container 100 includes at least one layer including at least one metal on an interior surface of at least one thermally sealed storage region 130. For example, the at least one metal may include gold, aluminum, copper, or silver. The at least one metal may include at least one metal composite or alloy, for example steel, stainless steel, metal matrix composites, gold alloy, aluminum alloy, copper alloy, or silver alloy. In some embodiments, the at least one metal includes metal foil, such as titanium foil, aluminum foil, silver foil, or gold foil. A metal foil may be a component of a composite, such as, for example, in association with polyester film, such as polyethylene terephthalate (PET) polyester film. The at least one layer including at least one metal on the interior surface of at least one storage region 130 may include at least one metal that may be sterilizable or disinfected. For example, the at least one metal may be sterilizable or disinfected using plasmons. For example, the at least one metal may be sterilizable or disinfected using autoclaving, thermal means, or chemical means. Depending on the embodiment, the at least one layer including at least one metal on the interior surface of at least one storage region may include at least one metal that has specific heat transfer properties, such as a thermal radiative properties.

In some embodiments, the container 100 may be configured for storage of one or more medicinal units within a storage region 130. For example, some medicinal units are optimally stored within approximately 0 degrees Centigrade and approximately 10 degrees Centigrade. For example, some medicinal units are optimally stored within approximately 2 degrees Centigrade and approximately 8 degrees Centigrade. For example, some medicinal units are optimally stored within approximately 5 degrees Centigrade and approximately 15 degrees Centigrade. For example, some medicinal units are optimally stored within approximately 0 degrees Centigrade and approximately −10 degrees Centigrade. See: Chan and Kristensen, "Opportunities and Challenges of Developing Thermostable Vaccines," *Expert Rev. Vaccines,* 8 (5), pages 547-557 (2009); Matthias et al., "Freezing Temperatures in the Vaccine Cold Chain: A Systematic Literature Review," *Vaccine* 25, pages 3980-3986 (2007); Wirkas et al., "A Vaccines Cold Chain Freezing Study in PNG Highlights Technology Needs for Hot Climate Countries," *Vaccine* 25, pages 691-697 (2007); the WHO publication titled "Preventing Freeze Damage to Vaccines," publication no. WHO/IVB/07.09 (2007); the WHO publication titled "Temperature Sensitivity of Vaccines," publication no. WHO/IVB/06.10 (2006); and Setia et al., "Frequency and Causes of Vaccine Wastage," *Vaccine* 20: 1148-1156 (2002), which are all herein incorporated by reference. The term "medicinal", as used herein, includes a drug, composition, formulation, material or compound intended for medicinal or therapeutic use. For example, a medicinal may include drugs, vaccines, therapeutics, vitamins, pharmaceuticals, remedies, homeopathic agents, naturopathic agents, or treatment modalities in any form, combination or configuration. For example, a medicinal may include vaccines, such as: a vaccine packaged as an oral dosage compound, vaccine within a prefilled syringe, a container or vial containing vaccine, vaccine within a unijet device, or vaccine within an externally deliverable unit (e.g. a vaccine patch for transdermal applications). For example, a medicinal may include treatment modalities, such as: antibody therapies, small-molecule compounds, anti-inflammatory agents, therapeutic drugs, vitamins, or pharmaceuticals in any form, combination or configuration. A medicinal may be in the form of a liquid, gel, solid, semi-solid, vapor, or gas. In some embodiments, a medicinal may be a composite. For example, a medicinal may include a bandage infused with antibiotics, anti-inflammatory agents, coagulants, neurotrophic agents, angiogenic agents, vitamins or pharmaceutical agents.

In some embodiments, the container 100 may be configured for storage of one or more food units within a storage region 130. For example, a container 100 may be configured to maintain a temperature in the range of −4 degrees C. and −10 degrees C. during storage, and may include a storage structure configured for storage of one or more food products, such as ice cream bars, individually packed frozen meals, frozen meat products, frozen fruit products or frozen vegetable products. In some embodiments, the container 100 may be configured for storage of one or more beverage units within a storage region 130. For example, a container 100 may be configured to maintain a temperature in the range of 2 degrees C. and 10 degrees C. during storage, and may include a storage structure configured for storage of one or more beverage products, such as wine, beer, fruit juices, or soft drinks.

In the embodiment depicted in FIG. 1, the substantially thermally sealed storage container 100 includes a gap 120 between the inner wall 110 and the outer wall 105. As shown in FIG. 1, the inner wall 110 and the outer wall 105 are separated by a distance and substantially define a gap 120. In the embodiment illustrated in FIG. 1, there are no irregularities or additions within the gap 120 to thermally join or create a thermal connection between the inner wall 110 and the outer wall 105 across the gap 120 when the container is upright, or in the position configured for normal use of the container 100. When the container 100 is in an upright position, as illustrated in FIG. 1, the inner wall 110 and the outer wall 105 do not directly come into contact with each other. Further, when the container 100 is in an upright position, there are no additions, junctions, flanges, or other fixtures within the gap that would function as a thermal connection across the gap 120 between the inner wall 110 and the outer wall 105.

As illustrated in FIG. 1, the connector 115 supports the entire mass of the inner wall and any contents of the storage region 130. In some embodiments, additional supporting units may be included in the gap 120 to provide additional support to the inner wall 110 in addition to that provided by the connector 115. For example, there may be one or more thermally non-conductive strands attached to the surface of the outer wall 105 facing the gap 120, wherein the thermally non-conductive strands are configured to extend around the surface of the inner wall 110 facing the gap 120 and provide additional support or movement restraint on the inner wall 110 and, by extension, the contents of the substantially thermally sealed storage region 130. In some embodiments, the central regions of the plurality of strands wrap around the inner wall 110 at diverse angles, with the corresponding ends of each of the plurality of strands fixed to the surface of the outer wall 105 facing the gap 120 at multiple locations. One or more thermally non-conductive strands may be, for example, fabricated from fiberglass strands or ropes. One or more thermally non-conductive strands may be, for example, fabricated from strands of a para-aramid synthetic fiber, such as Kevlar™. A plurality of thermally non-conductive strands may be attached to the surface of the outer wall 105 facing the gap 120 at both ends, with the center of the strands wrapped around the surface of the inner wall 110 facing the gap 120. For example, a plurality of strands fabricated from stainless steel ropes may be attached to the surface of the outer wall 105 facing the gap 120 at both ends, with the center of the strands wrapped around the surface of the inner wall 110 facing the gap 120.

In some embodiments, a substantially thermally sealed storage container 100 may include one or more sections of an ultra efficient insulation material. In some embodiments, there is at least one section of ultra efficient insulation material within a gap 120. The term "ultra efficient insulation material," as used herein, may include one or more type of insulation material with extremely low heat conductance and extremely low heat radiation transfer between the surfaces of the insulation material. The ultra efficient insulation material may include, for example, one or more layers of thermally reflective film, high vacuum, aerogel, low thermal conductivity bead-like units, disordered layered crystals, low density solids, or low density foam. In some embodiments, the ultra efficient insulation material includes one or more low density solids such as aerogels, such as those described in, for example: Fricke and Emmerling, Aerogels—preparation, properties, applications, Structure and Bonding 77: 37-87 (1992); and Pekala, Organic aerogels from the polycondensation of resorcinol with formaldehyde, *Journal of Materials Science* 24: 3221-3227 (1989), which are each herein incorporated by reference. As used herein, "low density" may include materials with density from about 0.01 g/cm$^3$ to about 0.10 g/cm$^3$, and materials with density from about 0.005 g/cm$^3$ to about 0.05 g/cm$^3$. In some embodiments, the ultra efficient insulation material includes one or more layers of disordered layered crystals, such as those described in, for example: Chiritescu et al., Ultralow thermal conductivity in disordered, layered $WSe_2$ crystals, *Science* 315: 351-353 (2007), which is herein incorporated by reference. In some embodiments, the ultra efficient insulation material includes at least two layers of thermal reflective film surrounded, for example, by at least one of: high vacuum, low thermal conductivity spacer units, low thermal conductivity bead like units, or low density foam. In some embodiments, the ultra efficient insulation material may include at least two layers of thermal reflective material and at least one spacer unit between the layers of thermal reflective material. For example, the ultra-efficient insulation material may include at least one multiple layer insulating composite such as described in U.S. Pat. No. 6,485,805 to Smith et al., titled "Multilayer insulation composite," which is herein incorporated by reference. For example, the ultra-efficient insulation material may include at least one metallic sheet insulation system, such as that described in U.S. Pat. No. 5,915,283 to Reed et al., titled "Metallic sheet insulation system," which is herein incorporated by reference. For example, the ultra-efficient insulation material may include at least one thermal insulation system, such as that described in U.S. Pat. No. 6,967,051 to Augustynowicz et al., titled "Thermal insulation systems," which is herein incorporated by reference. For example, the ultra-efficient insulation material may include at least one rigid multilayer material for thermal insulation, such as that described in U.S. Pat. No. 7,001,656 to Maignan et al., titled "Rigid multilayer material for thermal insulation," which is herein incorporated by reference. For example, the ultra-efficient insulation material may include multilayer insulation material, or "MLI." For example, an ultra efficient insulation material may include multilayer insulation material such as that used in space program launch vehicles, including by NASA. See, e.g., Daryabeigi, Thermal analysis and design optimization of multilayer insulation for reentry aerodynamic heating, *Journal of Spacecraft and Rockets* 39: 509-514 (2002), which is herein incorporated by reference. For example, the ultra efficient insulation material may include space with a partial gaseous pressure lower than atmospheric pressure external to the container 100. In some embodiments, the ultra efficient insulation material may substantially cover the inner wall 110 surface facing the gap 120. In some embodiments, the ultra efficient insulation material may substantially cover the outer wall 105 surface facing the gap 120.

In some embodiments, there is at least one layer of multilayer insulation material ("MLI") within the gap 120, wherein the at least one layer of multilayer insulation material substantially surrounds the inner wall 110. In some embodiments, there are a plurality of layers of multilayer insulation material within the gap 120, wherein the layers may not be homogeneous. For example, the plurality of layers of multilayer insulation material may include layers of differing thicknesses, or layers with and without associated spacing elements. In some embodiments there may be one or more additional layers within or in addition to the ultra efficient insulation material, such as, for example, an outer structural layer or an inner structural layer. An inner or an outer structural layer may be made of any material appropriate to the embodiment, for example an inner or an outer structural layer may include: plastic, metal, alloy, composite, or glass. In some embodiments, there may be one or more layers of high vacuum between layers of thermal reflective film. In some embodiments, the gap 120 includes a substantially evacuated gaseous pressure relative to the atmospheric pressure external to the container 100. A substantially evacuated gaseous pressure relative to the atmospheric pressure external to the container 100 may include substantially evacuated gaseous pressure surrounding a plurality of layers of MLI, for example between and around the layers. A substantially evacuated gaseous pressure relative to the atmospheric pressure external to the container 100 may include substantially evacuated gaseous pressure in one or more sections of a gap. For example, in some embodiments the gap 120 includes substantially evacuated space having a pressure less than or equal to $1\times10^{-2}$ torr. For example, in some embodiments the gap 120 includes substantially evacuated space having a pressure less than or equal to $5\times10^{4}$ torr. For example, in some embodiments the gap 120 includes substantially evacuated space having a pressure less than or equal to $1\times10^{-2}$ torr in the gap 120. For example, in some embodiments the gap 120 includes substantially evacuated space having a pressure less than or equal to $5\times10^{-4}$ torr in the gap 120. In some embodiments, the gap 120 includes substantially evacuated space having a pressure less than $1\times10^{-2}$ torr, for example, less than $5\times10^{-3}$ torr, less than $5\times10^{-4}$ torr, less than $5\times10^{-5}$ torr, $5\times10^{-6}$ torr or $5\times10^{-7}$ torr. For example, in some embodiments the gap 120 includes a plurality of layers of multilayer insulation material and substantially evacuated space having a pressure less than or equal to $1\times10^{-2}$ torr. For example, in some embodiments the gap 120 includes a plurality of layers of multilayer insulation material and substantially evacuated space having a pressure less than or equal to $5\times10^{-4}$ torr.

Depending on the embodiment, a substantially thermally sealed storage container 100 may be fabricated from a variety of materials. For example, a substantially thermally sealed storage container 100 may be fabricated from metals, fiberglass or plastics of suitable characteristics for a given embodiment. For example, a substantially thermally sealed storage container 100 may include materials of a suitable strength, hardness, durability, cost, availability, thermal conduction characteristics, gas-emitting properties, or other considerations appropriate for a given embodiment. In some embodiments, the materials for fabrication of individual segments of the container 100 are compatible with forming a gas-impervious seal between the segments. In some embodiments, the outer wall 105 is fabricated from stainless steel. In some embodiments, the outer wall 105 is fabricated from aluminum. In some embodiments, the inner wall 110 is fabricated from stainless steel. In some embodiments, the inner wall 110 is fabricated from aluminum. In some embodiments, all or part of the connector 115 is fabricated from stainless steel. In some embodiments, all or part of the connector 115 is fabricated from aluminum. Embodiments include a container with an inner wall 110 and an outer wall 105 fabricated from stainless steel, and a connector 115 with segments fabricated from stainless steel and segments fabricated from aluminum. In some embodiments, the connector 115 is fabricated from fiberglass. In some embodiments, portions or parts of a substantially thermally sealed storage container 100 may be fabricated from composite or layered materials. For example, an outer wall 105 may be substantially fabricated from stainless steel, with an external covering of plastic, such as to protect the outer surface of the container from scratches. For example, an inner wall 110 may substantially be fabricated from stainless steel, with a coating within the substantially sealed storage region 130 of plastic, rubber, foam or other material suitable to provide support and insulation to material stored within the substantially sealed storage region 130.

FIG. 1 illustrates a substantially thermally sealed container 100 including an outer wall 105 and an inner wall 110, with a connector 115 between the outer wall 105 and the inner wall 110. As shown in FIG. 1, the inner wall 110 roughly defines a substantially thermally sealed storage region 130. When the container 100 is in an upright position, as depicted in FIG. 1, the connector 115 is configured to entirely support the mass of the inner wall 110 and the total contents of the substantially thermally sealed storage region 130. In addition, in embodiments wherein a gap 120 includes a gaseous pressure significantly less than atmospheric pressure (e.g. less than or equal to $1\times10^{-2}$ torr, less than or equal to $1\times10^{-3}$ torr, less than or equal to $1\times10^{-4}$ torr, or less than or equal to $5\times10^{-4}$ torr), the connector 115 as depicted in FIG. 1 supports the mass of the inner wall 110 and any contents of the substantially thermally sealed storage region 130 against the force of the partial pressure within the gap 120. For example, in an embodiment wherein the connector 115 includes a conduit 125 of approximately 2½ inches in diameter and the partial pressure of the gap 120 is $5\times10^{-4}$ torr, the downward force on the region of the inner wall 110 directly opposite to the end of the conduit 125 is approximately equivalent to 100 pounds of weight at that location due to the partial pressure in the gap 120. As illustrated in FIG. 1, when the container 100 is in an upright position, the connector 115 substantially supports the mass of the inner wall 110 and any contents of the substantially thermally sealed storage region 130 without additional supporting elements within the gap 120. For example, in the embodiment illustrated in FIG. 1, the inner wall 110 is connected to the connector 115, and the inner wall 110 does not contact any other supporting units when the container 100 is in an upright position. As illustrated in FIG. 1, in embodiments wherein an inner wall 110 is entirely freely supported by a connector 115 and wherein the connector 115 is a flexible connector, the inner wall 110 may swing or otherwise move within the gap 120 in response to motion of the container 100. For example, when the container 100 is transported, the flexible connector 115 may bend or flex in response to the transportation motion, and the inner wall 110 may correspondingly swing or move within the gap 120.

Figure 2:
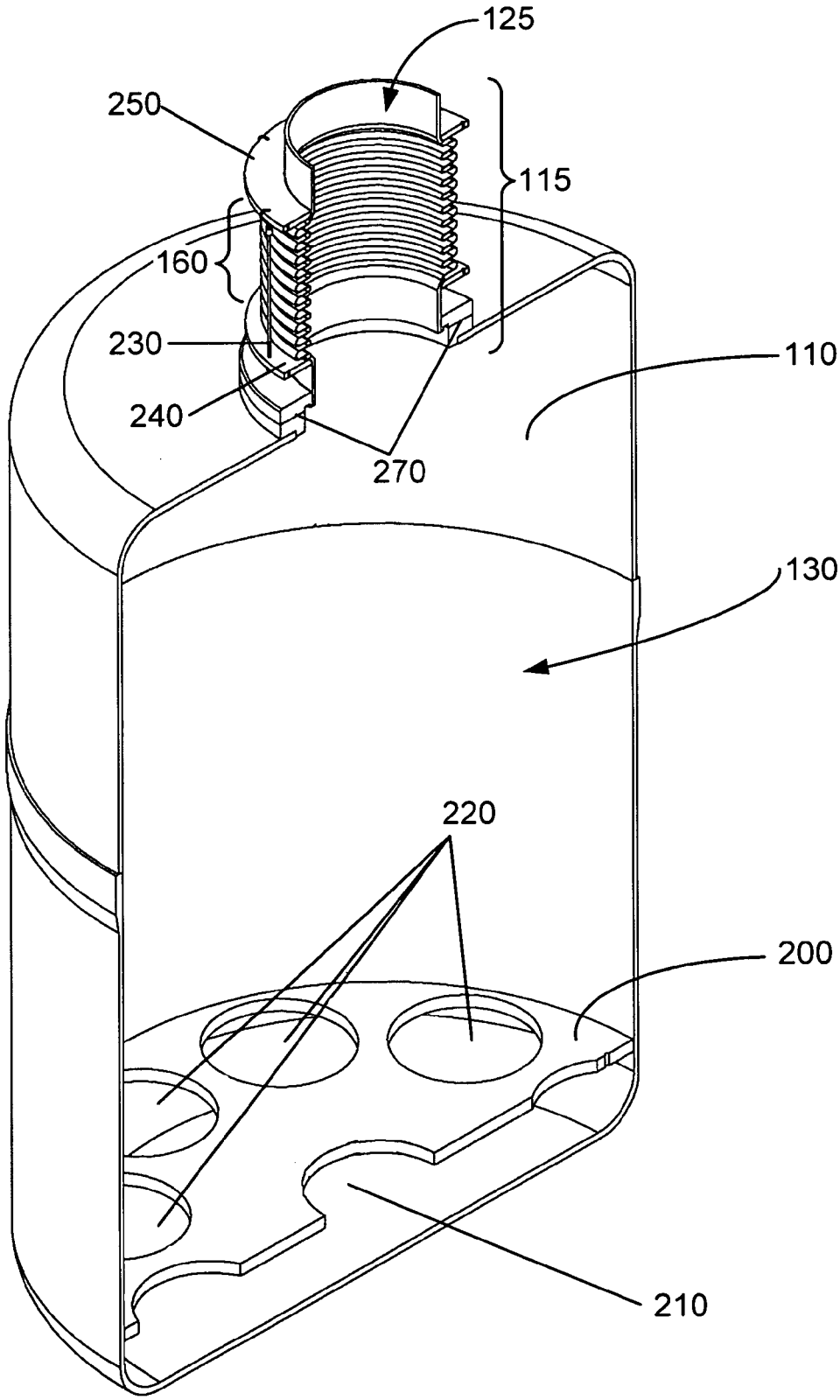
FIG. 2 shows aspects of a substantially thermally sealed storage container in cross-section.

FIG. 2 depicts aspects of some embodiments of a substantially thermally sealed container 100. FIG. 2 depicts in cross-section an inner wall 110 in conjunction with a connector 115. Although a connector 115 with a flexible segment 160 is illustrated, a connector 115 may be non-flexible in some embodiments. The interior of the connector 115 substantially defines a conduit 125 between the exterior of the container and the interior of a storage region 130. As illustrated in FIG. 2, the multiple flanges of the flexible segment 160 of the connector 115 form an elongated thermal pathway on the surface of the connector 115 forming the edges of the conduit 125 between the storage region 130 and the region exterior to the container. The elongated thermal pathway of the conduit 125 provides reduced thermal energy transfer along the conduit 125 in comparison with a smooth (i.e. non-flanged) connector 115.

The connector 115 illustrated in FIG. 2 includes a first compression unit 250 substantially encircling one end of the flexible segment 160 and a second compression unit 240 substantially encircling another end of the flexible segment 160. Although only a single compression strand 230 is illustrated in the view of FIG. 2, in an actual embodiment a plurality of compression strands 230 are positioned around the circumference of the flexible segment 160. The plurality of compression strands 230 are attached to both the first compression unit 250 and the second compression unit 240, substantially fixing a maximum distance allowable between the first compression unit 250 and the second compression unit 240. A junction unit 270 joins the connector 115 with the inner wall 110 of the container 100.

In embodiments with an inner wall 110 and/or an outer wall 105 fabricated from one or more materials and a connector 115 fabricated from one or more different materials, one or more junction units 270 may be included in the substantially thermally sealed storage container 100 to ensure a suitably strong, durable and/or gas-impermeable connection between the inner wall 110 and the connector 115 and/or the outer wall 105 and the connector 115. A "junction unit," as used herein, includes a unit configured for connections to two different components of the container 100, forming a junction between the different components. A substantially thermally sealed container 100 may include a gas-impermeable junction between the first end of the connector 115 and the outer wall at the edge of the outer wall aperture. A substantially thermally sealed container 100 may include a gas-impermeable junction between the second end of the duct and the inner wall at the edge of the inner wall aperture. Some embodiments include a gas-impermeable junction between the second end of the duct and the substantially thermally sealed storage region 130, the gas-impermeable junction substantially encircling the aperture in the substantially thermally sealed storage region 130. For example, in embodiments with a inner wall 110 and/or an outer wall 105 fabricated from aluminum and a connector 115 fabricated from stainless steel, one or more junction units 270 may be included in the substantially thermally sealed storage container 100 to ensure a suitably strong and gas-impermeable attachment between the inner wall 110 and the connector 115 and/or the outer wall 105 and the connector 115. Some embodiments include a gas-impermeable junction between the first end of the duct and the exterior of the substantially thermally sealed storage container 100, the gas-impermeable junction substantially encircling the aperture in the exterior. For example, a substantially ring-shaped junction unit may be included to functionally connect the top edge of the connector 115 and the edge of the aperture in the outer wall 105. For example, FIG. 2 illustrates a substantially ring-shaped junction unit 270 between the bottom edge of the connector 115 and the edge of the aperture in the inner wall 110. Junction units such as those depicted 270 in FIG. 2 may be fabricated from roll bonded clad metals, for example as roll bonded transition inserts such as those available from Spur Industries Inc., (Spokane, Wash.). For example, a roll bonded transition insert including a layer of stainless steel bonded to a layer of aluminum is a suitable base for fabricating a junction unit 270 between an aluminum outer wall 105 or inner wall 110 and a stainless steel connector 115. In such an embodiment, a junction unit 270 is positioned so that identical materials are placed adjacent to each other, and then operably sealed together using commonly implemented methods, such as welding. For example, in an embodiment where a container 100 includes an aluminum outer wall 105 and a stainless steel connector 115, a roll bonded transition insert including a layer of stainless steel bonded to a layer of aluminum may be used in a first junction unit, suitably positioned so that the aluminum outer wall 105 may be welded to the aluminum portion of the first junction unit. Similarly, the stainless steel portion of the junction unit may be welded to the top edge of the stainless steel connector 115. A second junction unit 270 may be similarly used to operably attach the bottom edge of the stainless steel connector 115 to the edge of the aperture in the aluminum inner wall 110. In embodiments where junction units 270 are not utilized, brazing methods and suitable filler materials may be used to operably attach a connector 115 fabricated from materials distinct from the materials used to fabricate the outer wall 105 and/or the inner wall 110.

As illustrated in FIG. 2, the interior of the storage region 130 includes a storage structure 200. The storage structure 200 is fixed to the interior surface of the inner wall 110. The storage structure 200 illustrated in FIG. 2 includes a plurality of apertures 220, 210 of an equivalent size and shape. Some of these apertures 220, 210 are completely depicted and some are only partially depicted in the cross-section illustration of FIG. 2. The storage structure 200 includes a planar structure including a plurality of apertures 220, 210, wherein the planar structure is located adjacent to a wall of the thermally sealed storage region 130 opposite to the single access aperture and substantially parallel with the diameter of the single access aperture. The plurality of apertures 220, 210 included in the storage structure 200 include substantially circular apertures. The plurality of apertures 220, 210 included in the storage structure 200 include a plurality of apertures 220 located around the circumference of the storage structure 200, and a single aperture 210 located in the center of the storage structure 200. As illustrated in FIG. 2, the apertures 220, 210 included in the storage structure 200 are of substantially similar size and shape, allowing for the interchange of the heat sink units and the stored material modules in different apertures 220, 210.

Although a substantially planar storage structure 200 is depicted in FIG. 2, in some embodiments a storage structure may include brackets, hooks, springs, flanges, or other configurations as appropriate for reversible storage of the heat sink modules and stored material modules of that embodiment. For example, a storage structure may include brackets and/or hooks. For example, a storage structure may include brackets with openings configured for heat sink modules and stored material modules to slide into the structure. For example, a storage structure may include hanging cylinders and/or a carousel-like structure with openings configured for heat sink modules and stored material modules to slide into the structure. Some embodiments include a storage structure with aspects configured to assist in the insertion, positioning and removal of heat sink modules and/or stored material modules; such as slide structures and/or positioning guide structures. Some embodiments include an external insertion and removal device, such as a hook, loop or bracket on an elongated pole configured to assist in the insertion, positioning and removal of heat sink modules and/or stored material modules.

In some embodiments, a substantially thermally sealed storage container 100 includes one or more storage structures 200 within an interior of at least one thermally sealed storage region 130. A storage structure 200 is configured for receiving and storing of at least one heat sink module and at least one stored material module. A storage structure 200 is configured for interchangeable storage of at least one heat sink module and at least one stored material module. For example, a storage structure may include racks, shelves, containers, thermal insulation, shock insulation, or other structures configured for storage of material within the storage region 130. In some embodiments, a storage structure includes at least one bracket configured for the reversible attachment of at least one heat sink module or at least one stored material module. In some embodiments, a storage structure includes at least one rack configured for the reversible attachment of at least one heat sink module or at least one stored material module. In some embodiments, a storage structure includes at least one clamp configured for the reversible attachment of at least one heat sink module or at least one stored material module. In some embodiments, a storage structure includes at least one fastener configured for the reversible attachment of at least one heat sink module or at least one stored material module. In some embodiments, a substantially thermally sealed storage container 100 includes one or more removable inserts within an interior of at least one thermally sealed storage region 130. The removable inserts may be made of any material appropriate for the embodiment, including nontoxic materials, metal, alloy, composite, or plastic. The one or more removable inserts may include inserts that may be reused or reconditioned. The one or more removable inserts may include inserts that may be cleaned, sterilized, or disinfected as appropriate to the embodiment. In some embodiments, a storage structure includes at least one bracket configured for the reversible attachment of at least one heat sink module or at least one stored material module. In some embodiments, a storage structure is configured for interchangeable storage of a plurality of modules, wherein the modules include at least one heat sink module and at least one stored material module.

In some embodiments the substantially thermally sealed storage container may include one or more heat sink units thermally connected to one or more storage region 130. In some embodiments, the substantially thermally sealed storage container 100 may include no heat sink units. In some embodiments, the substantially thermally sealed storage container 100 may include heat sink units within the interior of the container 100, such as within a storage region 130. Heat sink units may be modular and configured to be removable and interchangeable. In some embodiments, heat sink units are configured to be interchangeable with stored material modules. Heat sink modules may be fabricated from a variety of materials, depending on the embodiment. Materials for inclusion in a heat sink module may be selected based on properties such as thermal conductivity, durability over time, stability of the material when subjected to particular temperatures, stability of the material when subjected to repeated cycles of freezing and thawing, cost, weight, density, and availability. In some embodiments, heat sink modules are fabricated from metals. For example, in some embodiments, heat sink modules are fabricated from stainless steel. For example, in some embodiments, heat sink modules are fabricated from aluminum. In some embodiments, heat sink modules are fabricated from plastics. For example, in some embodiments, heat sink modules are fabricated from polyethylene. For example, in some embodiments, heat sink modules are fabricated from polypropylene. A heat sink unit may be fabricated to be durable and reusable, for example a heat sink unit may be fabricated from stainless steel and water. A heat sink unit may be brought to a suitable temperature before placement in a storage region 130, for example a heat sink unit may be frozen at −20 degrees Centigrade externally to the container 100 and then brought to 0 degrees Centigrade externally to the container 100 before placement within a storage region 130.

The term "heat sink unit," as used herein, includes one or more units that absorb thermal energy. See, for example, U.S. Pat. No. 5,390,734 to Voorhes et al., titled "Heat Sink," U.S. Pat. No. 4,057,101 to Ruka et al., titled "Heat Sink," U.S. Pat. No. 4,003,426 to Best et al., titled "Heat or Thermal Energy Storage Structure," and U.S. Pat. No. 4,976,308 to Faghri titled "Thermal Energy Storage Heat Exchanger," and Zalba et al., "Review on thermal energy storage with phase change: materials, heat transfer analysis and applications," *Applied Thermal Engineering* 23: 251-283 (2003), which are each incorporated herein by reference. In the embodiments described herein, all of the heat sink materials included within a substantially thermally sealed storage container 100 are located within specific heat sink units, as illustrated in the following Figures. All of the embodiments described herein include heat sink materials only within sealed heat sink units, maintained physically distinct and separated from any stored material within a storage region 130. This physical distance allows for the transfer of heat energy to the heat sink from the interior of the storage region 130 without excessive cooling of the stored material, which may damage the stored material For example, many medicinals must be stored a temperatures near to but above freezing (e.g. approximately 2 degrees Centigrade to approximately 8 degrees Centigrade). See Wirkas et al., "A Vaccine Cold Chain Freezing Study in PNG Highlights Technology Needs for Hot Climate Countries," *Vaccine* 25: 691-697 (2007). Heat sink units may include, for example: units containing frozen water or other types of ice; units including frozen material that is generally gaseous at ambient temperature and pressure, such as frozen carbon dioxide ($CO_2$); units including liquid material that is generally gaseous at ambient temperature and pressure, such as liquid nitrogen; units including artificial gels or composites with heat sink properties; units including phase change materials; and units including refrigerants. See, for example: U.S. Pat. No. 5,261,241 to Kitahara et al., titled "Refrigerant," U.S. Pat. No. 4,810,403 to Bivens et al., titled "Halocarbon Blends for Refrigerant Use," U.S. Pat. No. 4,428,854 to Enjo et al., titled "Absorption Refrigerant Compositions for Use in Absorption Refrigeration Systems," and U.S. Pat. No. 4,482,465 to Gray, titled "Hydrocarbon-Halocarbon Refrigerant Blends," which are each herein incorporated by reference. In some embodiments, heat sink materials include tetradecane and hexadecane binary mixtures (see, for example, Bo et al., "Tetradecane and hexadecane binary mixtures as phase change materials (PCMs) for cool storage in district cooling systems," *Energy* 24: 1015-1028 (1999), which is incorporated by reference). In some embodiments, heat sink materials include commercially available materials, such as PureTemp™ phase change materials, available from Entropy Solutions Inc., Plymouth, Minn.

The heat sink materials used for a given embodiment may vary depending on the desired internal temperature of the storage region 130 and the length of intended use, as well as other factors such as cost, weight and toxicity of the heat sink material. Although in the embodiments described herein the heat sink materials are only intended for use within a sealed heat sink unit, toxicity of a heat sink material may be relevant for manufacturing or disposal purposes. As an example, for embodiments wherein the storage region 130 is intended to be maintained between approximately 2 degrees to approximately 8 degrees Centigrade for a period of 30 days or greater, water ice or a water-ice combination may be used as a heat sink material.

Figure 3:
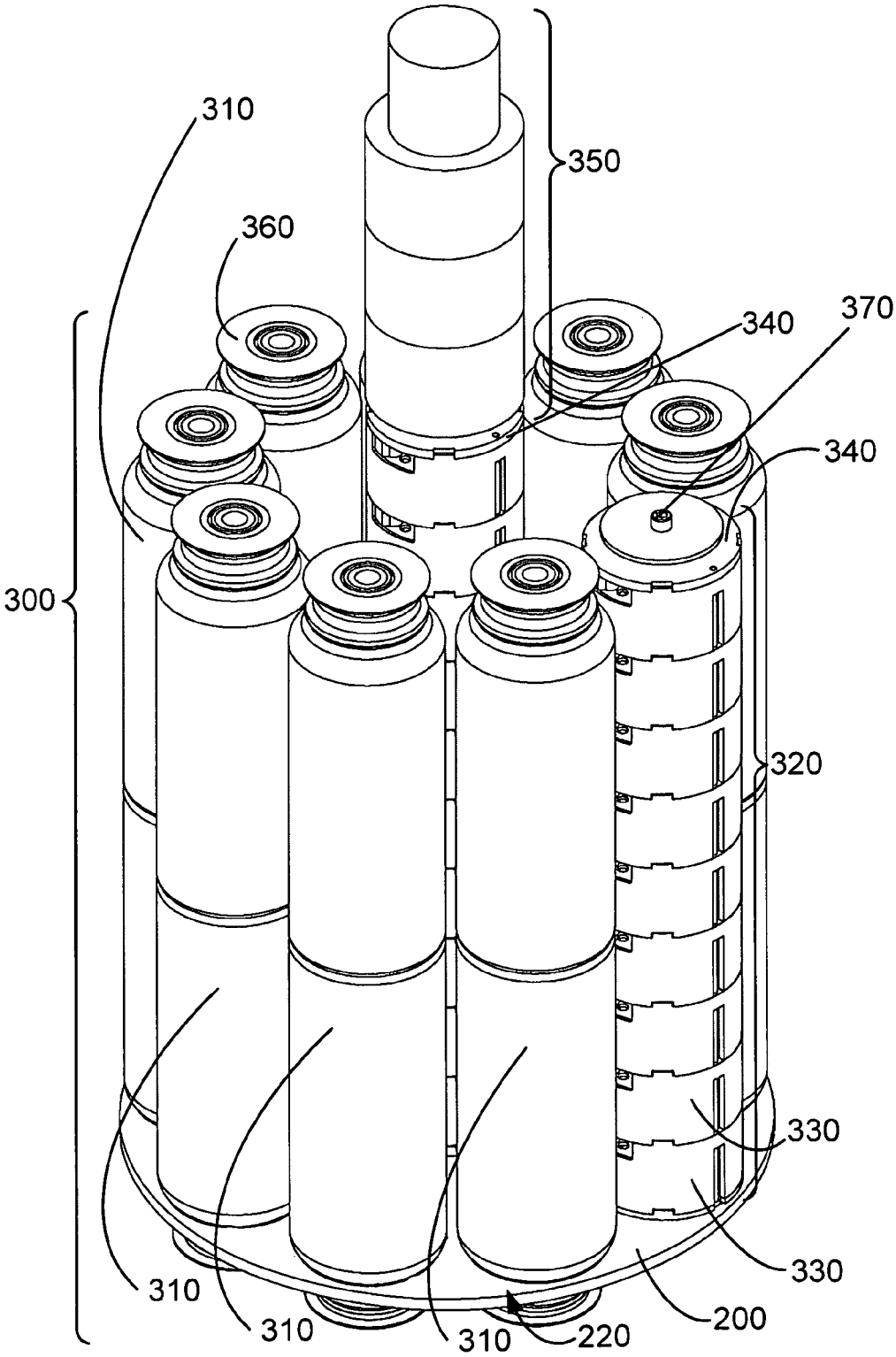
FIG. 3 depicts aspects of a storage structure and interchangeable modular units for use within a substantially thermally sealed storage container.

In the embodiments described herein, the substantially thermally sealed storage container includes one or more stored material modules. The substantially thermally sealed storage container 100 may include stored material modules within a storage region 130 in association with a storage structure 200. A stored material module may be configured to reversibly mate with the edge of an aperture 220, 210 in the storage structure 200, as illustrated in FIG. 3. A stored material module may be configured for use with a given size container 100 and storage structure 200 with apertures 220, 210 of specific dimensions. For example, a stored material module may be of a height suitable to fit a storage structure 200 within a storage region 130 in an upright position without coming into contact with the interior surface of the storage region 130. For example, a stored material module may be cylindrical and fit with minimal extra space within an aperture 220, 210 of a storage structure 130.

As used herein, "stored material modules" refers to modular units configured for storage of materials within a substantially thermally sealed storage container 100. Stored material modules are modular and configured to be removable and interchangeable. Stored material modules are configured to be removable and interchangeable with each other as well as with heat sink units, i.e. of a similar size and shape. Stored material modules such as those described herein are configured to fit, with minimal open space, within an aperture 220, 210 within a storage structure 200. Stored material modules may include a plurality of storage units. For example, a stored material module may include a plurality of cups, drawers, inserts, indentations, cavities, or chambers, each of which may be a storage unit configured for storage of material. In some embodiments, stored material modules are configured to be interchangeable with heat sink units. Stored material modules may be configured to be fixed in place within a storage region 130 with a storage structure 200. Stored material modules may be fabricated from a variety of materials, depending on the embodiment. Materials for inclusion in a stored material module may be selected based on properties such as thermal conductivity, durability over time, stability of the material when subjected to particular temperatures, stability, strength, cost, weight, density, and availability. In some embodiments, heat sink modules are fabricated from metals. For example, in some embodiments, heat sink modules are fabricated from stainless steel. For example, in some embodiments, heat sink modules are fabricated from aluminum. In some embodiments, heat sink modules are fabricated from plastics. For example, in some embodiments, heat sink modules are fabricated from polyethylene. For example, in some embodiments, heat sink modules are fabricated from polypropylene.

FIG. 3 illustrates aspects of a storage structure 200 and a plurality of modules 300, including heat sink modules 310 and stored material modules 320. As illustrated in FIG. 3, the storage structure 200 is configured for receiving and storing a plurality of modules 300, wherein the modules include at least one heat sink module 310 and at least one stored material module 320. As illustrated in FIG. 3, the storage structure 200 is configured for interchangeable storage of a plurality of modules 300, wherein the modules include at least one heat sink module 310 and at least one stored material module 320. The storage structure 200, as illustrated in FIG. 3, includes a planar structure including a plurality of circular apertures 220, 210 (see FIG. 2). The plurality of modules 300 illustrated in FIG. 3 are configured to reversibly mate with the surfaces of the circular apertures 220, 210. The plurality of modules 300 are configured to be interchangeable at different locations within the storage structure 200. The storage structure 200 includes circular apertures 220, 210 of substantially equivalent size and spacing configured to facilitate the modular format of the plurality of modules 300. Although the container 100 exterior is not depicted in FIG. 3, the storage structure 200 and the plurality of modules 300 are configured for inclusion within a storage region 130 of a container 100.

A stored material module 320, as illustrated in FIG. 3, includes a plurality of storage units 330. In the embodiment illustrated in FIG. 3, the storage units 330 are arranged in a columnar structure within the stored material module 320. Each storage module 320 includes a plurality of storage units positioned in a columnar array. In some embodiments, the plurality of storage units 330 may be of a substantially equivalent size and shape, as depicted in FIG. 3. In some embodiments, the plurality of storage units 330 may be positioned in a columnar array and wherein the storage units 330 are of a substantially equivalent horizontal dimension and wherein the plurality of storage units 330 include individual storage units 330 of at least two distinct vertical dimensions. Storage units 330 with fixed horizontal dimensions may be stacked in a linear array. However, storage units 330 with fixed width or diameter need not have the same height. In some embodiments, storage units 330 of varying heights may be desirable for storage of materials of varying sizes or heights. For example, in embodiments configured for storage of medicinal vials, such as vaccine vials, storage units 330 of varying heights may be configured for storage of different size vaccine vials. A storage unit 330 may be configured, for example, for storage of standard-size 2 cc vaccine vials, or standard-size 3 cc vaccine vials. A stored material module 320 may also include a cap 340. The cap 340 may be configured to enclose the adjacent storage unit 330. The cap may be removable and replicable. A central stabilizer 350 may be attached to a stored material module 320. A central stabilizer 350 may be attached to a cap 340 reversibly, for example with a threaded screw on the central stabilizer 350 configured to mate with a threaded aperture on the surface of the cap 340.

Stored material modules 320 and associated stored material units 330 may be fabricated from a variety of materials, depending on the embodiment. For example, the stored material modules 320 and stored material units 330 may be fabricated from a low thermal mass plastic, or a rigid foam material. In some embodiments the stored material modules 320 and stored material units 330 may be fabricated from acrylonitrile butadiene styrene (ABS) plastic. In some embodiments the stored material modules 320 may include metal components.

In some embodiments, a storage structure 200 and a plurality of modules 300, including heat sink modules 310 and stored material modules 320 may be configured for interchangeable storage of heat sink modules 310 and stored material modules 320. The choice of the type and number of heat sink modules 310 and stored material modules 320 may vary for any particular use of the container 100. For example, in an embodiment where the stored material modules 320 are required to be stored for a longer period of time in a predetermined temperature range, relatively fewer stored material modules 320 and relatively more heat sink modules 310 may be included. For example, in an embodiment such as depicted in FIG. 3, a total of nine heat sink modules may be included in the outer ring of the storage structure 200 and a single stored material module 320 may be included in the center of the ring. An embodiment such as depicted in FIG. 3 may, for example, be configured to store a single stored material module 320 and a total of nine heat sink modules 310 including water ice for at least three months at a temperature between 0 degrees C. and 10 degrees C. An embodiment such as depicted in FIG. 3 may, for example, be configured to store two stored material modules 320 and a total of eight heat sink modules 310 including water ice for at least two months at a temperature between 0 degrees C. and 10 degrees C.

Other configurations and relative numbers of stored material modules 320 and heat sink modules 310 may be utilized, depending on the particular container 100 and desired storage time in a particular temperature range. Other configurations and ratios of stored material modules 320 and heat sink modules 310 may be included in a particular container 100 depending on the desired storage time in a particular temperature range. Other configurations and ratios of stored material modules 320 and heat sink modules 310 may be included in a particular container 100 depending on the number of access events during the desired storage time in a particular temperature range. A heat sink module 310 including a particular volume of heat sink material at a particular temperature may be estimated to have a particular amount of energy storage, such as in joules of energy. Assuming a constant heat leak in the container 100, an incremental value of energy, e.g. joules, per time of storage may be calculated. Assuming a constant access energy loss to a storage region in a container, an incremental value of energy, e.g. joules, per access to a storage region may be calculated. For a particular use, heat sink module(s) 310 with corresponding values of energy storage, e.g. joules, may be included as calculated per time of storage. For a particular use, heat sink module(s) 310 with corresponding values of energy storage, e.g. joules, may be included as calculated per access to the storage region (e.g. removal and/or insertion of stored material).

Figure 4:
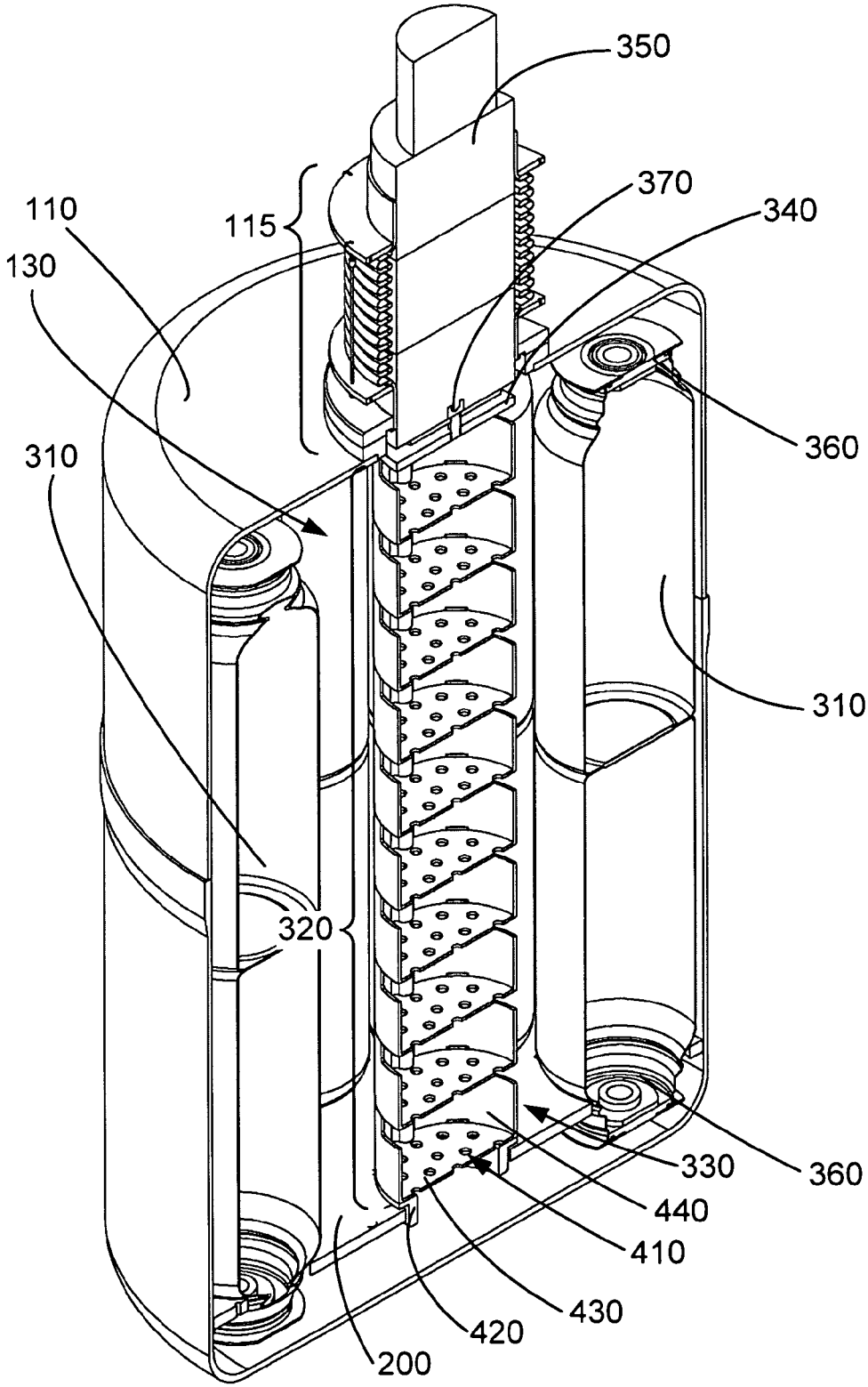
FIG. 4 illustrates, in cross-section, aspects of a storage structure and interchangeable modular units for use within a substantially thermally sealed storage container.

FIG. 4 illustrates aspects of a substantially thermally sealed storage container 100 including stored material modules 310, 320. FIG. 4 depicts an inner wall 110 and an attached connector 115 in cross-section. In the interests of illustrating the inner components of the container 100, an outer wall 105 and other aspects of the container are not depicted in FIG. 4. The storage region 130 within the inner wall 110 contains multiple storage modules 310, 320. FIG. 4 illustrates two heat sink modules 310 in cross-section. As is evident in the cross-section view, each of the two heat sink modules 310 includes two heat sink units, forming an upper and a lower heat sink region relative to the orientation of FIG. 4. Each of the heat sink modules 310 includes a cap 360. The cap 360 may be configured to be removable, for example with screw-type threading configured to mate with an edge of the heat sink unit. In some embodiments, a heat sink unit or module may not include a cap 360 but instead by constitutively sealed. In some embodiments, the cap 360 may include a flange, handle, knob or shaft configured to enable the insertion and removal of the heat sink module 310 from the container 100. For example, a cap 360 may include a thin flexible arc of material externally to the cap, the arc of material of suitable strength to allow its use as a handle for the insertion and removal of the heat sink module 310 from the storage region 130. A heat sink module 310 may be cylindrical, as illustrated in FIG. 4. A heat sink module 310 may contain, for example, water, water ice, and/or air. A heat sink module 310 may contain a heat sink material that may be recharged, such as water (i.e. by re-cooling or re-freezing). A heat sink module 310 may contain a heat sink material that may be replaced (i.e. by opening a cap 360). The illustrated heat sink modules 310 are substantially cylindrical in shape and include caps 360 configured for reversible opening of the heat sink modules 310. For example, the heat sink modules 310 may be opened for recharging or replacement of heat sink material within the heat sink modules 310. In some embodiments, the heat sink modules 310 may be sealed closed (e.g. with a welding joint) and not configured for reversible opening. The heat sink modules 310 may include two or more heat sink units (e.g. top and bottom relative to FIG. 4). Heat sink units may be attached to form a heat sink module 310 with a module joint, for example an adhesive attachment, a weld attachment, or a screw-type reversible attachment.

Some embodiments include a plurality of heat sink modules 310 of a substantially cylindrical shape as depicted in FIGS. 3 and 4. The materials used in the fabrication of the heat sink units may depend, for example, on the thermal properties of the heat sink material stored in the heat sink modules 310. The materials used in the fabrication of the heat sink modules 310 may depend, for example, on cost, weight, availability, and durability. The heat sink modules 310 may be fabricated from stainless steel of an appropriate type and thickness to the embodiment. The heat sink modules 310 may include water stored internally as a heat sink material. For example, substantially cylindrical heat sink modules 310 may be fabricated from stainless steel and approximately 90% filled with water. The heat sink modules 310 may then be placed horizontally and frozen in an environment set to approximately −20 degrees C. (for example, a standard freezer). After a sufficient time for the water within the heat sink modules 310 to freeze, the heat sink modules may be removed and placed at approximately 20 degrees C. (for example, an average room temperature) until some of the water turns to ice. See, for example, "Preventing Freeze Damage to Vaccines," WHO publication WHO/IVB/07.09, and Magennis et al., "Pharmaceutical Cold Chain: a Gap in the Last Mile," *Pharmaceutical & Medical Packaging News, Supply Chain Management Supplement,* 44-50 (September 2010), which are herein incorporated by reference. Once the heat sink modules 310 contain both ice and liquid water, they are ready for use in a storage region 130 within a substantially thermally sealed storage container 100 with an approximate temperature range between 0 degrees C. to 10 degrees C.

FIG. 4 depicts a stored material module 320 in cross-section in the center of the storage region 130. The stored material module 320 includes a series of stored material units 330 arranged in a columnar array. Each of the stored material units 330 includes a side region 440 and a bottom region 430 positioned at substantially right angles to the side region 440. Each of the stored material units 330 includes a plurality of apertures 410 in the bottom of the stored material unit 330. Such apertures may be configured to improve thermal circulation around stored material within the stored material unit 330. Such apertures may be configured to improve air flow around stored material within the stored material unit 330. The stored material module 320 includes a base 420 at the lower end of the module 320, the base having an external surface configured to reversibly mate with the interior surface of the center aperture 210 in the storage structure 200.

Figure 9:
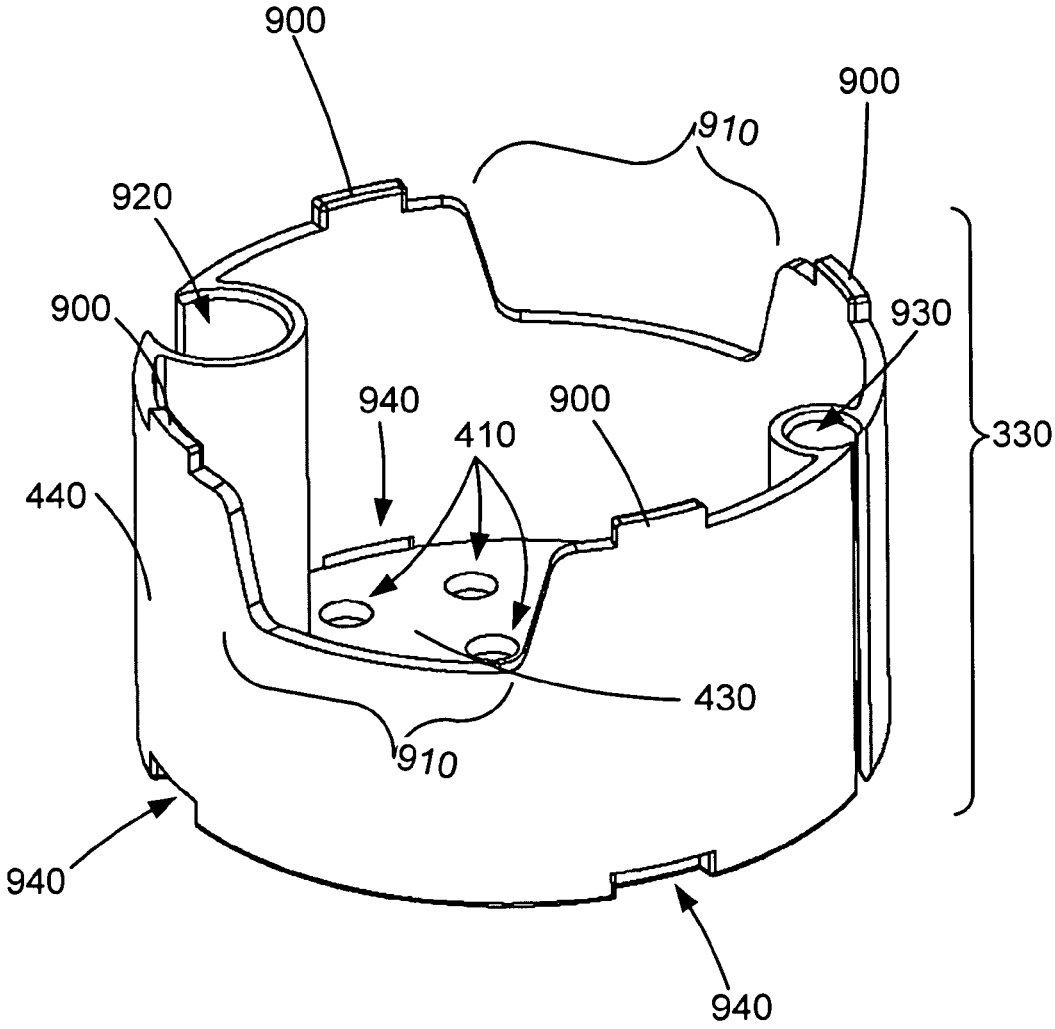
FIG. 9 depicts aspects of a storage unit.
Figure 10:
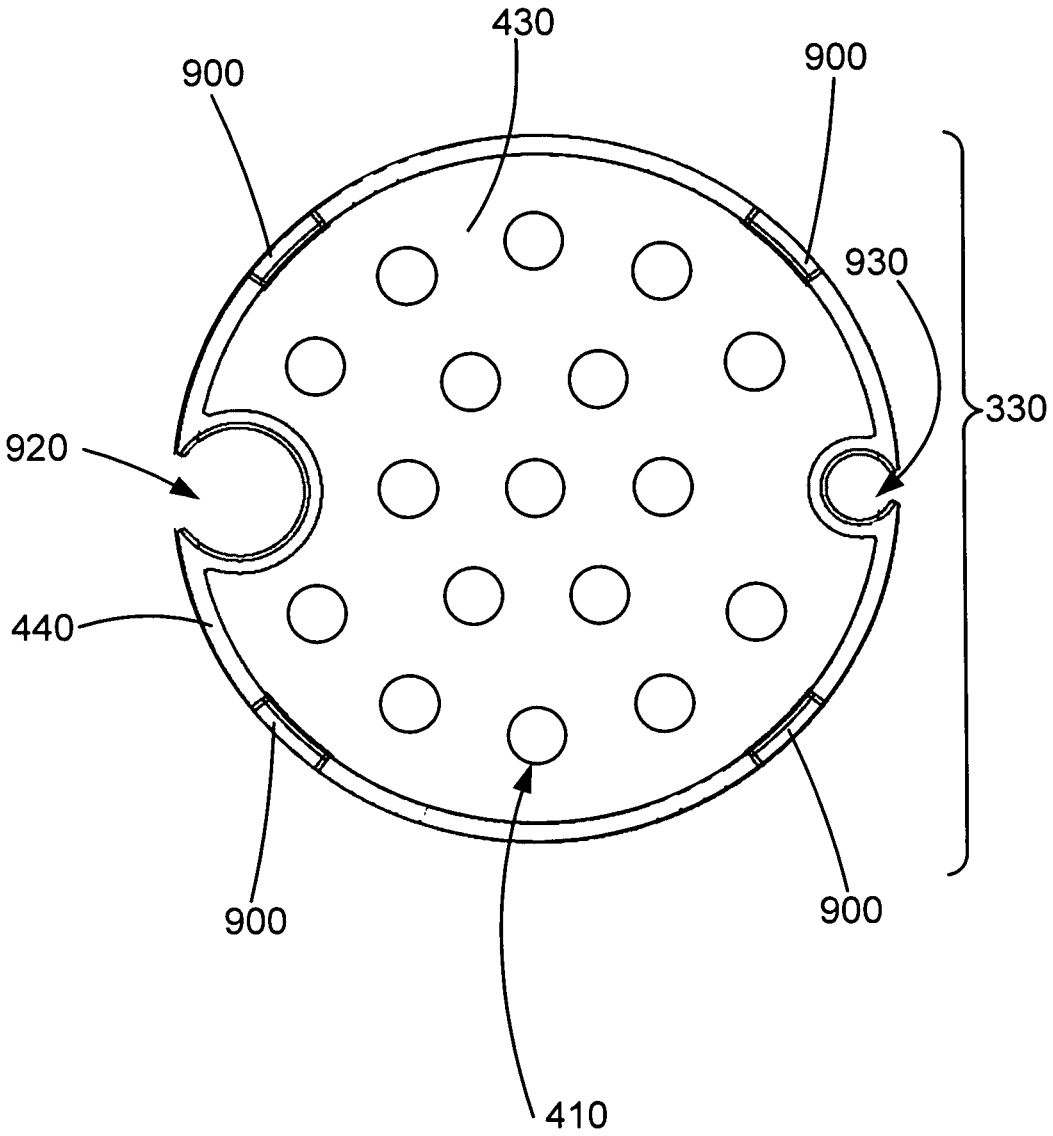
FIG. 10 illustrates aspects of a storage unit such as that depicted in FIG. 9.
Figure 11:
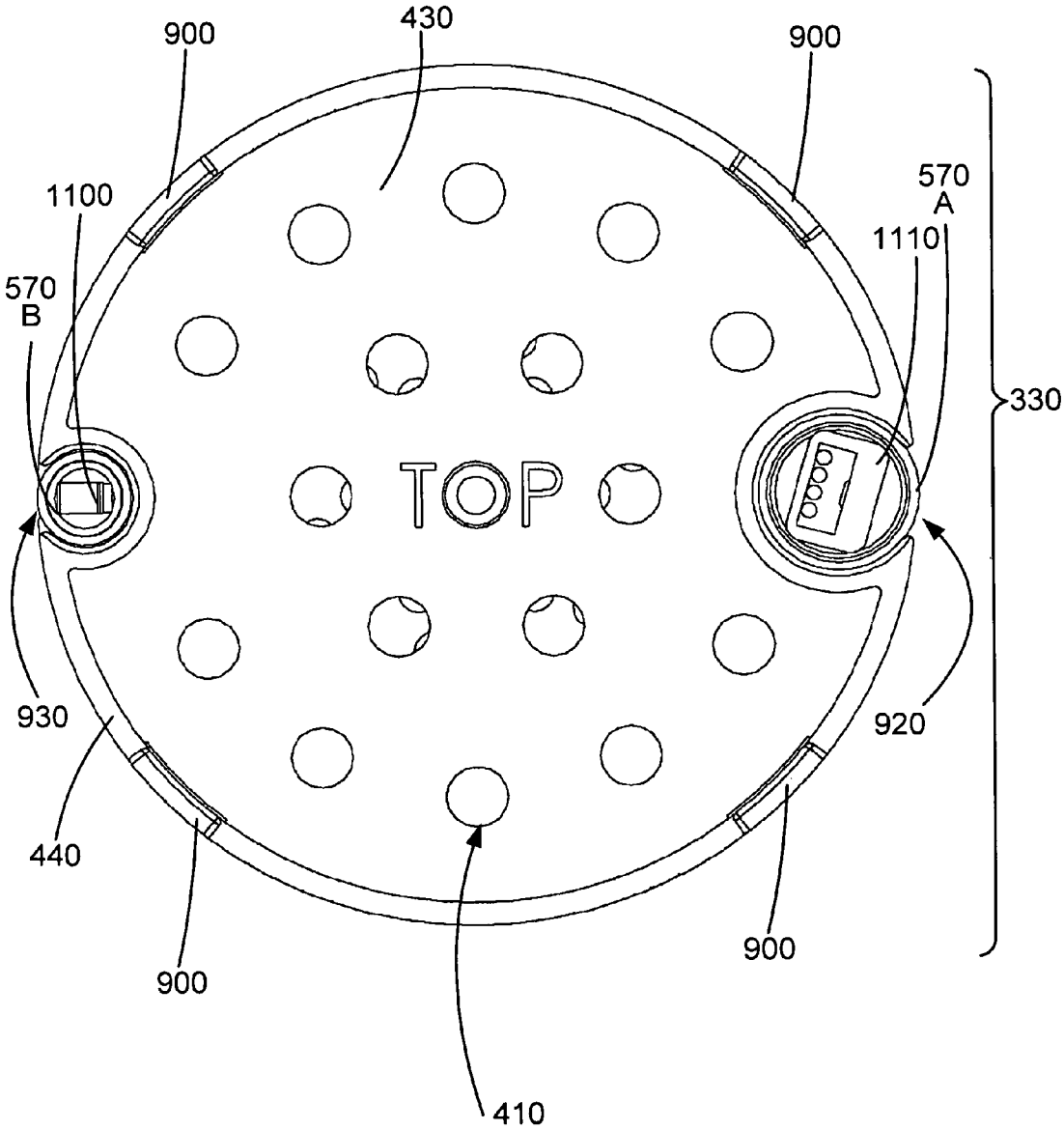
FIG. 11 shows aspects of a stored material module.

A stored material module 320 may be configured to reversibly mate with an aperture in a storage structure (see e.g. FIGS. 9, 10 and 11). The stored material module 320 includes a plurality of stored material units 330. Although each of the stored material units 330 depicted in FIGS. 3 and 4 are of a similar vertical dimension, or height, in some embodiments the stored material units 330 may be of a variety of vertical dimensions, or heights. Each of the stored material units 330 is configured in a cup-like shape. Each of the stored material units 330 includes a side region 440 and a bottom region 430 positioned at substantially right angles to the side region 440. Each of the stored material units 330 may include a plurality of apertures 410 in the bottom of the cup-like unit. The stored material units 330 are arrayed in a columnar stack, with most of the stored material units 330 resting on top of a lower stored material unit 330. At the bottom of the column of stored material units 330, the lowest stored material unit 330 sits on top of a stored material module base 420. At the top of the column of stored material units 330, the highest stored material unit 330 is covered with a cap 340. The cap 340 includes an attachment region 370. Although not illustrated in FIGS. 3 and 4, in some embodiments a stored material module 320 includes a flange, knob, handle or shaft configured to enable removal and insertion of the stored material module 320 into a storage region 130. Although not illustrated in FIGS. 3 and 4, in some embodiments a stored material module 320 includes an indentation along at least one vertical side, the indentation configured for insertion and support of wires as part of an information system. Although not illustrated in FIGS. 3 and 4, in some embodiments a stored material module 320 includes an indentation along at least one vertical side, the indentation configured for insertion and support of wires as part of a sensor system.

At the top of the stored material module 320 illustrated in cross-section, FIG. 4 depicts an attachment region 370 configured for reversible attachment of a central stabilizer unit 350 to the stored material module 320. For example, the attachment region 370 may include a threaded region configured to reversibly mate with a threaded region on a central stabilizer unit 350. The central stabilizer unit 350 may be configured from a material with low thermal conductivity, such as a low thermal mass plastic, or a rigid foam material. The central stabilizer unit 350 may be configured to substantially fill the conduit 125 in the connector 115. The central stabilizer unit 350 may be configured to provide lateral stabilization and/or support to the attached the stored material module 320. As illustrated in FIG. 4, a distal end of a central stabilizer unit 350 may protrude beyond the end of the connector 115.

Figure 5:
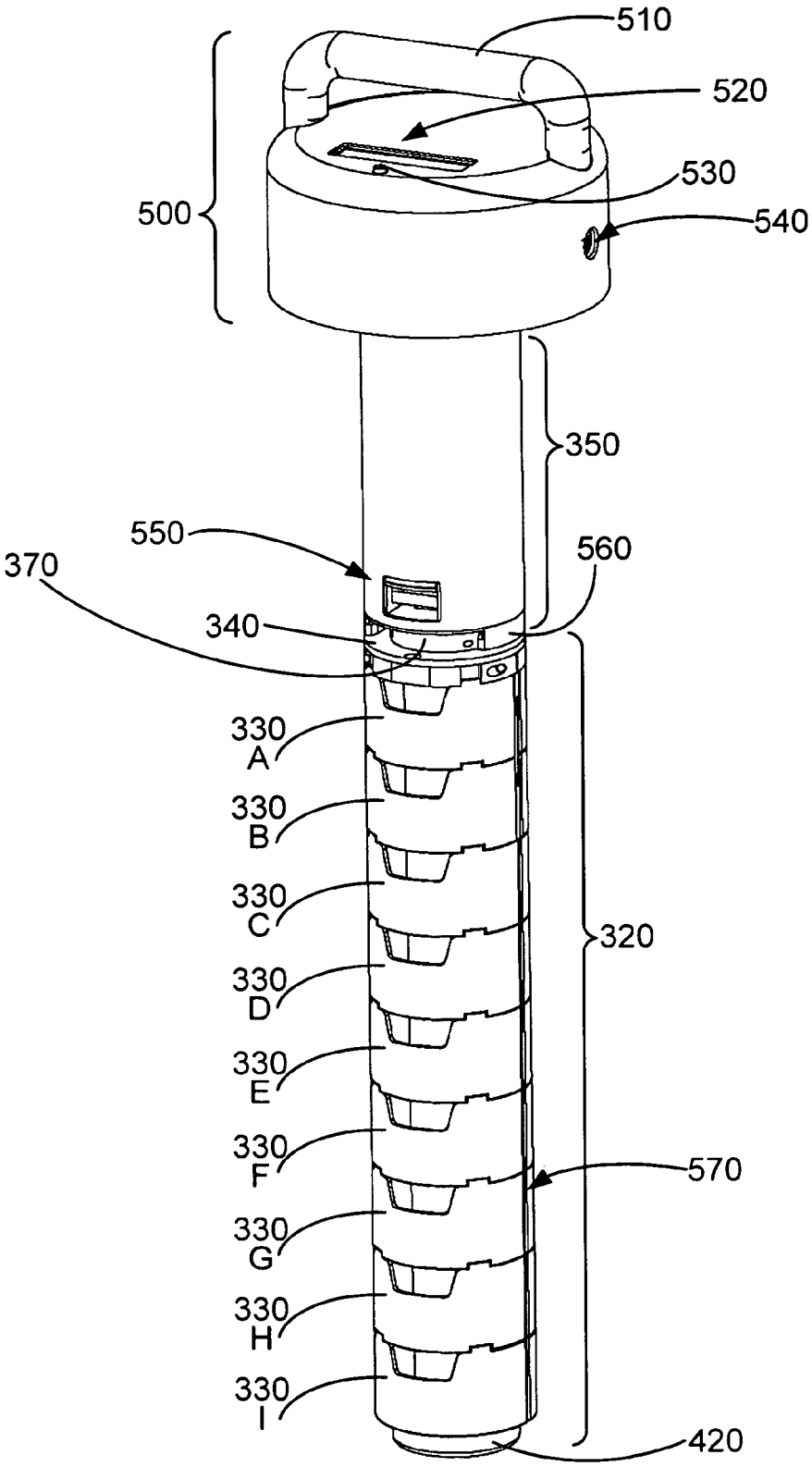
FIG. 5 depicts a stored material module and a central stabilizer configured for use with a substantially thermally sealed storage container.

FIG. 5 illustrates aspects of an apparatus for use with a substantially thermally sealed storage container. An apparatus, as illustrated in FIG. 5, includes: a stored material module including a plurality of storage units configured for storage of medicinal units, the stored material module including a surface configured to reversibly mate with a surface of a storage structure within a substantially thermally sealed storage container and including a surface configured to reversibly mate with a surface of a stabilizer unit; a storage stabilizer unit configured to reversibly mate with the surface of the stored material module; a stored material module cap configured to reversibly mate with a surface of at least one of the plurality of storage units within the stored material module and configured to reversibly mate with a surface of the at least one storage stabilizer unit; and a central stabilizer unit configured to reversibly mate with a surface of the stored material module cap, wherein the central stabilizer unit is of a size and shape to substantially fill a conduit in the substantially thermally sealed storage container. The size and shape of the apparatus is dependent on the particular container 100 with which the apparatus is used. For example, the stored material module base 420 is configured to reversibly mate with the surface of an aperture in the storage structure 200, while the lid 500 is configured to remain external to the container 100. The apparatus, therefore, must be of an appropriate length (e.g. along the axis between the stored material module base 420 and the lid handle 510) to allow the stored material module base 420 to reversibly mate with the surface of an aperture in the storage structure 200, while simultaneously allowing the lid 500 to remain external to the container 100. Similarly, the stored material module base 420, the stored material module 320 and the central stabilizer 350 of the apparatus are configured to be reversibly inserted and removed from the interior of the container 100 through the conduit 125. The apparatus, therefore, must be of a diameter (i.e. approximately horizontal relative to FIG. 5) across the stored material module base 420, the stored material module 320 and the central stabilizer 350 to fit within the conduit 125. Preferably, the central stabilizer 350 has a diameter similar to the minimal diameter of the conduit 125, so that there is minimal air space between the outer surface of the central stabilizer 350 and the surface of the connector 115 when the apparatus is in use within the container 100. An apparatus such as illustrated in FIG. 5 also should be of a weight and size suitable for handling by a person. For example, the apparatus should be configured to allow an individual person to easily pull the apparatus partially out of the container 100 with one hand, and to remove stored material from a storage unit 330 with the opposite hand. For example, the total apparatus such as illustrated in FIG. 5 should be no more than 3 kg, or no more than 5 kg, or no more than 7 kg, or no more than 10 kg when in use with stored material included within the storage units 330 A-I.

Components of the apparatus may be fabricated from a variety of materials, depending on the embodiment. For example, multiple components may be fabricated from materials selected for attributes such as cost, strength, density, weight, durability, low thermal transfer properties, resistance to corrosion, and thermal stability. Some of the components may be fabricated from a rigid plastic material, such as polyoxymethylene (POM) or Delrin™. Some of the components may be fabricated from stainless steel. Some of the components may be fabricated from aluminum. Some of the components may be fabricated from glass-reinforced plastic (GRP) or fiberglass.

As shown in FIG. 5, a stored material module 320 includes a plurality of storage units, 330A, 330B, 330C, 330D, 330E, 330F, 330G, 330H, and 330I. The storage units 330A-I are positioned in a columnar array in the stored material module 320. The storage units 330A-I are positioned as a vertical stack within the stored material module 320. As illustrated, the storage units 330A-I are configured to be interchangeable within the stored material module 320. For example, storage unit 330 B and storage unit 330 D may be removed from the stored material module 320 and switched in position within the stored material module 320 (i.e. so the storage unit order would be A, D, C, B, E, F, G, H, I) without loss of function or significant changes in the total size and shape of the stored material module 320. As illustrated, storage units 330A-I are of a substantially similar size and shape. In some embodiments, there may be at least two storage units 330 of a similar diameter relative to the column of the stored material module 320 but with distinct lengths, or heights relative to the stored material module 320 illustrated in FIG. 5. Such differently-sized storage units 330 may be suitable for storage of materials of different sizes within a single stored material module 320. For example, medicinal vials, such as vaccine vials, of different heights may be stored within a single stored material module 320 in distinct storage units 330 with different heights.

Each of the storage units 330A-I are configured for storage of medicinal units, more specifically each of the storage units 330A-I are configured for storage of medicinal vials, such as vaccine vials, of a set size and shape. Each of the storage units 330A-I are configured for storage of a number of vaccine vials, depending on the size of the vaccine vials (i.e. 2 cc or 3 cc vials). Given the space available, each of the storage units 330A-I are configured to store a maximum number of medicinal vials, for example less than 30 medicinal vials, less than 20 medicinal vials, or less than 10 medicinal vials. In some embodiments, one or more of the plurality of the storage units 330A-I are configured to store prefilled medicinal syringes and associated packaging, for example prefilled syringes containing vaccine. Given the space available and the packaging associated with a prefilled syringe, each of the storage units 330A-I may be configured to store a maximum number of prefilled medicinal syringes, for example less than 25 medicinal syringes, less than 20 medicinal syringes, less than 15 medicinal syringes, less than 10 medicinal syringes, or less than 5 medicinal syringes. Additional packaging, padding or contamination-limiting material may be added to one or more storage unit 330 A-I as desirable for a specific embodiment and type of stored material. One or more storage units 330A-I may also be left empty during use of the container, depending on the needs of the user.

The stored material module 320 includes a surface configured to reversibly mate with a surface of a storage structure within a substantially thermally sealed storage container. More specifically, the stored material module 320 includes a stored material module base 420 operably attached to the stored material module at an end of the stored material module distal to the stored material module cap. The exterior surface of the stored material module base 420 is configured to reversibly mate with the edge surface of an aperture 220, 210 in the storage structure 200 (not illustrated in FIG. 5). In some embodiments, as illustrated in FIGS. 26-31 and as discussed more fully in the associated text, a stored material module base 420 includes one or more apertures with edges configured to reversibly mate with an external surface of a stabilizer unit.

The apparatus depicted in FIG. 5 also includes a storage stabilizer unit 570 configured to reversibly mate with a surface of the stored material module 320. Each of the plurality of storage units 330A-I within the stored material module 320 include a surface configured to reversibly mate with an outer surface of the storage stabilizer unit 570. See also FIGS. 9-11 and associated text. As illustrated in FIG. 5, a single storage stabilizer unit 570 of a substantially rod-like shape is positioned along the outer edge of the surface of the stored material module 320. In some embodiments, there may be two or more storage stabilizer units 570. The selection on number and positioning of the storage stabilizer units 570 will depend on the intended use of a substantially thermally sealed storage container, for example the expected motion to the substantially thermally sealed storage container in transport or during use. A storage stabilizer unit 570 is configured to provide lateral support for the stored material module 320 column, maintaining the structure of the stored material module 320 during use. Depending on the embodiment, a storage stabilizer unit 570 may be fabricated from material such as stainless steel, plastic, or glass-reinforced plastic. For durability, a storage stabilizer unit 570 may be fabricated from a material that resists corrosion and maintains its properties in a given intended use. For example, in embodiments wherein the intended use includes maintaining an internal storage region 130 of a container 100 between 0 degrees Centigrade and 10 degrees Centigrade, a storage stabilizer unit 570 may be fabricated from a material predicted to maintain its strength and structure at in that temperature range. For example, in embodiments wherein the intended use includes humid conditions, a storage stabilizer unit 570 may be fabricated from a material with low corrosion properties in those conditions. FIGS. 11, 12 and 21-29 and associated text further describe storage stabilizer units 570.

As illustrated in FIG. 5, the apparatus includes a stored material module cap 340 configured to reversibly mate with a surface of at least one of the plurality of storage units (e.g. 330 A as illustrated in FIG. 5) within the stored material module 320 and configured to reversibly mate with a surface of the at least one storage stabilizer unit 570. The stored material module cap 340 is configured to be positioned at one end of the columnar array of stored material units 330 in a stored material module 320. A stored material module cap 340 may include at least one aperture with a surface configured to reversibly mate with a surface of a tab of a stored material unit 330. A stored material module cap 340 may include at least one aperture configured to attach a fastener between the stored material module 320 and the stored material module cap 340. Depending on the embodiment, a stored material module cap 340 may be fabricated from a number of materials of low thermal density and sufficient strength and durability. For example, a stored material module cap 340 may be fabricated from low thermal density plastic, or glass-reinforced plastic.

A stored material module cap 340 is configured to reversibly mate with a surface of a central stabilizer unit 350. The cap may include a connection region 370, as described in more detail in FIGS. 13-17. A connection region 370 may include a base and a rim, with a surface of the connection region 370 configured to reversibly mate with a surface of the central stabilizer 350. A connection region 370 is configured to allow a user to reversibly slide the stored material module 320 and the central stabilizer unit 350 and to maintain their relative positions during use of the apparatus. A stored material module cap 340 may include a connection region 370, including an aperture; and a circuitry connector within the aperture, the circuitry connector configured to reversibly mate with a corresponding circuitry connector on a surface of the central stabilizer 350. For example, an aperture in a stored material module cap 340 may be configured to allow for a circuitry connector within the aperture, the circuitry connector positioned to mate with a corresponding connector on a central stabilizer unit 350. A stored material module cap 340 may include a surface region configured to reversibly mate with a surface of a fastener between the stored material module cap 340 and a central stabilizer 350.

The apparatus illustrated in FIG. 5 also includes a central stabilizer unit 350. The central stabilizer unit 350 is configured to reversibly mate with a surface of the stored material module cap 340, wherein the central stabilizer unit 350 is of a size and shape to substantially fill a conduit 125 in the substantially thermally sealed storage container 100. The central stabilizer unit 350 is positioned with a central axis substantially identical to the column formed by the stored material module 340 during regular use. The central stabilizer unit 350 includes a base 560, wherein the base 560 includes a surface configured to reversibly mate with a surface of the stored material module cap 340. The central stabilizer unit 350 may include an aperture 550 configured for user access to a fastener release for a fastener between the central stabilizer unit 350 and the stored material module 340. The central stabilizer unit 350 may include a fastener positioned to reversibly attach the central stabilizer unit to the stored material module cap 340. The central stabilizer unit 350 may include a mechanical release operably attached to the fastener, the release positioned for access from an exterior surface of the central stabilizer unit 350, such as through an aperture 550.

The apparatus illustrated in FIG. 5 includes a lid 500 attached to an end of the central stabilizer unit 350 at a site distal to the stored material module cap 340. The lid 500 is attached to a handle 510 on a surface distal to the end of the central stabilizer unit 350. The lid 500 includes a display 520, for example a digital display unit, such as a monitor, screen, or video display device. The display 520 may be integral to the lid 500. A display 520 may be a LCD display. The lid may also include an electromechanical user input device 530, such as a button operably attached to circuitry. In some embodiments, the user input device 530 and associated circuitry is operably attached to the display 520, for example so that a signal is sent to the display 520 when the user input device 530 is operated by a user. For example, a person may depress a button user input device 530 and send a signal to the circuitry system, causing the system to respond by sending a signal to display the most recent sensor readings on the display 520. The lid 500 may include an access aperture 540 for access to a connector operably connected to circuitry positioned under the lid 500. In various embodiments, the lid 500 may be fabricated out of a variety of materials with low thermal conductivity and appropriate durability, hardness and strength. For example, the lid may be fabricated from a suitable plastic, glass-impregnated plastic, or aluminum.

Although not shown in FIG. 5, in some embodiments the lid 500 serves as a cover for a circuitry system located in the space under the lid and external to the container 100. For example, a circuitry system may include a global positioning device (i.e. GPS) and be configured to send a signal to a display 520 at set intervals, or in response to an input signal when a user input device 530 is operated by a user. For example, a circuitry system may be operably connected to a temperature sensor located on a stored material module 320 or within a stabilizer unit 570, the circuitry system configured to send a signal to a display 520 at set intervals, or in response to an input signal when a user input device 530 is operated by a user. In some embodiments, a circuitry system may be operably connected to an electromechanical switch located on a surface of the lid 500 in a region configured to mate with a surface of a substantially thermally sealed container 100 when the lid 500 is positioned on a container 100. Such an electromechanical switch may be configured with the associated circuitry to maintain a closed electrical circuit when the switch is engaged (i.e. pressed down by the pressure of the surface of the container 100 against the lid 500). A circuitry system and associated electromechanical switch located on a surface of the lid 500 may be configured to sound an alarm, such as a specific signal on the display 520, in response to the electromechanical switch being unengaged and the associated closed electrical circuit broken. A circuitry system may be configured to record data, for example from a sensor, over time. A circuitry system may be configured to display data on the display 520 in response to a user of the apparatus operating the user input device 530. A circuitry system may be configured to display data on the display 520 in response to predetermined parameters, such as a preset GPS coordinate being detected or a preset temperature being detected by an attached sensor.

A circuitry system may include at least one power source. An electrical power source may originate, for example, from municipal electrical power supplies, electric batteries, or an electrical generator device. A power source may include an electrical connector configured to connect with a municipal electrical power supply, for example through a connection associated with an access aperture 540 in the lid 500. A power source may include a battery pack. A power source may include an electrical generator, for example a solar-powered generator. In some embodiments, sensors within the apparatus may also be operably connected to a power source located under the lid 500. For example, power source such as a battery pack may be operably connected to a temperature sensor located in a stabilizer unit through wires running through the stabilizer unit, through an aperture in the stored material module cap 340, through an aperture in the central stabilizer 350 to circuitry located under the lid 500. For example, power source such as a battery pack may be operably connected to display 520 associated with the surface of the lid 500.

A circuitry system may be operably connected to a computing device, such as via a wire connection, such as joined through an access aperture 540 in the lid 500 or a wireless connection. The computing device may include a display, such as a monitor, screen, or video display device. The computing device may include a user interface, such as a keyboard, keypad, touch screen or computer mouse. A computing device may be a desktop system, or it may include a computing device configured for mobility, for example a PDA, tablet-type device, laptop, or mobile phone. A system user may use the computing device to obtain information regarding the circuitry system and apparatus, query the circuitry system, or set predetermined parameters regarding the circuitry system. For example, a remote system user, such as an individual person operating a remote computing device, may send signals to the circuitry system with instructions to set the parameters of acceptable temperature readings from a temperature sensor, and instructions to transmit a signal to the display 520 if temperature readings deviate from the acceptable parameters.

A circuitry system may include a controller. A circuitry system may include a power distribution unit. The power distribution unit may be configured, for example, to conserve the energy use by the system over time. The power distribution unit may be configured, for example, to minimize total energy within the substantially thermally sealed storage region 130 within the container 100, for example by minimizing power distribution to one or more sensors located within the stored material module 320 or stabilizer unit 570. The power distribution unit may include a battery capacity monitor. The power distribution unit may include a power distribution switch. The power distribution unit may include charging circuitry. The power distribution unit may be operably connected to a power source. For example, the power distribution unit may be configured to monitor electricity flowing between the power source and other components within the circuitry system. A wire connection may operably connect a power distribution unit to a power source.

Depending on the embodiment, the circuitry system may include additional components. For example, the circuitry system may include at least one indicator, such as a LED indicator or a display indicator. For example, the circuitry system may include at least one indicator that provides an auditory indicator, such as an auditory transmitter configured to produce a beep, tone, voice signal or alarm. For example, the circuitry system may include at least one antenna. An antenna may be configured to send and/or receive signals from a sensor network. An antenna may be configured to send and/or receive signals from an external network, such as a cellular network, or as part of an ad-hoc system configured to provide information regarding a group of substantially thermally sealed containers 100. The circuitry system may include one or more global positioning devices (e.g. GPS). The circuitry system may include one or more data storage units, such as computer DRAM, hard disk drives, or optical disk drives. The circuitry system may include circuitry configured to process data from a sensor network. The circuitry system may include logic systems. The circuitry system may include other components as suitable for a particular embodiment.

The circuitry system may include one or more external network connection device. An external network connection device may include a cellular phone network transceiver unit. An external network connection device may include a WiFi™ network transceiver unit. An external network connection device may include an Ethernet network transceiver unit. An external network connection device may be configured to transmit with Short Message Service (SMS) protocols. An external network connection device may be configured to transmit to a general packet radio service (GPRS). An external network connection device may be configured to transmit to an ad-hoc network system. An external network connection device may be configured to transmit to an ad-hoc network system such as a peer to peer communication network, a self-realizing mesh network, or a ZigBee™ network.

Figure 6:
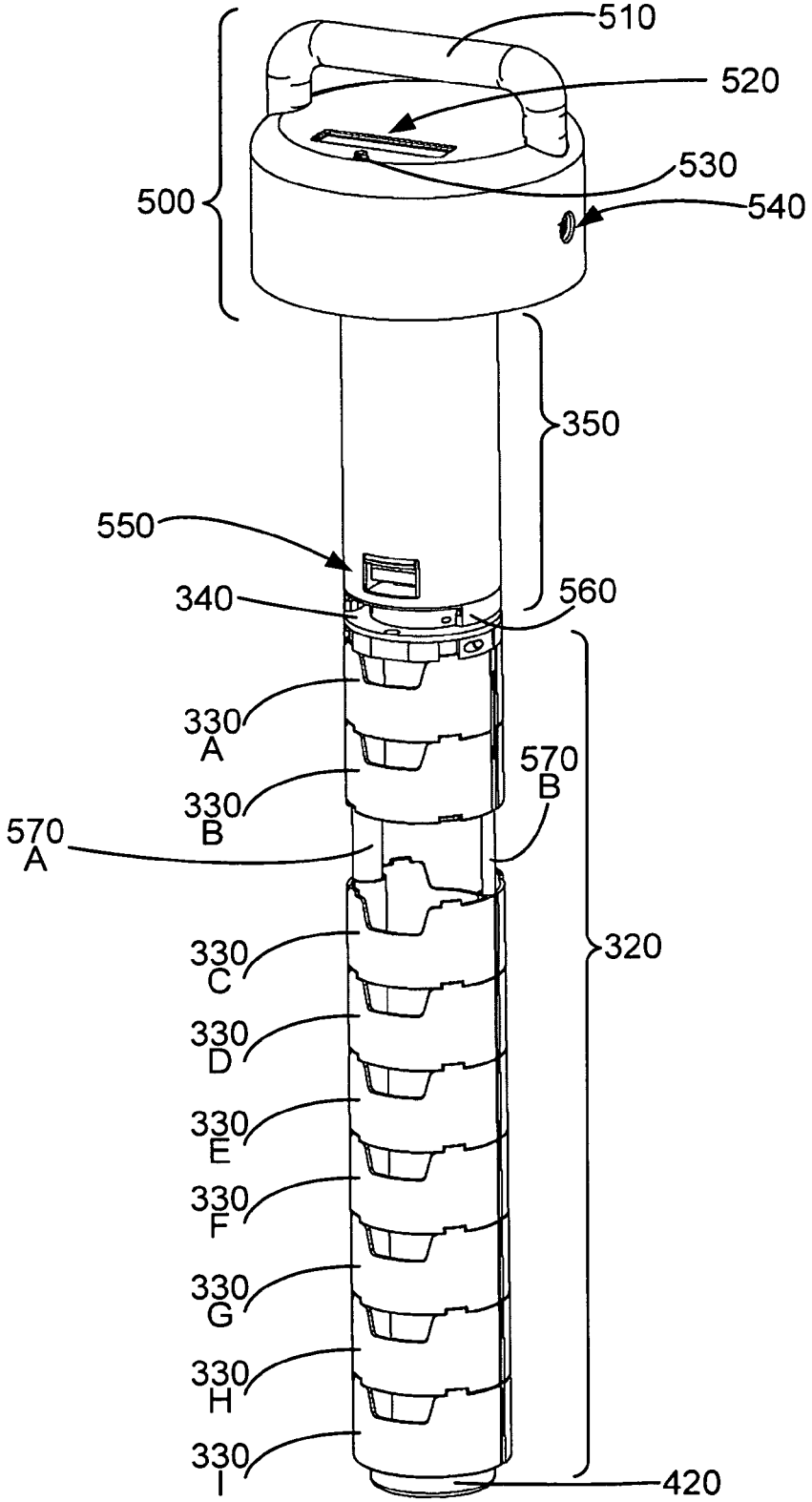
FIG. 6 illustrates a stored material module and central stabilizer as depicted in FIG. 5, with two of the storage units positioned to allow access to the interior of a third storage unit within the stored material module.

FIG. 6 illustrates aspects of the use of an apparatus such as that shown in FIG. 5. FIG. 6 illustrates how components of the apparatus may shift relative to each other for access of stored material within the storage units 330 A-I. In the view shown in FIG. 6, some of the plurality of stored material units 330 A-I have moved relative to the column of the stored material module 320. Stored material units 330 A and 330 B have moved vertically; or upwards as viewed in FIG. 6, relative to the remainder of the column of the stored material module 320 including stored material units 330 C-I and the base 420. The relative movement of the stored material units 330 A and 330 B allows a user of the apparatus to access material stored in stored material unit 330 B, for example by grasping a stored medicinal vial therein with the user's fingers. Similarly, the relative movement of the stored material units 330 A and 330 B allows a user of the apparatus to insert material into stored material unit 330 B, for example by placing medicinal vial from a user's fingers into stored material unit 330 B. Depending on the embodiment, the relative movement of the stored material units (e.g. 330 A and 330 B in FIG. 6) should be sufficient to allow access to the stored material within the stored material units. For example, stored material units that were previously in contact with each other (e.g. 330 B and 330 C in FIG. 5) should move at least 3 cm, at least 4 cm, or at least 5 cm apart depending on the size of the stored material. For example, stored material units that were previously in contact with each other (e.g. 330 B and 330 C in FIG. 5) should move at least as far from each other as the height of the wall of the unit from which material will be removed (e.g. 330 C in FIG. 6).

As depicted in FIG. 6, in some embodiments there are multiple storage stabilizer units 570 A, 570 B. The storage stabilizer units 570 A, 570 B are each configured to reversibly mate with a surface of at least one of the plurality of storage units 330 A-I within the stored material module 320 and configured to reversibly mate with the surfaces of each of the storage stabilizer units 330 A-I. For example, as illustrated in FIG. 6, the storage stabilizer units 570 A, 570 B are configured as tubular structures, and the storage units 330 A-I are configured with a circular surface region that reversibly mates with the surfaces of the tubular structures. As illustrated in FIG. 6, distinct storage stabilizer units 570 A, 570 B may be of different relative diameters. For example, storage stabilizer unit 570 A may be of approximately double the diameter of storage stabilizer unit 570 B. For example, storage stabilizer unit 570 A may have a diameter of approximately one centimeter, while storage stabilizer unit 570 B may have a diameter of approximately a half centimeter. In some embodiments, the plurality of storage units 330 A-I are configured to slide along an axis substantially defined by one or more storage stabilizer units 570 A, 570 B. As illustrated in FIG. 6, the storage stabilizer units 570 A, 570 B are configured as tubular structures, and the storage units 330 A-I are configured with a corresponding surface region that reversibly mates with and can slide along the surfaces of the tubular structures. Wherein there are distinct storage stabilizer units 570 A, 570 B of different relative diameters, the corresponding storage units 330 A-I surfaces configured to mate with the surfaces of the stabilizer units 570A, 570B are similarly of different sizes (see FIGS. 9-11 and associated text). The embodiment illustrated in FIG. 6 includes two storage stabilizer units 570 A, 570 B, however in some embodiments there may be a single storage stabilizer unit or more than two storage stabilizer units. The choice of number and relative positioning of storage stabilizer units depends on the intended use of a particular container 100. For example a container 100 designed for use in a relatively stable setting may require fewer storage stabilizer units 570 A, 570 B than a container 100 designed for frequent transport or relocation in use. Depending on the intended use of the container 100, a stabilizer unit 570 A, 570 B may be fabricated from a variety of materials. The choice of material may be made relative to considerations such as durability, thermal properties, corrosion resistance and cost. In some embodiments, a stabilizer unit 570 A, 570 B may be fabricated from stainless steel. In some embodiments, a stabilizer unit 570 A, 570 B may be fabricated from plastic, or glass-reinforced plastic.

Figure 7:
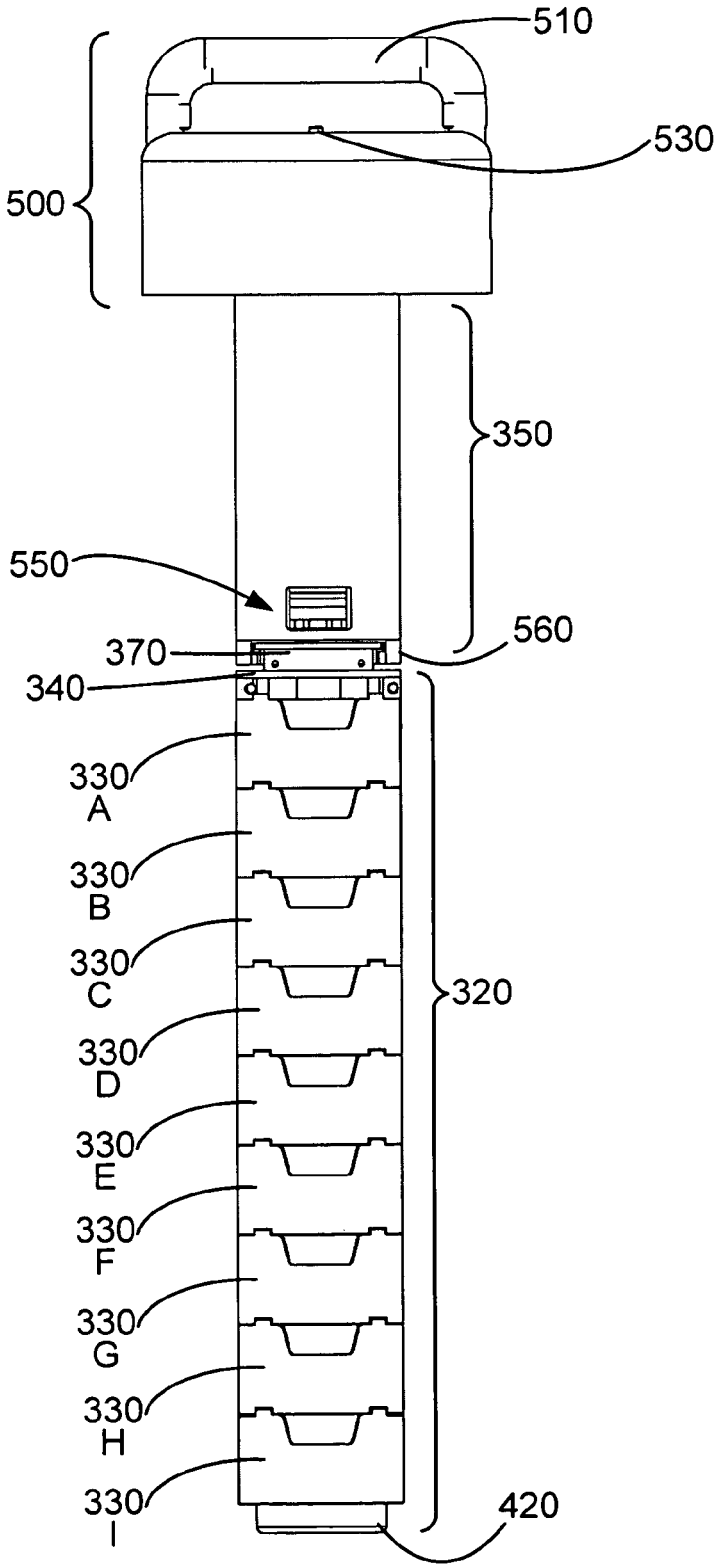
FIG. 7 shows a stored material module and a central stabilizer configured for use with a substantially thermally sealed storage container.

FIG. 7 illustrates an apparatus such as that shown in FIG. 5 in a full side view. An apparatus in the configuration illustrated in FIG. 7 is suitable for use with, and placement in, a substantially thermally sealed container 100. An apparatus such as illustrated in FIG. 7 includes a lid 500 with an integral handle 510 and a user input device 530, such as an electromagnetic switch. The lid 500 is attached to a central stabilizer unit 350 at an opposing end from the base 560 of the central stabilizer unit 350. The central stabilizing unit 350 includes an aperture 550 configured to allow a user of the apparatus to access a fastener within the central stabilizing unit 350, such as a fastener configured to reversibly hold the central stabilizing unit in position relative to a stored material module cap 340. The apparatus includes a stored material module 320 attached to the stored material module cap 340 at an opposing face of the stored material module cap 340 from the central stabilizing unit 350. The stored material module 320 includes a plurality of storage units (e.g. 330) arrayed in a vertical stack with the top edge of each storage unit in the stack in contact with the corresponding lower edge of the adjacent storage unit. The bottom of the stored material module 320 includes a stored material module base 420. In the view illustrated in FIG. 7, all of the storage units (e.g. 330) within the stored material module 320 are in the storage position, without substantial gaps or distance between the storage units. Although not illustrated in FIG. 7, the apparatus may also include one or more storage stabilizer unit located behind the storage units in the instant view.

Figure 8:
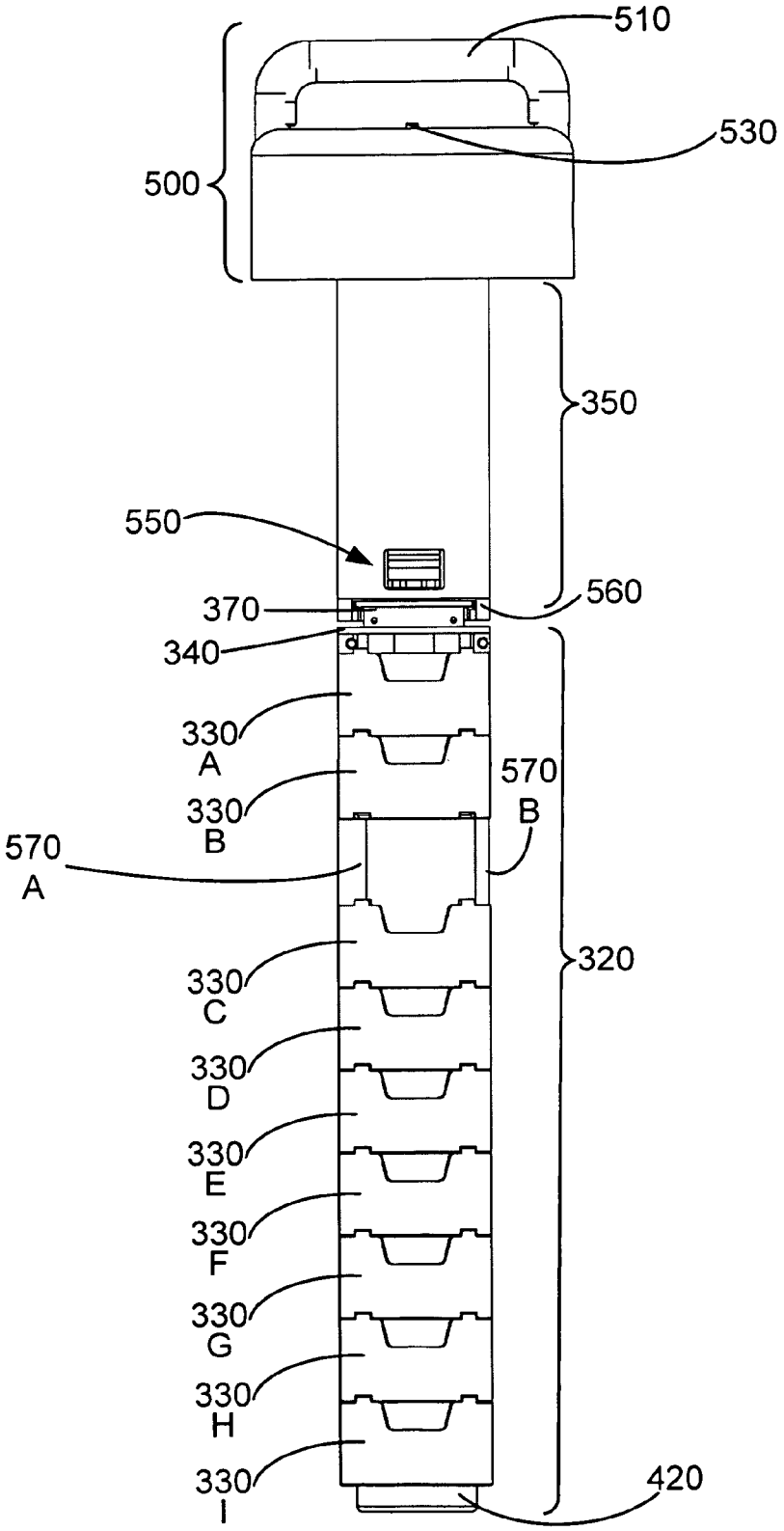
FIG. 8 illustrates a stored material module and central stabilizer as depicted in FIG. 7, with two of the storage units positioned to allow access to the interior of a third storage unit within the stored material module.

FIG. 8 depicts an apparatus such as the one shown in FIG. 7, in a similar full side view. The apparatus illustrated in FIG. 8 includes the same features as in FIG. 7, with the addition that two of the storage units (330 A and 330 B) are separated from the rest of the stack of storage units (330 C-I). This configuration would allow access to material stored within the storage unit identified as 330 C. As illustrated in FIG. 8, the separation of the storage units 330 A and 330 B from the remainder of the units is along an axis substantially defined by two storage stabilizer units, 570 A and 570 B. Corresponding to the relative movement of the storage units, the two ends of the apparatus, the handle 510 and the stored material module base 420, are separated from each other by the length of the distance between storage units 330 B and 330 C in FIG. 8 relative to FIG. 7.

FIG. 9 illustrates aspects of a stored material unit 330. The illustrated stored material unit 330 includes a side wall 440. The side wall 440 is formed from a curved plane in a substantially cylindrical structure. The lower edge of the side wall 440 includes at least one indentation 940. The edges of the indentation 940 are configured to reversibly mate with the surfaces of one or more corresponding tabs 900 on an adjacent stored material unit 330. A stored material unit 330 may include at least one tab structure 900 on an upper edge of the cup-like structure. A stored material unit 330 may include at least one indentation 940, wherein the indentation 940 is configured to reversibly mate with a tab structure 900 on an adjacent stored material unit 330. For example, a series of tab structures 900 and corresponding indentations 940 may assist in stabilization of a columnar array of stored material units 330 in a stored material module 320. A series of tab structures 900 and corresponding indentations 940 may be configured to minimize potential displacement of the stored material units 330 in a stored material module 320. A series of tab structures 900 and corresponding indentations 940 may be configured to increase stability of stored material units 330 in a stored material module 320 during addition or removal of stored material to one or more stored material units 330. A stored material unit 330 includes a bottom 430, which is substantially planar and attached to the side wall 440 at substantially right angles. The stored material unit bottom 430 may include one or more apertures 410, configured to allow air circulation through the stored material unit, such as during storage or when the apparatus is being inserted into or removed from a substantially thermally sealed container. The side wall 440 includes at least one gap 910, configured as a region of the side wall 440 that is shorter than other regions. A gap 910 may be oriented and configured to allow a user of the apparatus to view the interior of the stored material unit 330, such as any material stored within the stored material unit 330. A gap 910 may be oriented and configured to allow a user of the apparatus increased access to any material stored within the stored material unit 330, such as when the stored material unit is distanced from an adjacent stored material unit (e.g. as in FIG. 8). A gap 910 may be configured to allow thermal circulation through a stored material unit 330. A gap 910 may be configured to allow air flow through the stored material unit 330. A gap 910 may be configured to allow visual identification of stored material within the stored material unit 330.

A stored material unit 330 may include at least one stabilizer unit attachment region 920, 930. As illustrated in FIG. 9, the stored material unit 330 includes two stabilizer unit attachment regions 920, 930. As illustrated in FIG. 9, each of the stabilizer unit attachment regions 920, 930 is configured with a surface of a size and shape to reversibly mate with a surface of a stabilizer unit 570. For example, stabilizer unit attachment region 920 is configured to reversibly mate with the surface of stabilizer unit 570 B in the embodiment illustrated in FIG. 5. For example, stabilizer unit attachment region 930 is configured to reversibly mate with the surface of stabilizer unit 570 A in the embodiment illustrated in FIG. 5. Although the stabilizer unit attachment regions 920, 930 illustrated in FIG. 9 are substantially cylindrical regions configured to reversibly mate with the surface of the tubular stabilizer units 570 A, 570 B in FIG. 5, in some embodiments a stabilizer unit attachment region may be of another shape. For example, a stabilizer unit attachment region may be configured in a substantially oblong, rectangular, triangular or other shape as required for the surface to reversibly mate with the surface of a corresponding stabilizer unit. As illustrated in FIG. 9, the stabilizer unit attachment regions 920, 930 have surfaces that are configured to allow the stabilizer unit to slide relative to the surface of the stored material unit 330. The stabilizer unit attachment regions 920, 930 are of a length shorter than the length of the surface of a corresponding stabilizer unit. The stabilizer unit attachment regions 920, 930 are configured to reversibly mate with a substantial region of the surface of a corresponding stabilizer unit as the surfaces move relative to each other.

FIG. 10 illustrates aspects of a stored material unit 330. The view illustrated in FIG. 10 is a "top down" view of a stored material unit 330 such as the one illustrated in FIG. 9. A stored material unit 330 includes a side wall 440, and a bottom region 430. The bottom region may include apertures 410, for example to promote air flow through the stored material unit 330. The side wall 440 may include one or more tab structures 900. The stored material unit 330 may include at least one stabilizer unit attachment region 920, 930. In embodiments wherein the stored material unit includes more than one stabilizer unit attachment region 920, 930, the regions may be of differing sizes and shapes, for example to promote stability, to maintain the directionality of the apparatus, or as suitable for other design requirements. For example, stabilizer units 570 A, 570 B include other features within their interiors as further illustrated in FIG. 11.

FIG. 11 depicts aspects of a stored material unit 330 in horizontal cross-section along with the associated stabilizer units 570 A, 570 B and lower stored material units in the columnar array. The view depicted in FIG. 11 is similar to the view as illustrated in FIG. 10, only with the addition of multiple lower stored material units as well as associated stabilizer units 570 A, 570 B. A stored material unit 330 includes a side wall 440, and a bottom region 430. The side wall 440 may include one or more tab structures 900. The bottom region may include apertures 410, for example to promote air flow through the stored material unit 330. As visible in FIG. 11, the apertures 410 in adjacent stored material units (e.g. 330 A, 330 B and 330 C in FIG. 5) need not align or correspond in a linear array through the column.

The stored material unit 330 shown in FIG. 11 includes stabilizer unit attachment regions 920, 930. In the embodiment illustrated in FIG. 11, the stabilizer unit attachment regions 920, 930 are of similar curvilinear shapes with distinct diameters. Each of the stabilizer unit attachment regions 920, 930 have surfaces which reversibly mate with the exterior surfaces of stabilizer units 570 A, 570 B. Each of the stabilizer units 570 A, 570 B includes an inner tube and at least one exterior tube of different internal diameters, the tubes positioned as at least one interior and at least one exterior tube relative to each other, the tubes sized to slide relative to each other. The tubes included in each of the stabilizer units 570 A, 570 B form a telescoping structure along the length of the stabilizer units 570 A, 570 B. See also FIG. 12. Each of the interior tubes included in each of the stabilizer units 570 A, 570 B forms an interior aperture, including an interior space within each of the stabilizer units 570 A, 570 B. The interior space within a stabilizer unit 570A, 570B may include additional components. As illustrated in FIG. 11, the interior space within stabilizer unit 570 A includes a circuitry connector 1110, such as common connectors between wires and circuitry components. A circuitry connector 1110 may include, for example, a cable connector, a quick-disconnect, a keyed connector, a plug and socket connector, or other types of electrical connectors as suitable to a particular embodiment. As illustrated in FIG. 11, the interior space within stabilizer unit 570 B includes a retaining unit 1100. The retaining unit 1100 is configured to maintain tension on a rod, as further illustrated in FIG. 17. In some embodiments, the interior space within a stabilizer unit 570 A, 570 B may be empty or include other components as suitable for a given embodiment.

Figure 12:
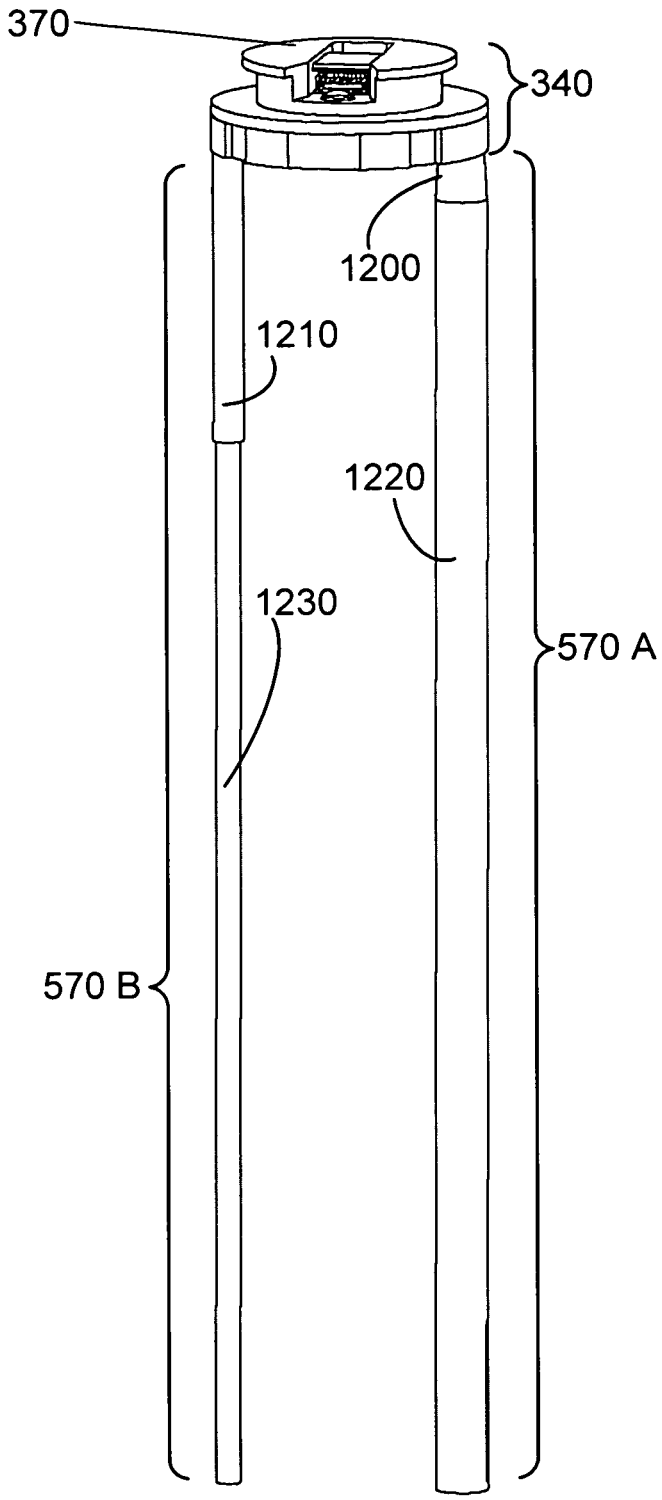
FIG. 12 depicts a stored material module cap attached to two stabilizer units.

FIG. 12 illustrates a stored material module cap 340 and two associated stabilizer units 570 A, 570 B in the absence of a stored material module 320. Although a stored material module cap 340 and associated stabilizer units 570 A, 570 B are generally implemented in combination with a stored material module 320, the stored material module 320 has been removed from FIG. 12 for purposes of illustration. As illustrated in FIG. 12, a stored material module cap 340 includes an attachment region 370. Also as illustrated in FIG. 12, each of the stabilizer units 570 A, 570 B includes an inner tube and at least one exterior tube of different internal diameters. For example, FIG. 12 illustrates that stabilizer unit 570 A includes an inner tube 1200 and an outer tube 1220, with the exterior surface of the inner tube 1200 positioned to reversibly mate with the interior surface of the outer tube 1220. The inner tube 1200 is positioned to slide relative to the outer tube 1220 in a telescoping fashion, so that the inner tube 1200 reversibly slides within the outer tube 1220. The end of the inner tube 1200 may be operably attached to a surface of the stored material module cap 340 if desired in a specific embodiment. FIG. 12 also illustrates that stabilizer unit 570 B includes an outer tube 1210 and an inner tube 1230. The exterior surface of the inner tube 1230 positioned to reversibly mate with the interior surface of the outer tube 1210. The inner tube 1230 is positioned to slide relative to the outer tube 1210 in a telescoping fashion, so that the inner tube 1230 reversibly slides within the outer tube 1210. The end of the outer tube 1210 may be operably attached to a surface of the stored material module cap 340 if desired in a specific embodiment. Each of the stabilizer units 570 A, 570 B may also include a retaining unit operably attached to the inner tube 1200, 1230 and positioned to slide within an aperture in the corresponding outer tube 1220, 1210. See FIGS. 24 and 25 for further detail on these retaining units.

Figure 13:
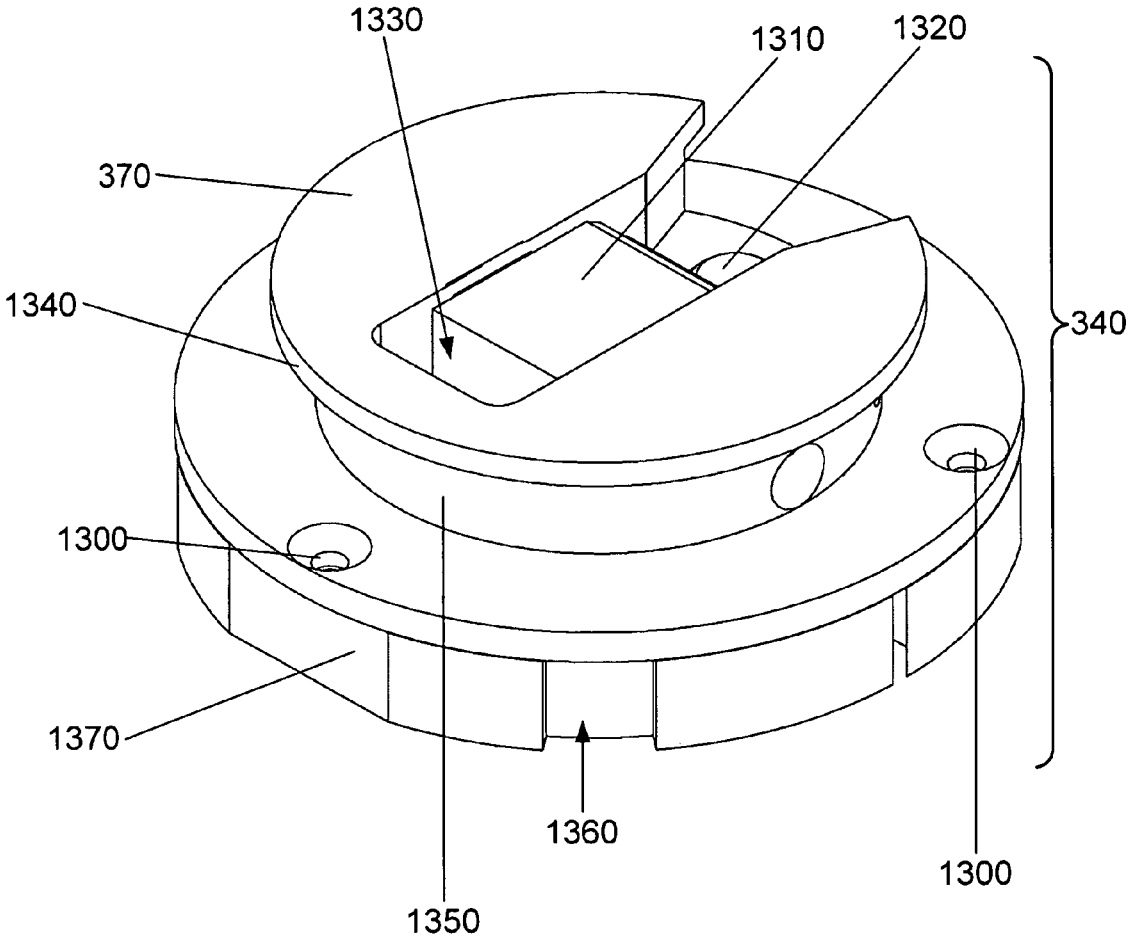
FIG. 13 illustrates aspects of a stored material module cap.

FIG. 13 depicts aspects of a stored material module cap 340. The stored material module cap 340 includes connection region 370. The connection region 370 has a surface configured to reversibly mate with a surface of a central stabilizer 350, such as an attachment region 560 of a base of a central stabilizer 350. The stored material module cap 340 is configured to reversibly attach to a central stabilizer 350. Stored material modules 320 configured to be placed in apertures 220 in an edge region of a storage structure 200 (see FIG. 2 for example) may include different embodiments of a stored material module cap 340 as suitable for their configuration. Stored material modules 320 configured to be placed in apertures 220 in an edge region of a storage structure 200 (see FIG. 2 for example) may also include a stored material module cap 340 as illustrated in FIG. 13 to provide interchangeability and flexibility of configurations of the stored material modules 320 within a storage structure 200. The connection region 370 illustrated in FIG. 13 includes a surface configured to reversibly mate with a surface of a central stabilizer 350, including a base of the connection region 1350 and a rim of a connection region 1340. The base of the connection region 1350 and a rim of a connection region 1340 as illustrated in FIG. 13 forms a flared structure configured to slide along a corresponding surface of a central stabilizer 350. The connection region 370 illustrated in FIG. 13 also includes an indentation 1330. As depicted in FIG. 13, an indentation 1330 may be of a size and shape to include a circuitry connector 1310, such as a universal serial bus (USB) connector. A circuitry connector 1310 may also include, for example, a cable connector, a quick-disconnect, a keyed connector, a plug and socket connector, or other types of electrical connectors as suitable to a particular embodiment. As shown in FIG. 13, an indentation 1330 may be of a size and shape to expose a shaft 1320 within the stored material module cap 340.

The lower region of the stored material module cap 340 is configured to reversibly attach with the upper face of the topmost stored material unit 330 in a stored material module 320. For example, the stored material module cap 340 may include an aperture 1360 with a, surface configured to reversibly mate with a surface of a tab structure 900 on a stored material unit 330. For example, a stored material module cap 340 may include one or more apertures 1300 configured to hold a fastener between the stored material module cap 340 and an adjacent stored material unit 330. A stored material module cap 340 may also include a surface region 1370 configured to provide minimal overlap with a gap 910 in a stored material unit 330. A surface region 1370 configured to provide minimal overlap with a gap 910 in a stored material unit 330 may be configured to maximize the space available for a user of the system to access stored material in the stored material unit 330, for example by using fingers to remove stored material. In some embodiments, a user of the system may use a device, such as a rod, tongs, tweezers, pincers, pliers or similar devices.

Figure 14:
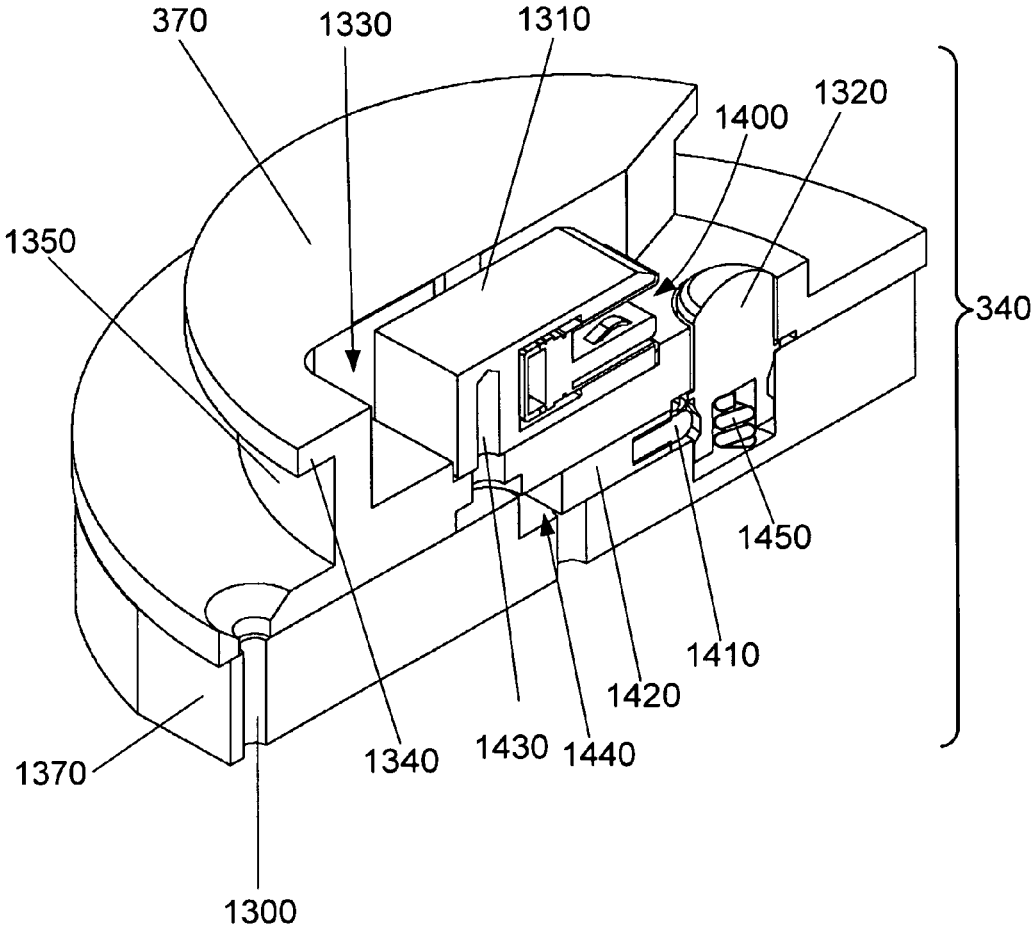
FIG. 14 depicts parts of a stored material module cap, such as illustrated in FIG. 13.

FIG. 14 depicts aspects, in an angled cross-section view, of a stored material module cap 340 such as illustrated in FIG. 13. The stored material module cap 340 includes a connection region 370 with a base region 1350 and a rim region 1340. The stored material module cap 340 includes a lower region configured to reversibly attach to the upper face of the topmost stored material unit 330 in a stored material module 320. The lower region includes an aperture 1300 configured to hold a fastener between the stored material module cap 340 and an adjacent stored material unit 330. The lower region includes a surface region 1370 configured to provide minimal overlap with a gap 910 in a stored material unit 330. As illustrated in FIG. 14, the stored material module cap 340 includes an aperture 1330. The aperture 1330 is of sufficient dimensions to provide space for a circuitry connector 1310. The circuitry connector 1310 and the corresponding region of the stored material module cap 340 may include apertures configured for a fastener 1430 to attach the circuitry connector 1310 to the stored material module cap 340. The circuitry connector 1310 illustrated in FIG. 14 is a universal serial bus (USB) type connector, but other types of circuitry connectors may be used in various embodiments as required by the specific circuitry of an embodiment. The circuitry connector 1310 includes an aperture 1400 positioned to reversibly mate with a corresponding circuitry connector on a central stabilizer 350.

The stored material module cap 340 depicted in FIG. 14 also includes interior structures configured to transmit force across the stored material module cap 340 in response to the surface of a central stabilizer 350 coming into contact with the surface of the stored material module cap 340. As will be further shown in the subsequent Figures, this transfer of force by mechanical parts results in one or more stabilizer units (e.g. 570 A, 570 B, not illustrated in FIG. 14) held in a fixed position relative to the stored material module cap 340. As illustrated in FIG. 14, the stored material module cap 340 includes an indentation 1330 of a size and shape to expose a shaft 1320 enclosed within an internal aperture of the stored material module cap 340. The shaft 1320 includes side regions of varying widths relative to the diameter of the shaft. The shaft includes side regions of varying diameters relative to the axis of the length of the shaft, or diameters approximately parallel with the top surface of the connection region 370 as illustrated in FIGS. 13 and 14. The shaft 1320 has an equilibrium position relative to the force along the axis of the shaft 1320 from the pressure of an attached spring 1450. The shaft 1320 is configured to transmit force along the axis of the shaft 1320 in response to pressure from a surface of a central stabilizer 350 coming into contact with the surface of the stored material module cap 340, including the end of the shaft 1320. Contact of a central stabilizer 350 with the surface of the stored material module cap 340 at the end of the shaft 1320 results in the shaft 1320 to move within its associated aperture, resulting in a side region with a different and larger diameter to be placed adjacent to a rod 1410 attached to a rotating plate 1420. The different and larger diameter region of the shaft 1320 causes motion of the rotating plate 1420. As illustrated in FIG. 14, the interior of the stored material module cap 340 includes an aperture 1440 sufficient to allow for motion of the rotating plate 1420. Further aspects of interior structures configured to transmit force across the stored material module cap 340 in response to the surface of a central stabilizer 350 coming into contact with the surface of the stored material module cap 340 are illustrated in the following Figures.

Figure 15:
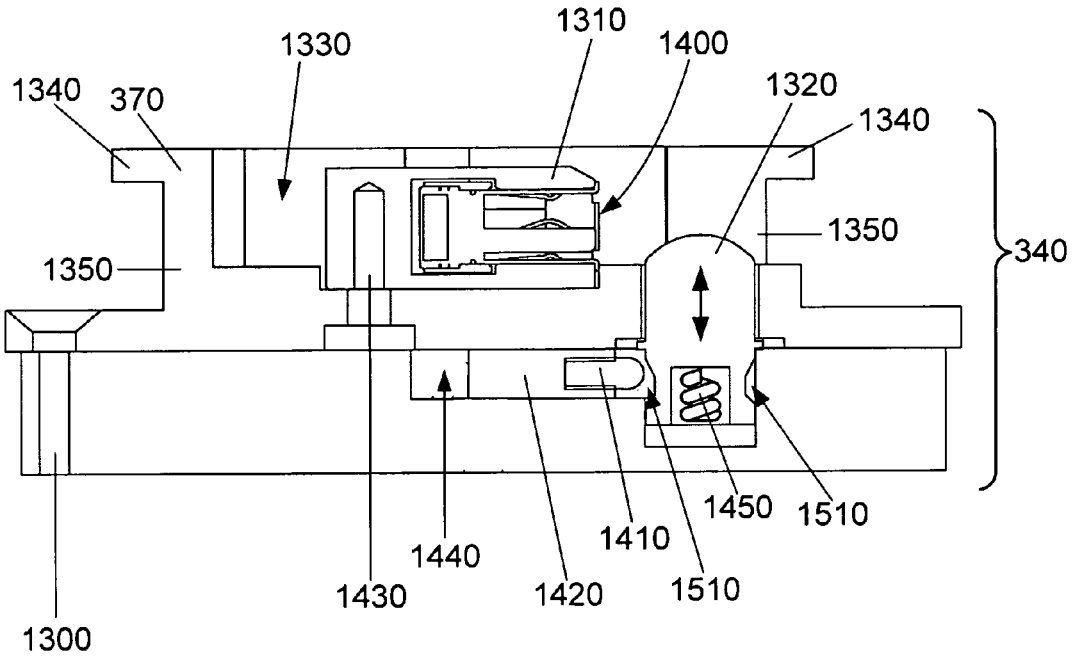
FIG. 15 shows a stored material module cap, such as illustrated in FIG. 13, in cross-section.

FIG. 15 illustrates, in a full cross-section view, further aspects of a stored material module cap 340 such as depicted in FIG. 14. The stored material module cap 340 includes a connection region 370 with a base region 1350 and a rim region 1340. As shown in FIG. 15, the base region 1350 and rim region 1340 form a flanged region for reversibly mating with a corresponding surface of a central stabilizer 350. The stored material module cap 340 includes a lower region configured to reversibly attach with the upper face of the topmost stored material unit 330 in a stored material module 320. The lower region includes an aperture 1300 configured to hold a fastener between the stored material module cap 340 and an adjacent stored material unit 330. The stored material module cap 340 includes an aperture 1330. The aperture 1330 is of sufficient dimensions to provide space for a circuitry connector 1310. The circuitry connector 1310 and the corresponding region of the stored material module cap 340 may include apertures configured for a fastener 1430 to attach the circuitry connector 1310 to the stored material module cap 340. The circuitry connector 1310 includes an aperture 1400 positioned to reversibly mate with a corresponding circuitry connector on a central stabilizer 350.

The stored material module cap 340 includes interior structures configured to transmit force across the stored material module cap 340 in response to the surface of a central stabilizer 350 coming into contact with the surface of the stored material module cap 340. The stored material module cap 340 includes an internal aperture of a size and shape to include a shaft 1320 enclosed within the stored material module cap 340. In the confirmation illustrated, the shaft 1320 end projects above the lower edge of the aperture 1330. A central stabilizer 350 reversibly attached to the stored material module cap 340 would apply pressure to the shaft 1320 end, forcing the shaft downward relative to the view in FIG. 15. A central stabilizer 350 reversibly attached to the stored material module cap 340 would apply pressure to the shaft 1320 end, pressing against a spring 1450 positioned at the base of the shaft 1320. The shaft 1320 includes side regions of varying widths relative to the diameter of the shaft 1320. For example, the shaft 1320 includes a region with a relatively small width 1510. The shaft 1320 has an equilibrium position relative to the force along the axis of the shaft 1320 from the pressure of an attached spring 1450. At the equilibrium position, the region of small width 1510 is adjacent to the end of an adjacent rod 1410. When the shaft 1320 is forced downward, or along its axis, due to contact the end of the shaft 1320 with the surface of the central stabilizer 350, the side region of the shaft 1320 adjacent to the rod 1410 is of a different and larger diameter than the region of small width 1510. The pressure on the rod 1410 causes motion of a rotating plate 1420. The interior of the stored material module cap 340 includes an aperture 1440 sufficient to allow for motion of the rotating plate 1420.

Figure 16:
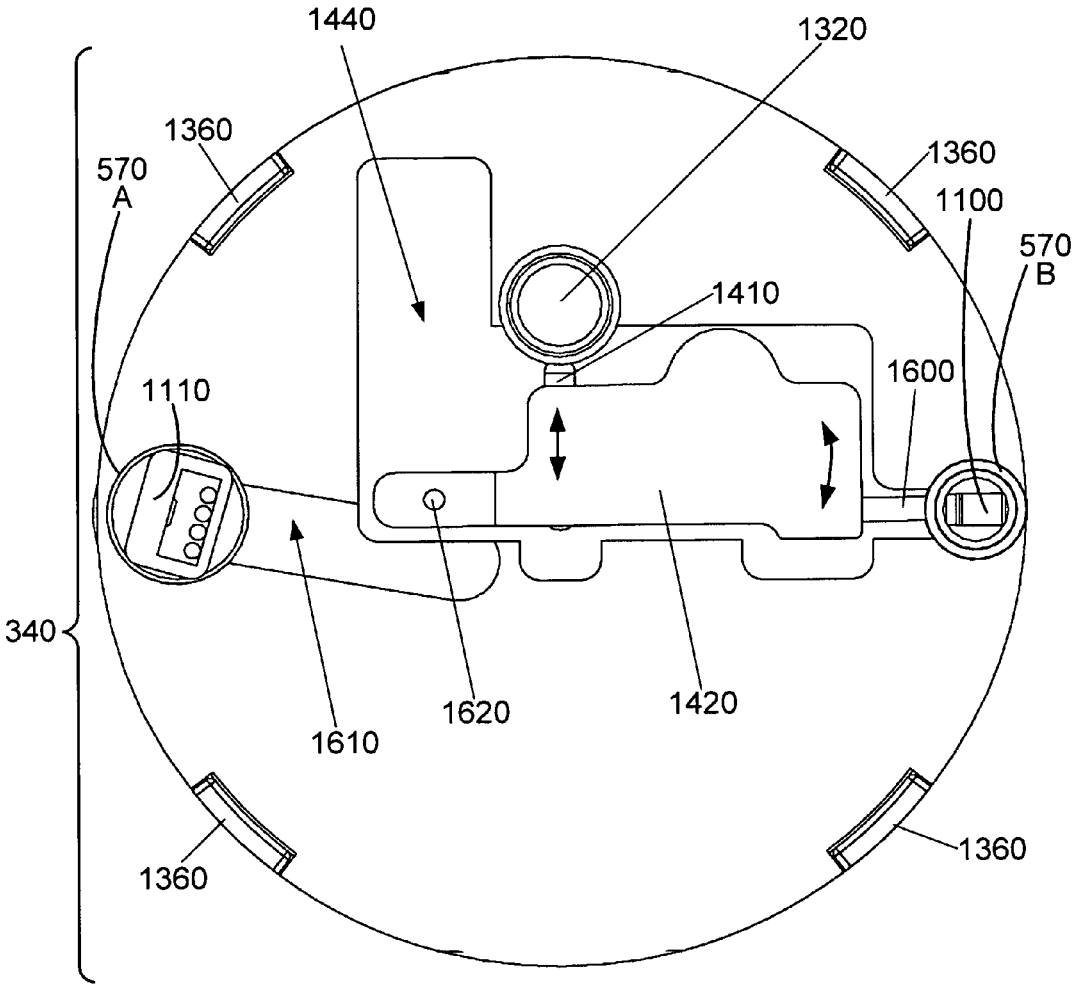
FIG. 16 illustrates an interior view of parts of a stored material module cap.

FIG. 16 shows the interior structures of a stored material module cap 340, such as illustrated in the preceding Figures, with attached stabilizer units 570 A, 570 B. The interior structures of the stored material module cap 340 are configured to transmit force across the stored material module cap 340 in response to the surface of a central stabilizer 350 coming into contact with the surface of the stored material module cap 340. In the view shown in FIG. 16, a stored material module cap 340 is illustrated in a top-down cross-section view, which is substantially perpendicular to the view illustrated in FIG. 15.

FIG. 16 shows a stored material module cap 340 including apertures 1360 with edges configured to reversibly mate with the surfaces of corresponding tabs 900 on an adjacent stored material unit 330. In the embodiment illustrated in FIG. 16, the center region of attached stabilizer unit 570 A includes circuitry 1110. The embodiment illustrated in FIG. 16 corresponds with the embodiment depicted in FIG. 11, although the view is rotated 180 degrees in FIG. 16 relative to FIG. 11. The stored material module cap 340 region adjacent to attached stabilizer unit 570 A may include a slot 1610 configured to provide space for additional circuitry or wiring (not illustrated in FIG. 16) connected to the circuitry 1110 in the center region of attached stabilizer unit 570 A. The center region of attached stabilizer unit 570 B includes a retaining unit 1100. The retaining unit 1100 is configured to transmit force to the end of a rod 1600 attached to the rotating plate 1420 in opposition to the force transmitted via the movement of the rotating plate 1420. In response to the motion of the shaft 1320 in a direction substantially perpendicular to the plane of the rotating plate 1420 (see FIGS. 14 and 15), force is transmitted from the shaft 1320 to the adjacent rod 1410 and, correspondingly, to the rotating plate 1420. This transmission of force results in the motion of the rotating plate 1420, as illustrated by the double arrows in FIG. 16. The movement of the rotating plate 1420 is limited by an attached rotation pin 1620, which is configured to restrict movement of the rotating plate 1420 along its plane, as illustrated by the double arrows in FIG. 16. The movement of the rotating plate 1420 is also restricted by the edges of the aperture 1440. In response to the motion of the rotating plate 1420, the end of the rod 1600 is moved relative to the stabilizer unit 570 B and retaining unit 1100. This results in the position of the stabilizer unit 570 B relative to the stored material module cap 340, as further illustrated in FIG. 17.

Figure 17:
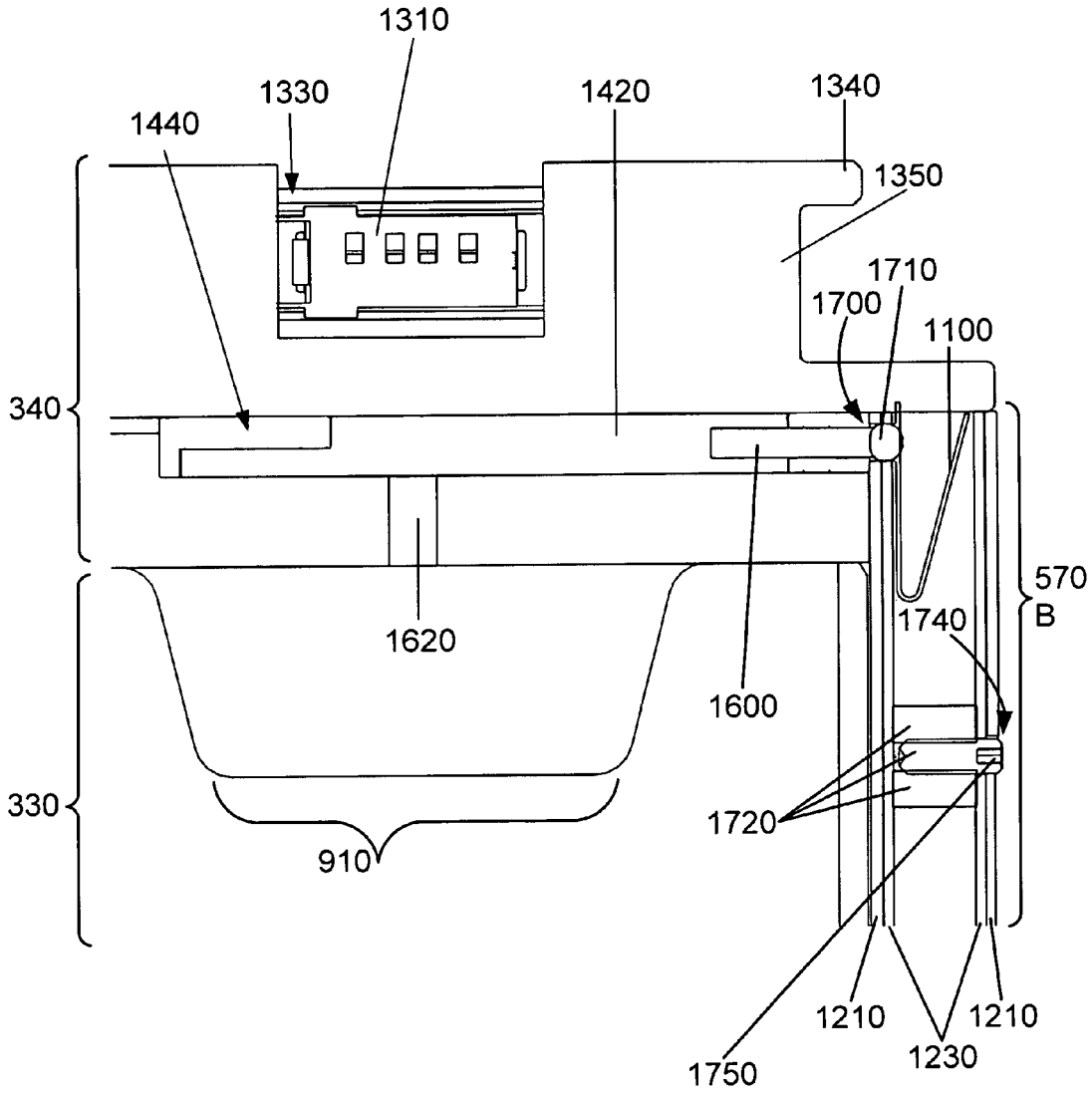
FIG. 17 depicts a partial cross-section of a stored material module cap attached to a stabilizer unit.

FIG. 17 depicts an embodiment of a stored material module cap 340 attached to a stored material unit 330 and an associated stabilizer unit 570 B. A gap 910 in the side of the stored material unit 330 is visible in the embodiment illustrated in FIG. 17. The stored material module cap 340 includes a base region 1350 and a rim region 1340 configured to reversibly mate with the surface of a central stabilizer unit 350 (not depicted in FIG. 17). The stored material module cap 340 includes an aperture 1330 and a circuitry connector 1310 within the aperture 1330. Another aperture 1440 is located in the interior of the stored material module cap 340. The interior aperture 1440 is of a size and shape to accommodate the rotating plate 1420. The movement of the rotating plate 1420 is limited by an attached rotation pin 1620, which is configured to permit motion of the rotating plate 1420 in a substantially horizontal direction relative to FIG. 17. The movement of the rotating plate 1420 is also restricted by the edges of its associated aperture 1440. The rotating plate 1420 has an attached rod 1600.

In response to the motion of the rotating plate 1420, the rod tip 1710 moves through an aperture 1700 formed in the outer rod 1210 and the inner rod 1230 of the stabilizer unit 570 B. Both the outer rod 1210 and the inner rod 1230 include apertures of similar size and shape positioned to form the aperture 1700 in the stabilizer unit 570 B when the rods 1210, 1230 are in a specific relative position. In the embodiments illustrated, the rods 1210, 1230 form the aperture 1700 in the stabilizer unit 570 B when the stabilizer unit 570 B is in its shortest position, i.e. when the rods 1210, 1230 have maximum surface areas in contact. The position of the rod tip 1710 within the aperture 1700 is limited by pressure from the surface of the retaining unit 1100. In the configuration illustrated in FIG. 17, the stabilizer unit 570 B is in a restrained position relative to the stored material module cap 340. In the position illustrated in FIG. 17, the position of the rod tip 1710 within the aperture 1700 prevents the relative movement of the outer rod 1210 and the inner rod 1230. The position of the rod tip 1710 within the aperture 1700 prevents the telescoping extension of the stabilizer unit 570 B.

As can be envisioned from the combination of the above Figures as well as associated text, the embodiment illustrated is operated as follows. Physical pressure of a central stabilizer 350 depresses the end of a shaft 1320 positioned within the stored material module cap 340. The shaft 1320 includes regions of varying diameters, or widths, which provide varying degrees of force against a rod 1410 attached to a rotating plate 1420 within an internal aperture 1440 in the stored material module cap 340. The rotating plate has a second rod 1600 attached, and the rod tip 1710 of the second rod 1600 is positioned to reversibly fit within an aperture 1700 formed in both the outer rod 1210 and the inner rod 1230 of a stabilizer unit 570 B. A retaining unit 1100 located within the inner rod 1230 prevents the rod tip 1710 from substantially entering the interior of the inner rod 1230. The position of the rod tip 1710 within the aperture 1700 prevents the extension of stabilizer unit 570 B by blocking the relative movement of the inner surface of the outer rod 1210 and the outer surface of the inner rod 1230. As also can be envisioned from the Figures and associated text, the removal of the central stabilizer 350 from an adjacent stored material module cap 340 allows the spring 1450 operably attached to the shaft 1320 to extend the surface of the shaft 1320 above the surface of the stored material module cap 340. This brings a region of the shaft 1320 with a relatively small width 1510 into contact with the surface of a rod 1410 attached to a rotating plate 1420. The rotating plate 1420 then moves so that the rod tip 1710 of a second attached rod 1600 is no longer within the aperture 1700 in the stabilizer unit 570 B. In the absence of the rod tip 1710 of a second attached rod 1600 being within the aperture 1700 in the stabilizer unit 570 B, the outer rod 1210 and the inner rod 1230 of the stabilizer unit 570 B may slide relative to each other, creating a telescoping stabilizer unit 570 B. This mechanism results in the stabilizer unit 570 B held in a fixed position relative to the stored material module cap 340. Although other embodiments may be envisioned by one of skill in the art, the function of the herein-described mechanism operates to retain the position and relative length of a stabilizer unit in relation to a stored material module cap when the apparatus is configured to store material.

Also as illustrated in FIG. 17, one or more stabilizer units 570 A, 570 B may include internal retaining units 1720 which establish limits on the relative position of the outer rod 1210 and the inner rod 1230 of a stabilizer unit 570 A, 570 B. As illustrated in FIG. 17, the inner rod 1230 of a stabilizer unit 570 B includes a retaining unit 1720 attached to the interior surface of the inner rod 1230. The retaining unit 1720 includes a projection 1750 configured to fit within a slit-like aperture (not visible in FIG. 17) in both the outer rod 1210 and the inner rod 1230. The length of the slit-like aperture in both the outer rod 1210 and the inner rod 1230 establishes the maximum and minimum distance that the inner rod can move relative to the outer rod before the projection 1750 at the end of the slit-like aperture prevents further relative movement of the rods 1210, 1230. Further aspects of internal retaining units 1720 are illustrated in the following Figures, particular FIGS. 21-25.

Figure 18:
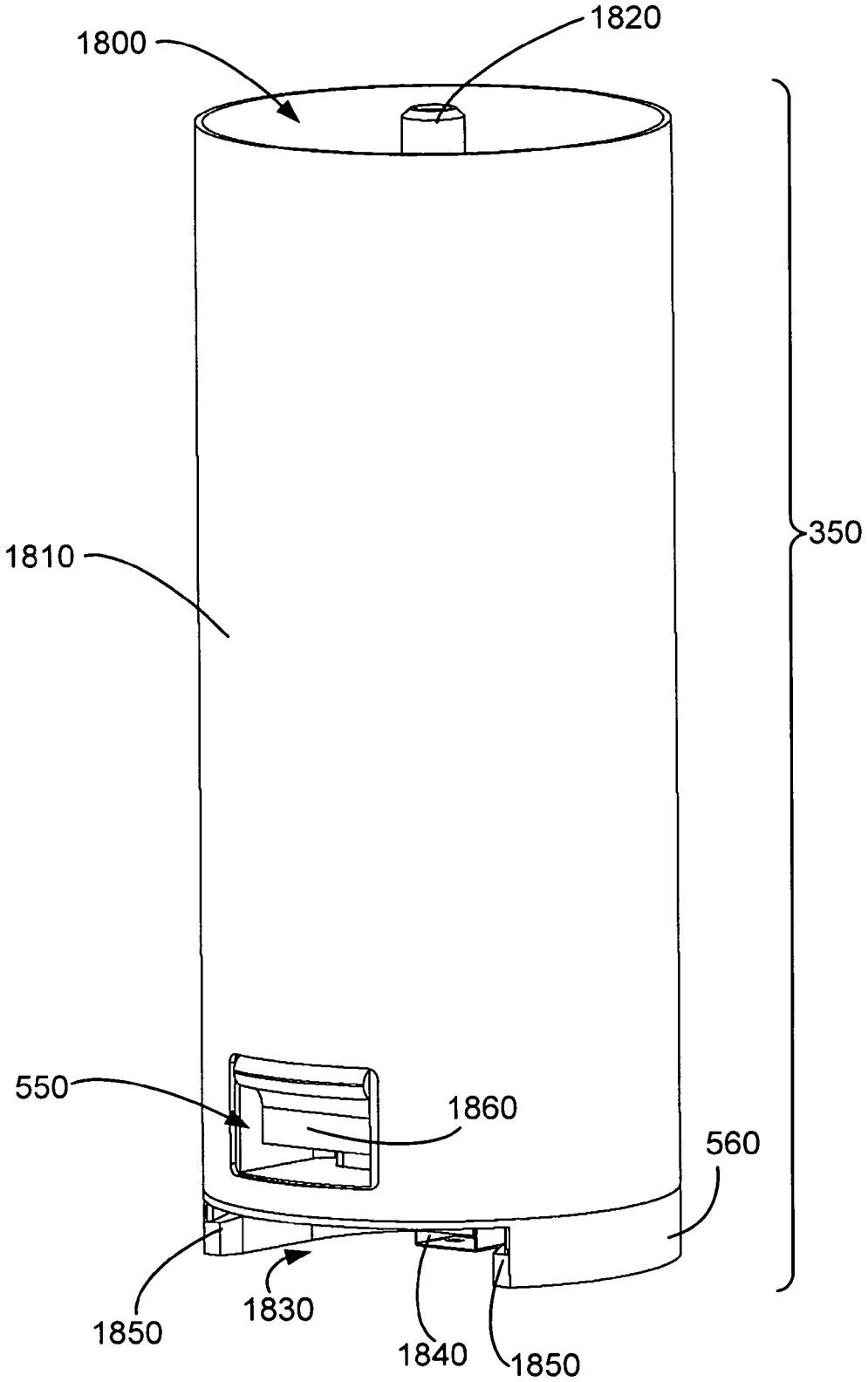
FIG. 18 shows a central stabilizer unit.

FIG. 18 illustrates aspects of a central stabilizer unit 350. A central stabilizer unit 350 includes a base region 560, with a surface configured to reversibly mate with a corresponding surface of a stored material module cap 340 (not shown in FIG. 18). The base region 560 includes one or more flanges 1850 configured, to reversibly mate with the corresponding surface of a stored material module cap 340 and hold the central stabilizer unit 350 and the stored material module cap 340 in a stable position relative to one another. As illustrated herein, the one or more flanges 1850 are configured to reversibly mate with the rim 1340 and the base 1350 of the attachment region 370 in a stored material module cap 340. The base region 560 includes an aperture 1830 configured to accommodate the attachment region 370 in a stored material module cap 340. The base region 560 may include a circuitry connector 1840 of a type to mate with the corresponding circuitry connector 1310 in an attachment region 370 in a stored material module cap 340. For example, as illustrated herein the circuitry connector 1840 is a USB connector, however other types of connectors may be utilized depending on the embodiment. The circuitry connector 1840 is attached to the base region 560 at a position within the aperture 1830 to reversibly mate with the corresponding circuitry connector 1310 in an attachment region 370 in a stored material module cap 340. The stable positioning of the central stabilizer unit 350 and the stored material module cap 340 (not shown in FIG. 18) mates the respective circuitry connectors 1310, 1840.

Also as illustrated in FIG. 18, the central stabilizer unit 350 includes an exterior wall 1810. The exterior wall 1810 may be fabricated from a material with sufficient durability and strength for the embodiment. The material used to fabricate the exterior wall 1810 should also have low thermal conduction. For example, some types of rigid plastics, or glass-impregnated plastics, are suitable materials for an exterior wall 1810 of a central stabilizer unit 350. The outer surface dimensions of a central stabilizer unit 350 are of a size and shape to fit within a connector 115. A central stabilizer unit 350 such as described herein should be of a size and shape to substantially fill the interior space of a conduit 125 in a substantially thermally sealed container 100 during use. The central stabilizer unit 350 includes an interior region 1800 as defined by the inner surface of the exterior wall 1810 of the central stabilizer unit 350. The interior region 1800 may be substantially filled with a low density, low thermal conduction material, such as low density plastic foam. Although not illustrated in FIG. 18, in some embodiments circuitry connectors and/or circuitry may be within the interior region 1800. For example, there may be one or more wire connections in the interior region 1800 connecting circuitry units across the central stabilizer 350. For example, wires may be located in the interior region 1800 connecting the circuitry connector 1840 to a display unit (e.g. 520 of FIG. 5) on the exterior of the container 100, or on a lid 500 (see FIGS. 5-8). The central stabilizer unit 350 may include an interior stabilizer 1820. An interior stabilizer 1820 may be included as necessary in some embodiments to further reinforce and stabilize the structure of the central stabilizer unit 350. In the embodiment illustrated in FIG. 18, the interior stabilizer 1820 is a hollow tube made of a material of suitable rigidity and low thermal conductivity, for example a rigid plastic material. Although not shown in FIG. 18, the interior stabilizer 1820 may also be attached to a lid 500 (see FIGS. 5-8).

As illustrated in FIG. 18, the central stabilizer unit 350 also includes an aperture 550 in the exterior wall 1810. The aperture 550 may include a fastener release handle 1860, configured to control a fastener within the central stabilizer unit 350. The fastener may be configured to stabilize the reversible attachment of the central stabilizer unit 350 to a stored material module cap 340.

Figure 19:
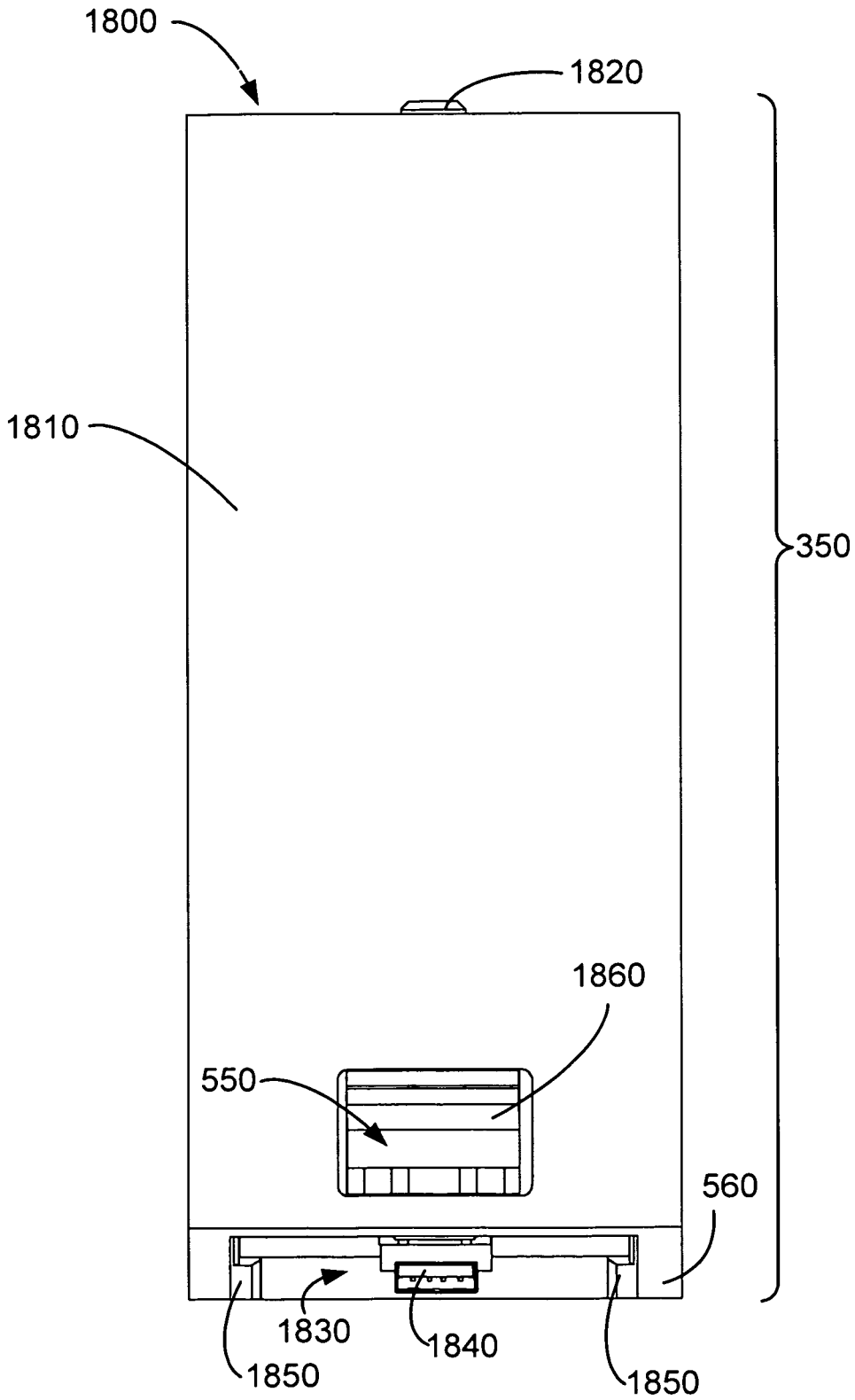
FIG. 19 illustrates a central stabilizer unit such as that shown in FIG. 18.

FIG. 19 illustrates an exterior view of a central stabilizer unit 350. The view presented in FIG. 19 is similar to the view presented in FIG. 18, only at a different angle to present aspects of the features of the central stabilizer unit 350. As illustrated in FIG. 19, the exterior of a central stabilizer unit 350 is depicted in a horizontal view. The central stabilizer unit 350 shown includes an exterior wall 1810. The internal surface of the exterior wall 1810 substantially defines an interior region 1800. An interior stabilizer 1820 is located within the interior region 1800. As illustrated, the end of the interior stabilizer 1820 is positioned above the edge of the exterior wall 1810. This positioning may be helpful, for example, to attach a lid 500 (see FIGS. 5-8) to the central stabilizer unit 350. FIG. 19 also illustrates an aperture 550 in the exterior wall 1810, and a fastener release handle 1860 located within the aperture 550.

The lower end of the central stabilizer unit 350, or the end configured to be inserted into a conduit of a substantially thermally stable container 100, includes a base region 560. The base region 560 is configured with surfaces of a size and shape to reversibly mate with corresponding surfaces on a stored material module cap 340 (not shown in FIG. 19). The base region 560 includes one or more flanges 1850 configured to reversibly mate with the corresponding surface of a stored material module cap 340 and hold the central stabilizer unit 350 and the stored material module cap 340 in a stable position relative to one another. The base region 560 includes an aperture 1830 configured to accommodate a connection region 370 of a stored material module cap 340. The base region also includes a circuitry connector 1840.

Figure 20:
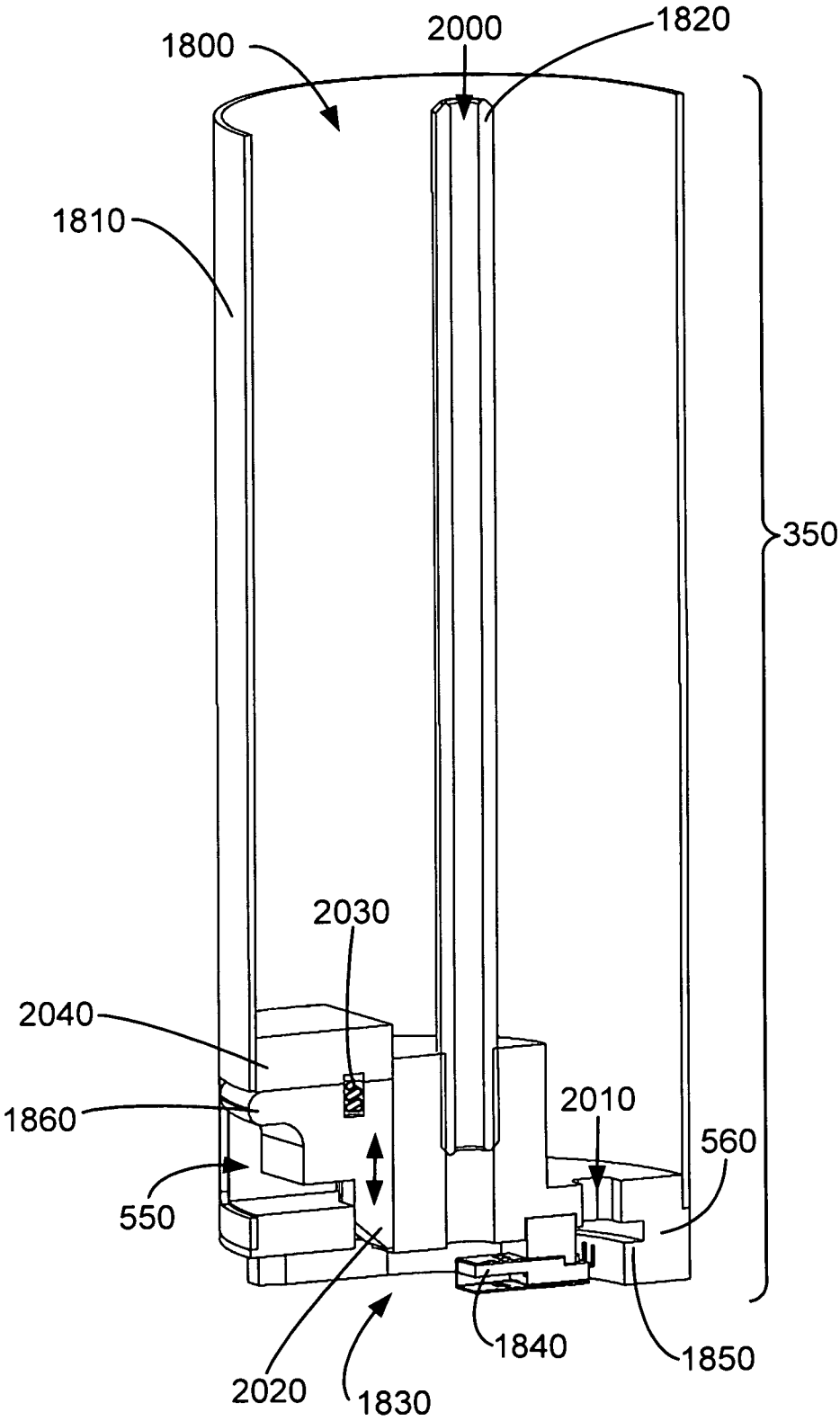
FIG. 20 depicts, in cross-section, a central stabilizer unit.

FIG. 20 illustrates a cross-section view of a central stabilizer unit 350 such as those depicted in FIGS. 18 and 19. The central stabilizer unit 350 includes an exterior wall 1810 and an interior region 1800. An interior stabilizer 1820 is located within the interior region 1800. One end of the interior stabilizer 1820 is attached to the base region 560 of the central stabilizer unit 350, and the other end projects beyond the edge of the exterior wall 1810. The interior stabilizer 1920 may be hollow and include an interior region 2000 configured to accommodate circuitry and circuitry connectors, such as wires. The base region 560 may also include at least one aperture 2010 configured to accommodate circuitry and circuitry connectors, such as wires. The lower region of the base region 560 includes a flange 1850 with a surface configured to reversibly mate with a corresponding surface of a stored material unit cap 340 (not shown). An aperture 1830 in the lower portion of the base region 560 is configured to accommodate a stored material unit cap 340 (not shown). A circuitry connector 1840 is positioned to reversibly mate with a corresponding circuitry connector (e.g. 1310, not shown in FIG. 20) on a stored material unit cap 340.

FIG. 20 illustrates that a central stabilizer unit 350 may include an aperture 550 in the exterior wall 1810. The aperture 550 allows for user access to a fastener release handle 1860 located within the aperture 550. For example, a user may insert one or more fingers into the aperture 550 to operate the fastener release handle 1860. The fastener release handle is connected to a fastener 2020. The fastener 2020 is configured to reversibly provide tension on the surface of an adjacent stored material unit cap 340 (not shown), such as on a surface of a connection region 370 and/or the end of a shaft 1320. As illustrated in FIG. 20, a fastener 2020 is adjacent to a fastener stabilizer 2040. The fastener stabilizer 2040 is attached to the internal surface of the exterior wall 1810. A spring 2030 positioned between the adjacent surfaces of the fastener 2020 and the fastener stabilizer 2040 provides force on the fastener surface in a direction away from the adjacent surface of the fastener stabilizer 2040. In the view shown in FIG. 20, the force provided by the spring 2030 is in a substantially vertical, or downward, position. The fastener 2020 is thereby moved in contact with the surface of an adjacent stored material unit cap 340 (not shown). The fastener 2020 may be configured to depress a shaft 1320 and thereby to retain the position and relative length of a stabilizer unit 570 in relation to a stored material module cap 340 (not depicted in FIG. 20). The fastener 2020 may be configured to provide tension on the surface of an adjacent stored material unit cap 340 and thereby stabilize the relative positions of the central stabilizer unit 350 and the adjacent stored material unit cap 340. A user of the apparatus may put pressure (i.e. from a finger) on the fastener release handle 1860 to reverse the movement of the fastener 2020 relative to the adjacent stored material unit cap 340 surface, releasing the associated tension and decoupling the fastener 2020 from the adjacent stored material unit cap 340 surface. In some embodiments, decoupling the fastener 2020 from the adjacent stored material unit cap 340 surface will also release the previously-stabilized relative positions of the central stabilizer unit 350 and the adjacent stored material unit cap 340 (see above Figures and text).

Figure 21:
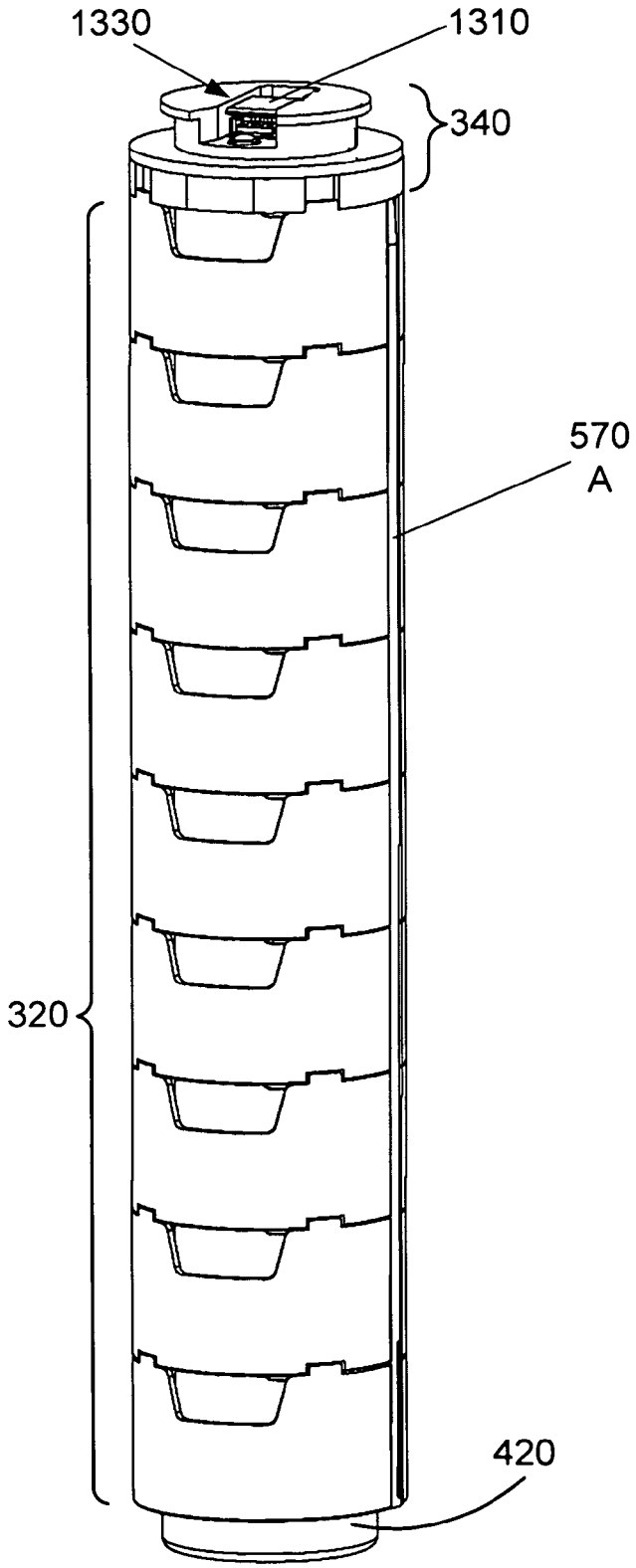
FIG. 21 shows a stored material module, a stored material module cap and a stabilizer unit.

FIG. 21 illustrates aspects of a stored material module 320 in association with a stored material module cap 340. The assembled apparatus shown in FIG. 21 depicts the relative positioning and association of the stored material module 320 and its base 420 in relation to an attached stored material module cap 340. The stored material module cap 340 includes an aperture 1330 on a surface distal to the surface attached to the stored material module cap 340. The aperture 1330 includes a circuitry connector 1310. The assembly also includes a stabilizer unit 570 A in association with both the stored material module cap 340 and the stored material module 320.

Figure 22:
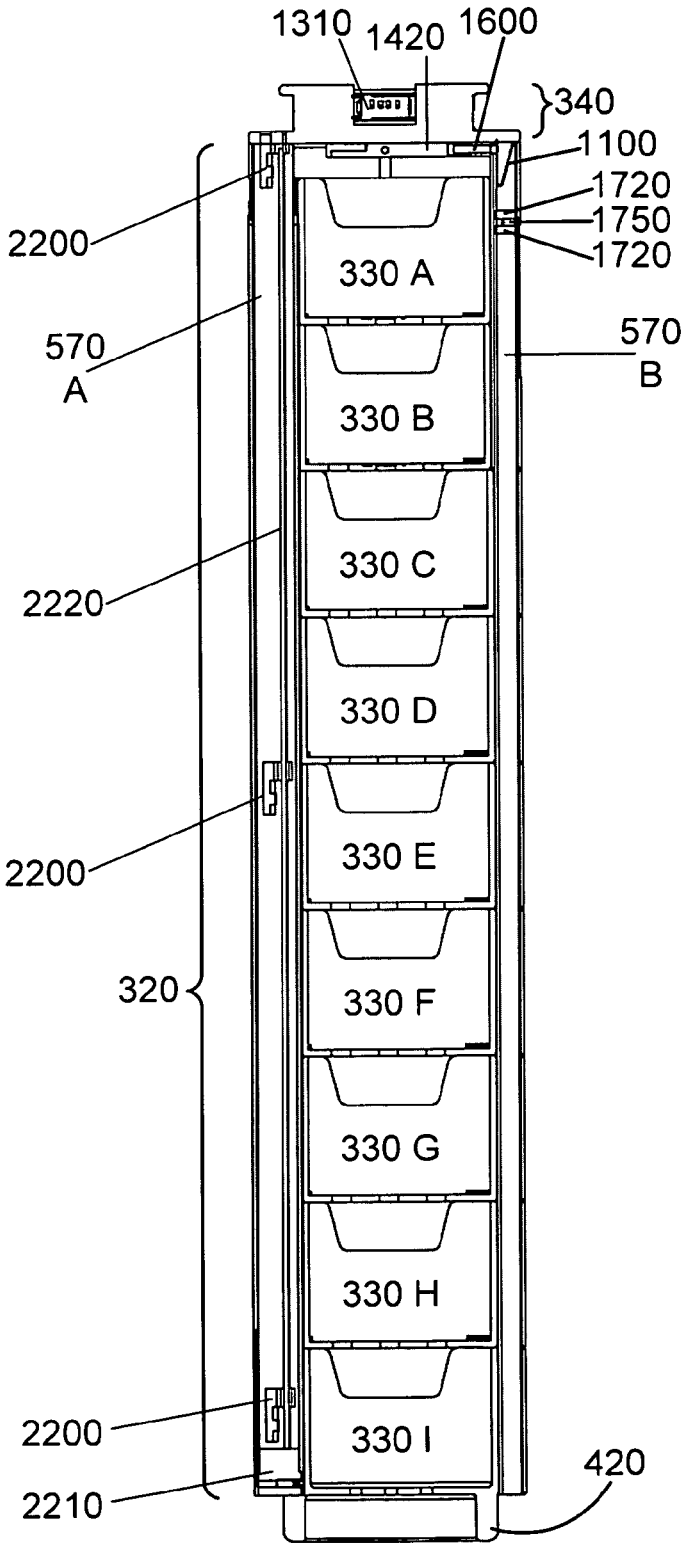
FIG. 22 illustrates, in cross-section, a stored material module, a stored material module cap and a stabilizer unit such as those shown in FIG. 21.

FIG. 22 depicts an internal cross-section view of the apparatus of FIG. 21. FIG. 22 illustrates aspects of a stored material module 320 in association with a stored material module cap 340 and two stabilizer units 570 A, 570 B. The stored material module 320 includes a base 420. The stored material module 320 includes a plurality of stored material units, 330 A-330 I, positioned in a vertical array. Although the plurality of stored material units, 330 A-330 I, depicted in FIG. 22 are of substantially similar heights relative to the vertical array of the stored material module 320, some embodiments may include stored material units of different heights but substantially similar widths or diameters. The apparatus includes a stored material module cap 340 affixed to the top of the stored material module 320 at the upper edge of stored material unit 330 A. The stored material module cap 340 is attached to the top of the upper edge of the side wall of stored material unit 330 A at the top of the column of stored material units, 330 A-330 I. The stored material module cap 340 includes a circuitry connector 1310. The stored material module cap 340 includes a rotating plate 1420 and an attached rod 1600. As illustrated in FIG. 22, the rod 1600 is in contact with a retaining unit 1100 and is in a configuration to prevent the relative movement of the outer rod and the inner rod of the stabilizer unit 570 B. A retaining unit 1720 within the inner rod of the stabilizer unit 570 B and its associated projection 1750 are fixed at a set position within the inner rod. The stabilizer unit 570 A positioned at the opposing side of the apparatus includes a retaining unit 2210 with a projection (not visible) attached at a location within the inner rod of the stabilizer unit 570 A. The projection (not visible) attached within stabilizer unit 570 A provides a maximum and minimum limit for the relative motion of the tubes within stabilizer unit 570 A, as depicted in subsequent Figures.

Also located within the inner rod of stabilizer unit 570 A are a series of sensors 2200 fixed to the interior surface of the inner rod. In some embodiments, sensors may be attached to one or more stabilizer units (e.g. 570 A and 570 B), including on an interior surface of a stabilizer unit. In some embodiments, sensors may be attached to other regions of the container. The sensors 2200 may be located as desired in a particular embodiment. For example, the sensors 2200 depicted in FIG. 22 are positioned to be at approximately the top, center and bottom regions of a storage region 130 of a substantially thermally sealed container 100 when the apparatus is in use within the container 100. In some embodiments, the one or more sensors includes at least one temperature sensor. In some embodiments, at least one sensor may include a temperature sensor, such as, for example, chemical sensors, thermometers, bimetallic strips, or thermocouples. In some embodiments, the one or more sensors includes at least one sensor of a gaseous pressure within one or more of the at least one storage region, sensor of a mass within one or more of the at least one storage region, sensor of a stored volume within one or more of the at least one storage region, sensor of a temperature within one or more of the at least one storage region, or sensor of an identity of an item within one or more of the at least one storage region.

A substantially thermally sealed container 100 and associated apparatus may include a sensor network. One or more sensors attached to a stored material module, a stored material module cap and/or a stabilizer unit may function as part of the network. FIG. 22 depicts a circuitry link 2220, such as a wire link, connecting the sensors 2200. The circuitry link 2220 may also be connected to a circuitry connector 1310. Data from the sensors 2200 may be transmitted via the circuitry link 2220 to the exterior of the container 100, for example to a display 520 attached to a lid 500. A sensor network operably attached to the at least one substantially thermally sealed container may include one or more sensors such as a physical sensor component such as described in U.S. Pat. No. 6,453,749 to Petrovic et al., titled "Physical sensor component," which is herein incorporated by reference. A sensor network operably attached to the at least one substantially thermally sealed container may include one or more sensors such as a pressure sensor such as described in U.S. Pat. No. 5,900,554 to Baba et al., titled "Pressure sensor," which is herein incorporated by reference. A sensor network operably attached to the at least one substantially thermally sealed container may include one or more sensors such as a vertically integrated sensor structure such as described in U.S. Pat. No. 5,600,071 to Sooriakumar et al., titled "Vertically integrated sensor structure and method," which is herein incorporated by reference. A sensor network operably attached to the at least one substantially thermally sealed container may include one or more sensors such as a system for determining a quantity of liquid or fluid within a container, such as described in U.S. Pat. No. 5,138,559 to Kuehl et al., titled "System and method for measuring liquid mass quantity," U.S. Pat. No. 6,050,598 to Upton, titled "Apparatus for and method of monitoring the mass quantity and density of a fluid in a closed container, and a vehicular air bag system incorporating such apparatus," and U.S. Pat. No. 5,245,869 to Clarke et al., titled "High accuracy mass sensor for monitoring fluid quantity in storage tanks," which are each herein incorporated by reference. A sensor network operably attached to the at least one substantially thermally sealed container may include one or more sensors of radio frequency identification ("RFID") tags to identify material within the at least one substantially thermally sealed storage region. RFID tags are well known in the art, for example in U.S. Pat. No. 5,444,223 to Blama, titled "Radio frequency identification tag and method," which is herein incorporated by reference.

Figure 23:
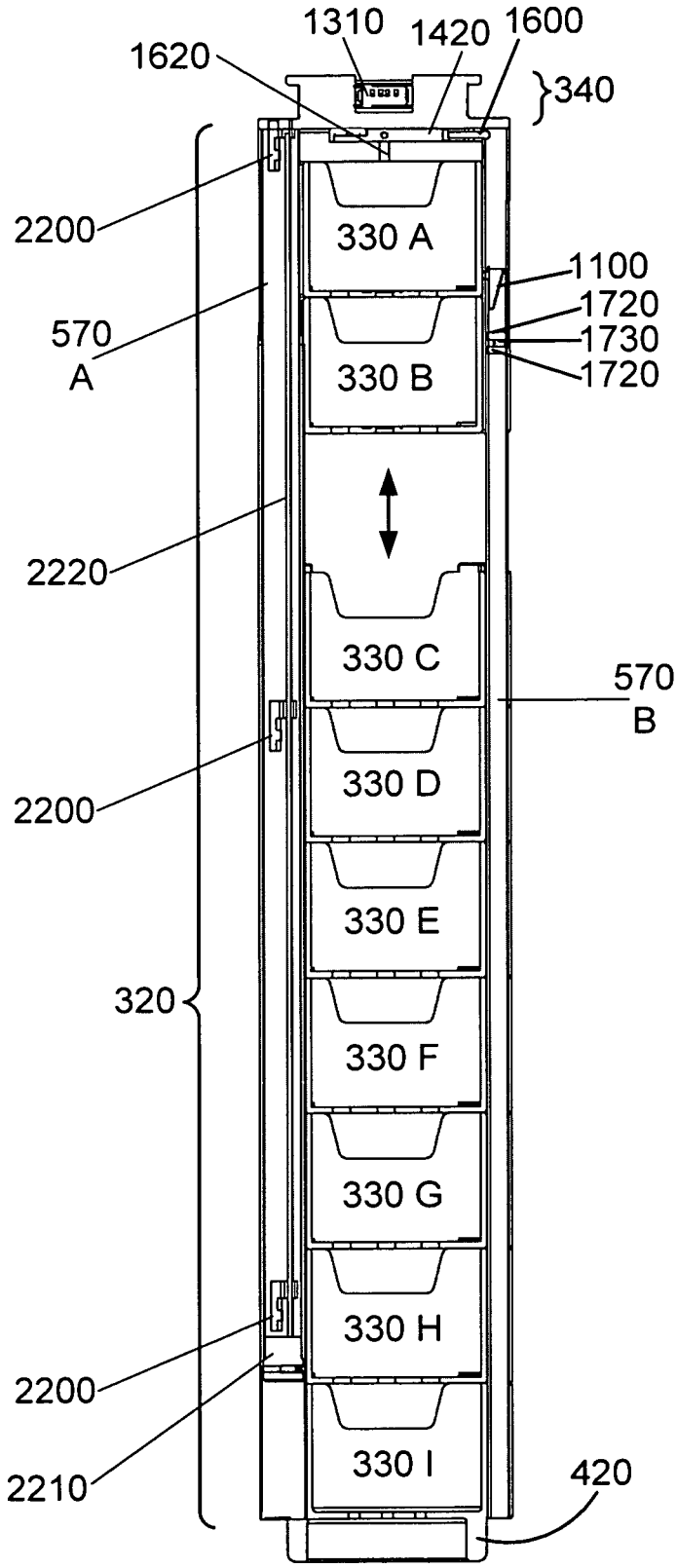
FIG. 23 depicts, in cross-section, a stored material module, a stored material module cap and a stabilizer unit such as those illustrated in FIG. 22, with two of the storage units positioned to allow access to the interior of a third storage unit within the stored material module.

FIG. 23 depicts an apparatus and view similar to that shown in FIG. 22. FIG. 23 illustrates aspects of a stored material module 320 in association with a stored material module cap 340 and two stabilizer units 570 A and 570 B when the apparatus is in a configuration to allow the relative movement of the outer rod and the inner rod of the stabilizer units 570 A and 570 B. The stored material module 320 includes a base 420. The stored material module 320 includes a plurality of stored material units, 330 A-330 I, positioned in a vertical array. In the configuration illustrated in FIG. 23, the outer rod and the inner rod of the stabilizer units 570 A and 570 B are in an "unlocked" configuration, or allowed to slide relative to each other. This allows the individual stored material units 330 A-330I of the stored material module 320 to be moved vertically, or along the axis of the stabilizer units 570 A and 570 B. An individual using the apparatus may move one or more of the individual stored material units 330 A-330I to access material stored within the individual stored material units 330 A-330I. For example, as illustrated in FIG. 23, stored material units 330 A and 330 B have been positioned at the top of the stabilizer units 570 A and 570 B with a space between the lower face of stored material unit 330 B and the upper face of the adjacent stored material unit 330 C. This space would allow a user of the system to access material stored within stored material unit 330 C. The apparatus includes a stored material module cap 340 affixed to the top of the stored material module 320 at the upper edge of stored material unit 330 A. The stored material module cap 340 is attached to the top of the upper edge of the side wall of stored material unit 330 A at the top of the column of stored material units, 330 A-330 I. The stored material module cap 340 includes a circuitry connector 1310. The stored material module cap 340 includes a rotating plate 1420 and an attached rod 1600. As illustrated in FIG. 23, the rod 1600 is not in contact with a retaining unit 1100 and is in a configuration to permit the relative movement of the outer rod and the inner rod of the stabilizer unit 570 B. A retaining unit 1720 within the inner rod of the stabilizer unit 570 B and its associated projection 1750 are fixed at a set position within the inner rod. The stabilizer unit 570 A positioned at the opposing side of the apparatus includes a retaining unit 2210 with a projection (not visible) attached at a location within the inner rod of the stabilizer unit 570 A. The projection (not visible) attached within stabilizer unit 570 A provides a maximum and minimum limit for the relative motion of the tubes within stabilizer unit 570 A, as depicted in subsequent Figures. The sensors 2200 and the circuitry link 2220 located within stabilizer unit 570 A are located at fixed positions relative to the interior surface of the inner tube 1200 of stabilizer unit 570 A and the retaining unit 2210.

Figure 24:
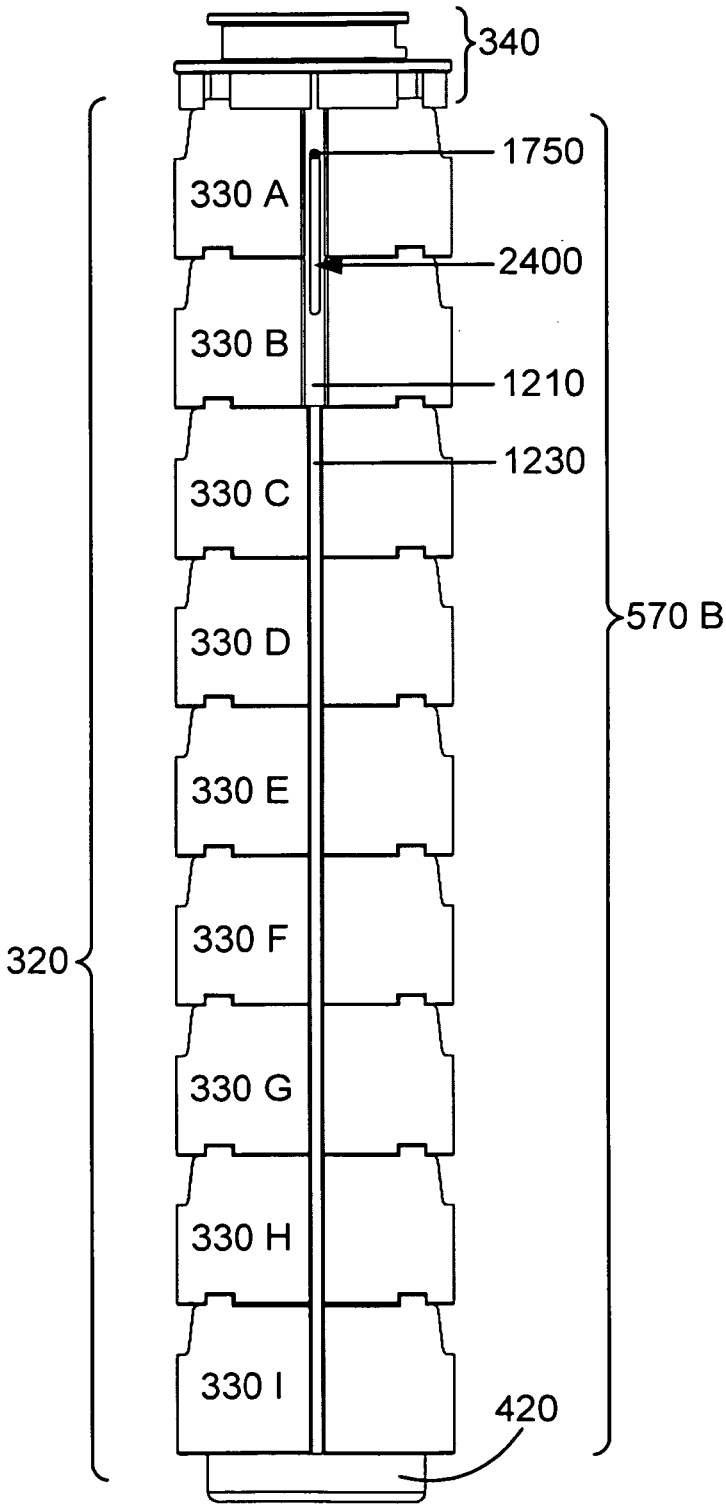
FIG. 24 shows a stored material module, a stored material module cap and a stabilizer unit.

FIG. 24 illustrates an exterior side view of an apparatus such as those depicted in FIGS. 21-23. The apparatus includes a stored material module cap 340, a stored material module 320 and a stabilizer unit 570 B. In the configuration depicted in FIG. 24, the stored material module 320 is in a "closed" position, with minimal spaces between the stored material units 330 A-330 I. The stored material module 320 also includes a base 420. The apparatus includes a stabilizer unit 570 B positioned along the side of the stored material module 320, with the axis of the stabilizer unit 570 B substantially parallel with the axis of the stored material module 320. The stabilizer unit 570 B includes an outer tube 1210 and an inner tube 1230, which are shaped and positioned to slide in a telescoping fashion relative to each other. The outer tube 1210 includes a slit-like aperture 2400 positioned along the length of the outer edge of the outer tube 1210. The inner tube 1230 includes a projection 1750 of a size and shape to fit within the aperture 2400. The projection 1750 is attached to a retaining unit 1720 (see, e.g. FIG. 17) not depicted in FIG. 24. The retaining unit 1720 is attached at a fixed position relative to the inner tube 1230. The configuration of aperture 2400 and projection 1750 creates a minimum and maximum distance for the relative slide positioning of the outer tube 1210 relative to the inner tube 1230.

Figure 25:
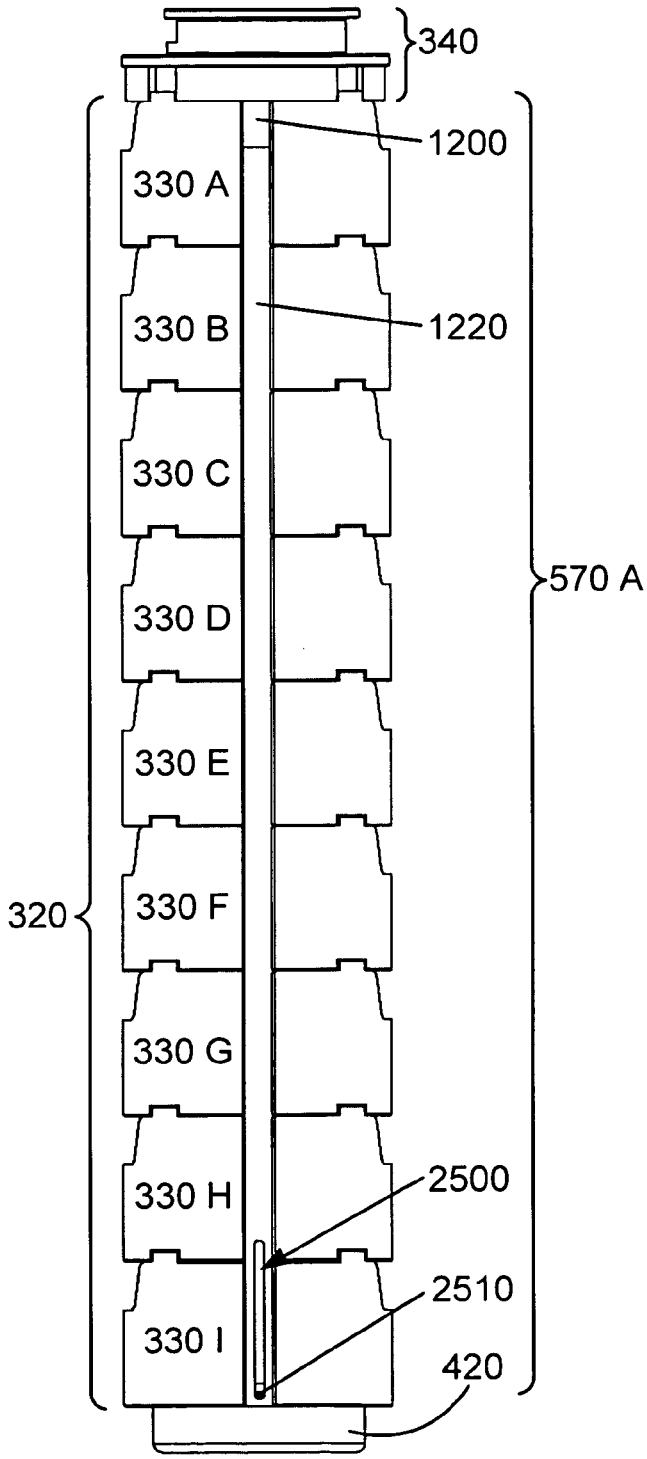
FIG. 25 illustrates a stored material module, a stored material module cap and a stabilizer unit.

FIG. 25 illustrates an exterior side view of an apparatus such as those depicted in FIGS. 21-24. The apparatus includes a stored material module cap 340, a stored material module 320 and a stabilizer unit 570 A. In the configuration depicted in FIG. 25, the stored material module 320 is in a "closed" position, with minimal spaces between the stored material units 330 A-330 I. The stored material module 320 also includes a base 420. The apparatus includes a stabilizer unit 570 A positioned along the side of the stored material module 320, with the axis of the stabilizer unit 570 A substantially parallel with the axis of the stored material module 320. The stabilizer unit 570 A includes an outer tube 1220 and an inner tube 1200, which are shaped and positioned to slide in a telescoping fashion relative to each other. The outer tube 1220 includes a slit-like aperture 2500 positioned along the length of the outer edge of the outer tube 1220. The inner tube 1200 includes a projection 2510 of a size and shape to fit within the aperture 2500. The projection 2510 is attached to a retaining unit 2210 (see, e.g. FIG. 22) not depicted in FIG. 25. The retaining unit 2210 is attached at a fixed position relative to the inner tube 1200. The configuration of aperture 2500 and projection 2510 creates a minimum and maximum distance for the relative positioning of the outer tube 1220 relative to the inner tube 1200.

Figure 26:
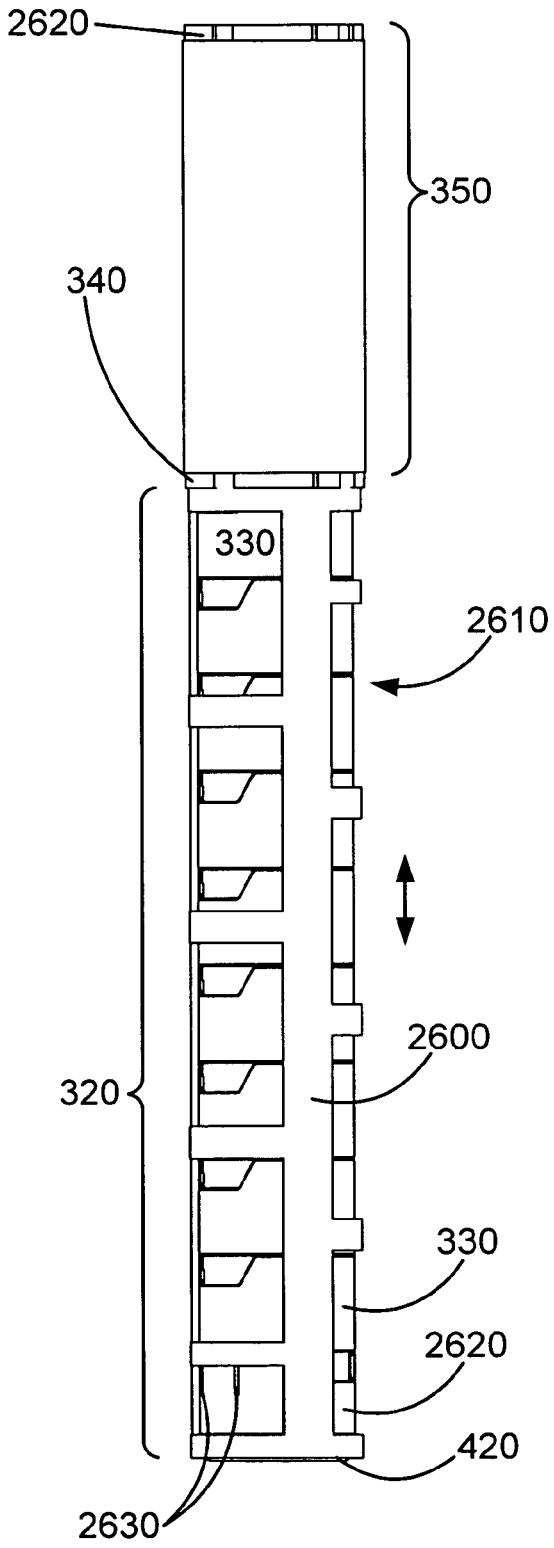
FIG. 26 depicts an embodiment of a central stabilizer, a stored material module, a stored material module cap and a stabilizer unit.

FIG. 26 depicts an embodiment of an apparatus. FIG. 26 shows an apparatus including a central stabilizer 350, a stored material module 320 and a stabilizer unit 2600. In this configuration, the apparatus is in a "closed" or "locked" position, with minimal open space surrounding the stored material within the stored material module. The stored material module 320 includes a cap 340 attached to the central stabilizer 350. The stored material module 320 includes a base stored material unit 2620, the base stored material unit 2620 including at least one aperture 2630. The base stored material unit 2620 is attached to the base 420 of the stored material module 320. The central stabilizer 350 includes a cap 2620 attached to the central stabilizer 350 at an opposing side of the central stabilizer 350 from the cap 340 of the stored material module 320. The stabilizer unit 2600 is configured as an exterior frame with an internal surface configured to mate with external surfaces of the stored material units 330 within the stored material module 320. The stabilizer unit is attached to the cap 340 of the stored material module 320. The stabilizer unit 2600 includes an exterior frame of a size and shape to substantially surround the stored material module 320, an inner surface of the external frame substantially conforming to an outer surface of the stored material module 320. The stabilizer unit 2600 includes a plurality of apertures 2610 in the external frame, the apertures 2610 formed along the axis of the stored material module 320, or substantially vertically as shown in FIG. 26. The stabilizer unit 2600 includes one or more protrusions from a surface of the exterior frame at a surface facing the stored material module 320, the protrusions corresponding to one or more edge surfaces of an aperture 2630 within a base stored material unit 2620. The protrusions form a surface of the exterior frame at a surface facing the stored material module 320 fit within the aperture 2630, limiting the relative movement of the stored material units 330 within the stored material module 320 relative to the exterior frame. In the embodiment illustrated in FIG. 26, the stored material units 330 within the stored material module 320 may slide relative to the axis formed by the external frame of the stabilizer unit 2600, or substantially vertically as illustrated in the Figure. The relative movement of the stored material module 320 to the external frame of the stabilizer unit 2600 is limited to the substantially vertical direction as defined by the aperture 2630.

Figure 27:
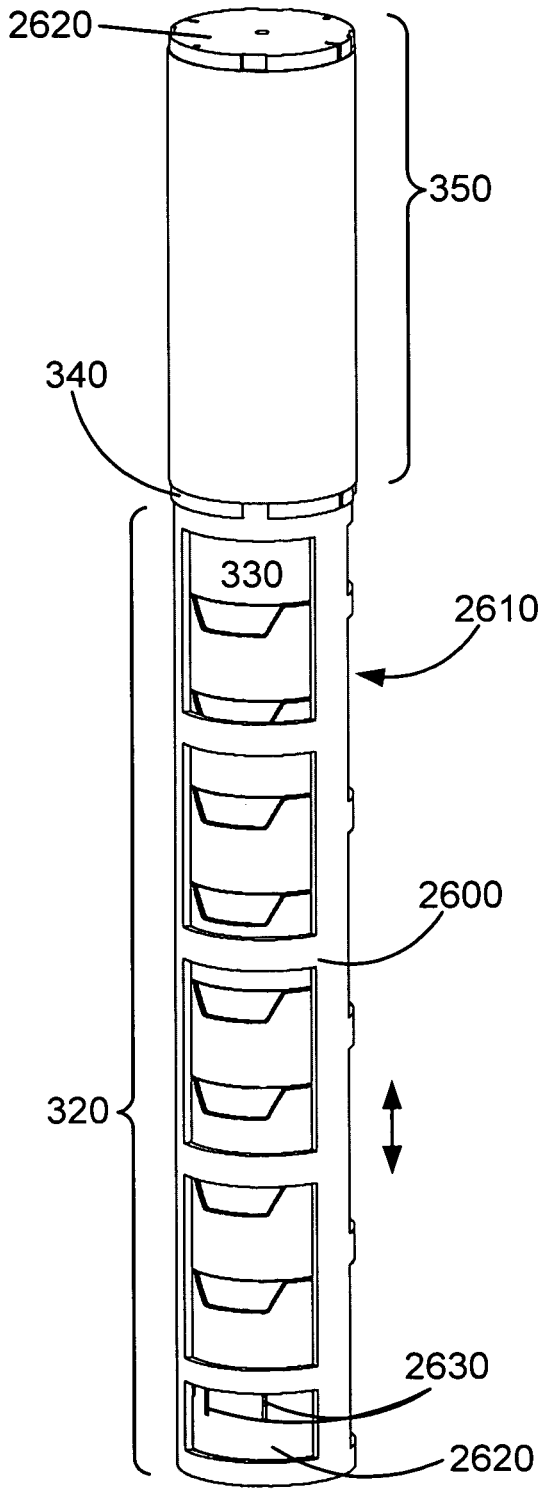
FIG. 27 shows aspects of an embodiment of a central stabilizer, a stored material module, a stored material module cap and a stabilizer unit such as depicted in FIG. 26.

FIG. 27 depicts an embodiment of an apparatus such as shown in FIG. 26. FIG. 27 shows an apparatus including a central stabilizer 350, a stored material module 320 and a stabilizer unit 2600. In this configuration, the apparatus is in a "closed" or "locked" position, with minimal access to the stored material within the stored material module. This position may be suitable for periods of storage. The stored material module 320 includes a cap 340 attached to the central stabilizer 350. The stored material module 320 includes a base stored material unit 2620, the base stored material unit 2620 including at least one aperture 2630. The central stabilizer 350 includes a cap 2620 attached to the central stabilizer 350 at an opposing side of the central stabilizer 350 from the cap 340 of the stored material module 320. The stabilizer unit 2600 is configured as an exterior frame with an internal surface configured to mate with external surfaces of the stored material units 330 within the stored material module 320. The stabilizer unit is attached to the cap 340 of the stored material module 320. The stabilizer unit 2600 includes an exterior frame of a size and shape to substantially surround the stored material module 320, an inner surface of the external frame substantially conforming to an outer surface of the stored material module 320. The stabilizer unit 2600 includes a plurality of apertures 2610 in the external frame. The stabilizer unit 2600 includes one or more protrusions from a surface of the exterior frame at a surface facing the stored material module 320, the protrusions corresponding to one or more edge surfaces of an aperture 2630 within a base stored material unit 2620. The protrusions form a surface of the exterior frame at a surface facing the stored material module 320 fit within the aperture 2630, limiting the relative movement of the stored material units 330 within the stored material module 320 relative to the exterior frame. In the embodiment illustrated in FIGS. 26 and 27, the stored material units 330 within the stored material module 320 may slide relative to the axis formed by the external frame of the stabilizer unit 2600, or substantially vertically as illustrated in the Figures. The relative movement of the stored material module 320 to the external frame of the stabilizer unit 2600 is limited, as defined by the position of the aperture 2630.

Figure 28:
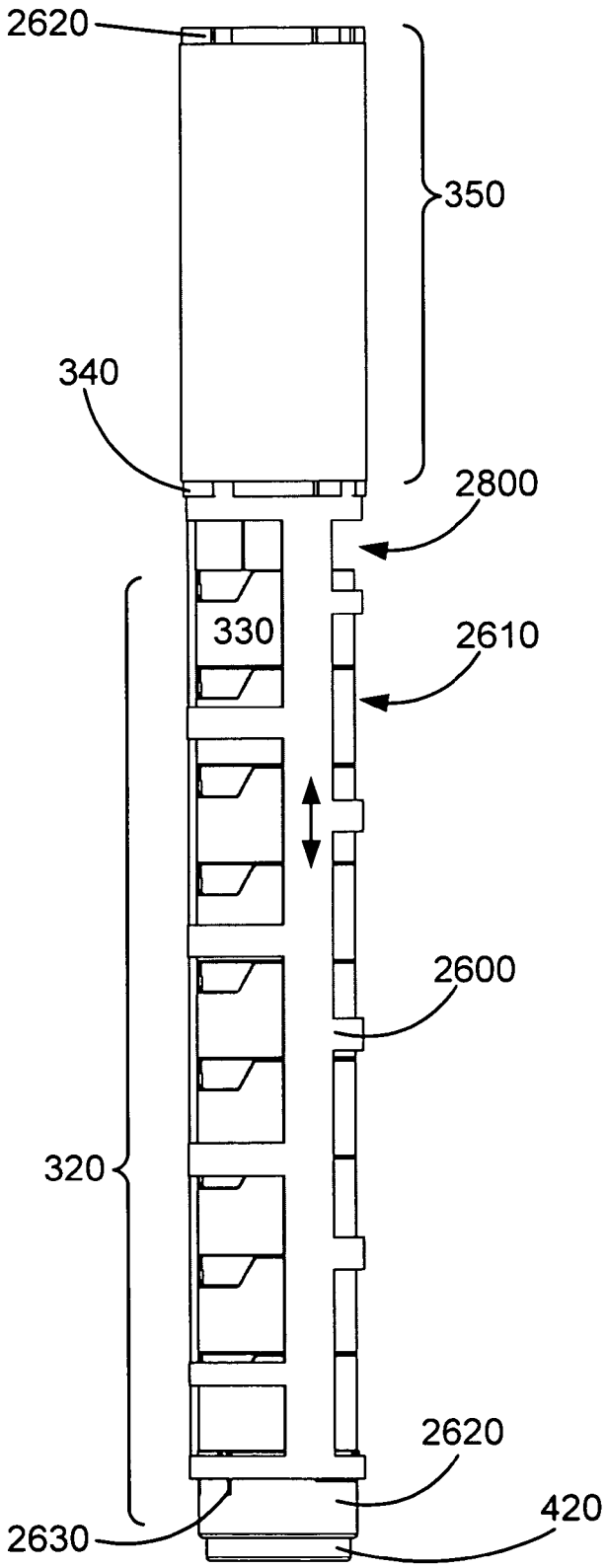
FIG. 28 illustrates an embodiment of a central stabilizer, a stored material module, a stored material module cap and a stabilizer unit, with the central stabilizer and the stabilizer unit positioned to allow access to a storage unit.

FIG. 28 depicts an embodiment of an apparatus such as illustrated in FIGS. 26 and 27. The view of FIG. 28 is similar to the view shown in FIG. 26. In the configuration shown in FIG. 28, the apparatus is in an "open" position to allow access to material stored in the stored material module 320. FIG. 28 shows an apparatus including a central stabilizer 350, a stored material module 320 and a stabilizer unit 2600. The stored material module 320 includes a cap 340 attached to the central stabilizer 350. The stored material module 320 includes a base stored material unit 2620, the base stored material unit 2620 including at least one aperture 2630. The base stored material unit 2620 is attached to the base 420 of the stored material module 320. The central stabilizer 350 includes a cap 2620 attached to the central stabilizer 350 at an opposing side of the central stabilizer 350 from the cap 340 of the stored material module 320. The stabilizer unit 2600 is configured as an exterior frame with an internal surface configured to mate with external surfaces of the stored material units 330 within the stored material module 320. The stabilizer unit is attached to the cap 340 of the stored material module 320. The stabilizer unit 2600 includes an exterior frame of a size and shape to substantially surround the stored material module 320, an inner surface of the external frame substantially conforming to an outer surface of the stored material module 320. The stabilizer unit 2600 includes a plurality of apertures 2610 in the external frame. The stabilizer unit 2600 includes one or more protrusions from a surface of the exterior frame at a surface facing the stored material module 320, the protrusions corresponding to one or more edge surfaces of an aperture 2630 within a base stored material unit 2620. The protrusions form a surface of the exterior frame at a surface facing the stored material module 320 fit within the aperture 2630, limiting the relative movement of the stored material units 330 within the stored material module 320 relative to the exterior frame. In the embodiment illustrated in FIG. 28, the stored material units 330 within the stored material module 320 have slid relative to the axis formed by the external frame of the stabilizer unit 2600, or substantially vertically as illustrated in the Figure. The relative movement of the stored material module 320 to the external frame of the stabilizer unit 2600 is limited, as defined by the direction and position of the aperture 2630. In FIG. 28, the relative movement of the stored material module 320 is sufficient to form an access region 2800. The access region 2800 would allow a user of the apparatus to access material stored in the stored material units within the stored material module 320. Although only the topmost stored material unit 330 is shown adjacent to the access region 2800, each of the stored material units within the stored material module 320 may slide relative to the external frame of the stabilizer unit 2600 to form access regions 2800 adjacent to each of the stored material units.

Figure 29:
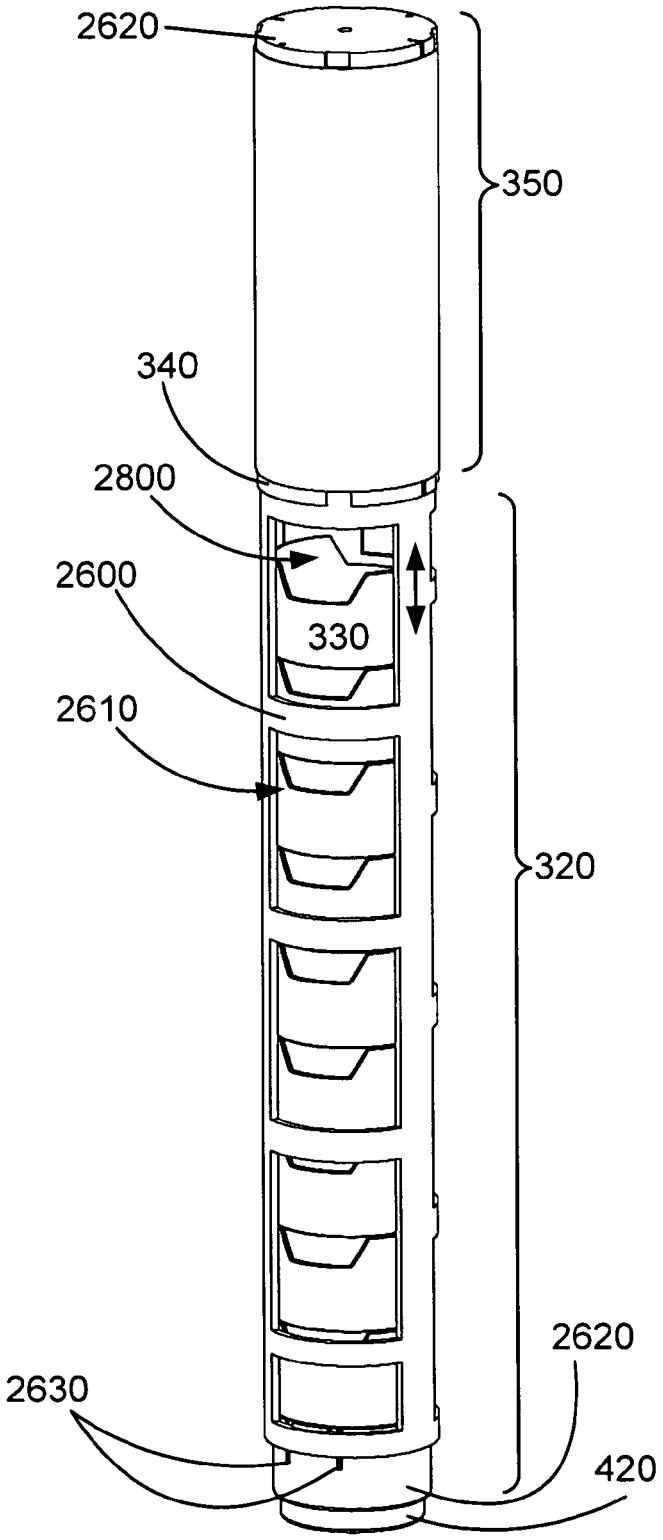
FIG. 29 depicts aspects of the embodiment illustrated in FIG. 28.

FIG. 29 depicts an embodiment of an apparatus such as illustrated in FIGS. 26-28. The view of FIG. 29 is similar to the view shown in FIG. 27. In the configuration shown in FIG. 29, the apparatus is in an "open" position to allow access to material stored in the stored material module 320. FIG. 29 shows an apparatus including a central stabilizer 350, a stored material module 320 and a stabilizer unit 2600. The stored material module 320 includes a cap 340 attached to the central stabilizer 350. The stored material module 320 includes a base stored material unit 2620, the base stored material unit 2620 including at least one aperture 2630. The base stored material unit 2620 is attached to a base 420 of the stored material module 320. The central stabilizer 350 includes a cap 2620 attached to the central stabilizer 350 at an opposing side of the central stabilizer 350 from the cap 340 of the stored material module 320. The stabilizer unit 2600 is configured as an exterior frame with an internal surface configured to mate with external surfaces of the stored material units 330 within the stored material module 320. The stabilizer unit is attached to the cap 340 of the stored material module 320. The stabilizer unit 2600 includes an exterior frame of a size and shape to substantially surround the stored material module 320, an inner surface of the external frame substantially conforming to an outer surface of the stored material module 320. The stabilizer unit 2600 includes a plurality of apertures 2610 in the external frame. The stabilizer unit 2600 includes one or more protrusions from a surface of the exterior frame at a surface facing the stored material module 320, the protrusions corresponding to one or more edge surfaces of at least one aperture 2630 within a base stored material unit 2620. The protrusions form a surface of the exterior frame at a surface facing the stored material module 320 fit within the aperture 2630, limiting the relative movement of the stored material units 330 within the stored material module 320 relative to the exterior frame. In the embodiment illustrated in FIG. 29, the stored material units 330 within the stored material module 320 have slid relative to the axis formed by the external frame of the stabilizer unit 2600, or substantially vertically as illustrated in the Figure. The relative movement of the stored material module 320 to the external frame of the stabilizer unit 2600 is limited as substantially defined by the shape and position of the aperture 2630. In FIG. 29, the relative movement of the stored material module 320 is sufficient to form an access region 2800. The access region 2800 would allow a user of the apparatus to access material stored in the stored material units within the stored material module 320. Although only the topmost stored material unit 330 is shown adjacent to the access region 2800, each of the stored material units within the stored material module 320 may slide relative to the external frame of the stabilizer unit 2600 to form access regions 2800 adjacent to each of the stored material units.

Figure 30:
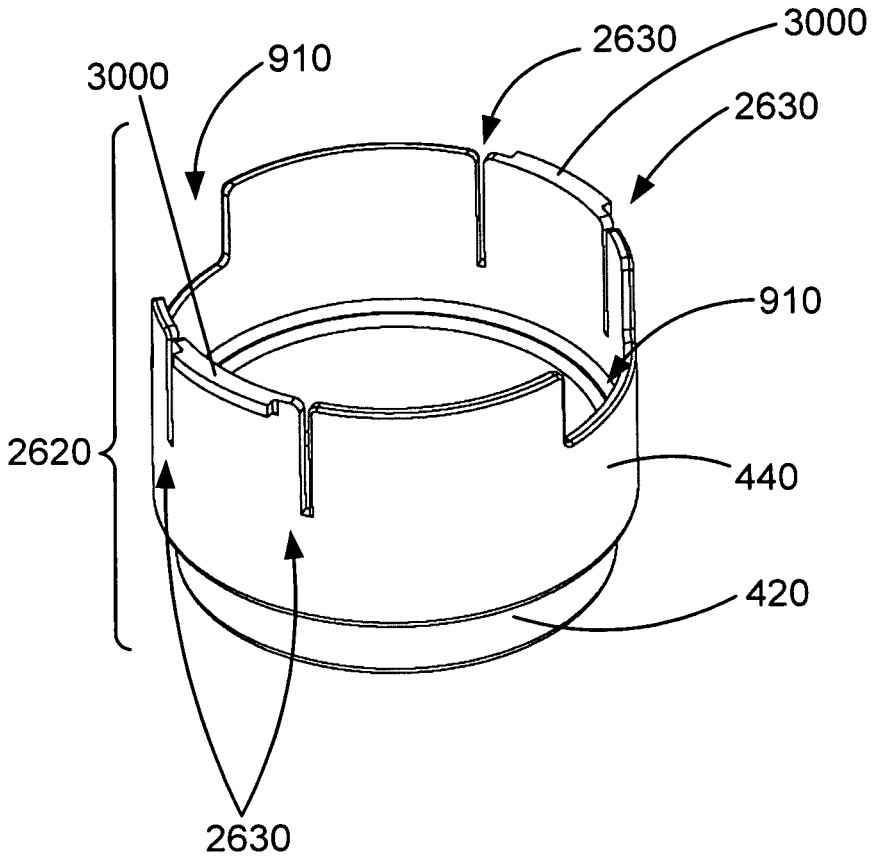
FIG. 30 shows aspects of a storage unit.

FIG. 30 illustrates a base stored material unit 2620 such as shown within an apparatus in FIGS. 26-29. The base stored material unit 2620 is attached to a stored material module base 420. Similar to the stored material units depicted in other Figures (identified as 330), the base stored material unit 2620 includes a gap region 910 configured to allow visibility and access to stored material within the base stored material unit 2620. The base stored material unit 2620 includes at least one aperture 2630 configured to mate with a projection on a corresponding interior surface of an exterior frame of a stabilizer unit 2600 (see FIGS. 26-29). The lower edge of the aperture 2630 substantially defines the relative positions of the stored material unit 320 relative to the stabilizer unit 2600. The base stored material unit 2620 includes a side wall 440. At last one flange 3000 projects from the top edge of the side wall 440 of the base stored material unit 2620. The at least one flange 3000 projects in a substantially perpendicular direction relative to the surface of the side wall 440. The at least one flange 3000 projects in a substantially perpendicular direction away from the exterior surface of the side wall 440. The flange is configured to reversibly mate with the edges of an aperture 2600 in an exterior frame of a stabilizer unit 2600. The edge of the flange 3000 mating with the edge of an aperture 2600 creates the minimum and maximum size of an access region 2800 adjacent to the stored material units within the stored material module 320. The edges of an aperture 2600 connecting with a edge of the flange 3000 substantially defines the vertical height of the access region 2800 adjacent to the stored material units within the stored material module 320 (see FIGS. 26-29). The contact between the edge of the flange 3000 and the upper edge of the aperture 2600 substantially defines the minimum displacement possible in a stored material module 320, or the height of the stored material module 320 in a "closed" or "locked" position (see FIGS. 26 and 27). Similarly, the contact between the edge of the flange 3000 and the upper edge of the aperture 2600 substantially defines the maximum displacement possible in a stored material module 320, or the height of the stored material module 320 in a "open" or "unlocked" position (see FIGS. 28 and 29).

Figure 31:
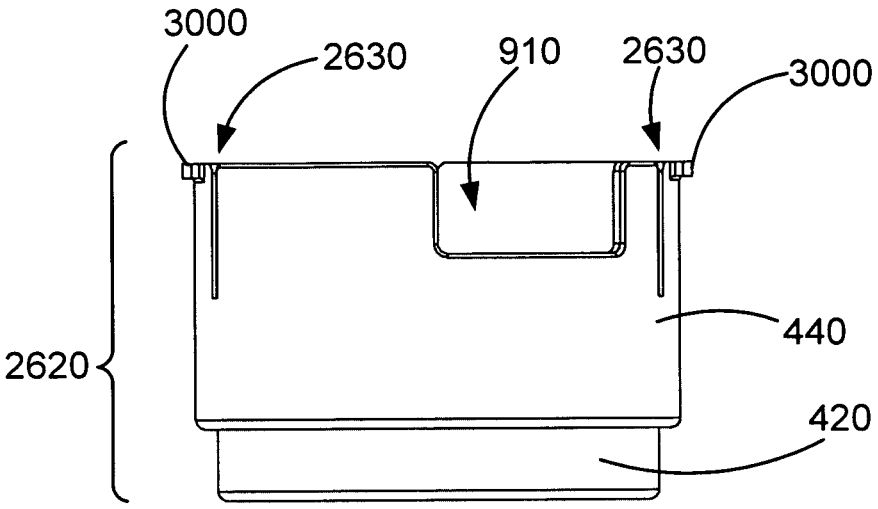
FIG. 31 illustrates aspects of a storage unit such as that shown in FIG. 30.

FIG. 31 illustrates a base stored material unit 2620 such as shown in FIG. 30, and illustrated within an apparatus in FIGS. 26-29. The base stored material unit 2620 is attached to a stored material module base 420: The base stored material unit 2620 includes a gap region 910 configured to allow visibility and access to stored material within the base stored material unit 2620. The base stored material unit 2620 includes at least one aperture 2630 configured to mate with a projection on a corresponding interior surface of an exterior frame of a stabilizer unit 2600 (see FIGS. 26-29). The lower edge of the aperture 2630 substantially defines the relative potential motion of the stored material unit 320 relative to the stabilizer unit 2600. The base stored material unit 2620 includes a side wall 440. At last one flange 3000 projects from the top edge of the side wall 440 of the base stored material unit 2620. The at least one flange 3000 projects in a substantially perpendicular direction relative to the surface of the side wall 440, or horizontally as depicted in FIG. 31. The flange is configured to reversibly mate with the edges of an aperture 2600 in an exterior frame of a stabilizer unit 2600. The edge of the flange 3000 mating with the edge of an aperture 2600 creates the boundaries of an access region 2800 adjacent to the stored material units within the stored material module 320. The edges of an aperture 2600 connecting with an edge of the flange 3000 substantially defines the vertical height of the access region 2800 adjacent to the stored material units within the stored material module 320 (see FIGS. 26-29). The contact between the edge of the flange 3000 and the upper edge of the aperture 2600 substantially defines the minimum displacement possible in a stored material module 320, or the height of the stored material module 320 in a "closed" or "locked" position (see FIGS. 26 and 27). Similarly, the contact between the edge of the flange 3000 and the upper edge of the aperture 2600 substantially defines the maximum displacement possible in a stored material module 320, or the height of the stored material module 320 in a "open" or "unlocked" position (see FIGS. 28 and 29).

Figure 32:
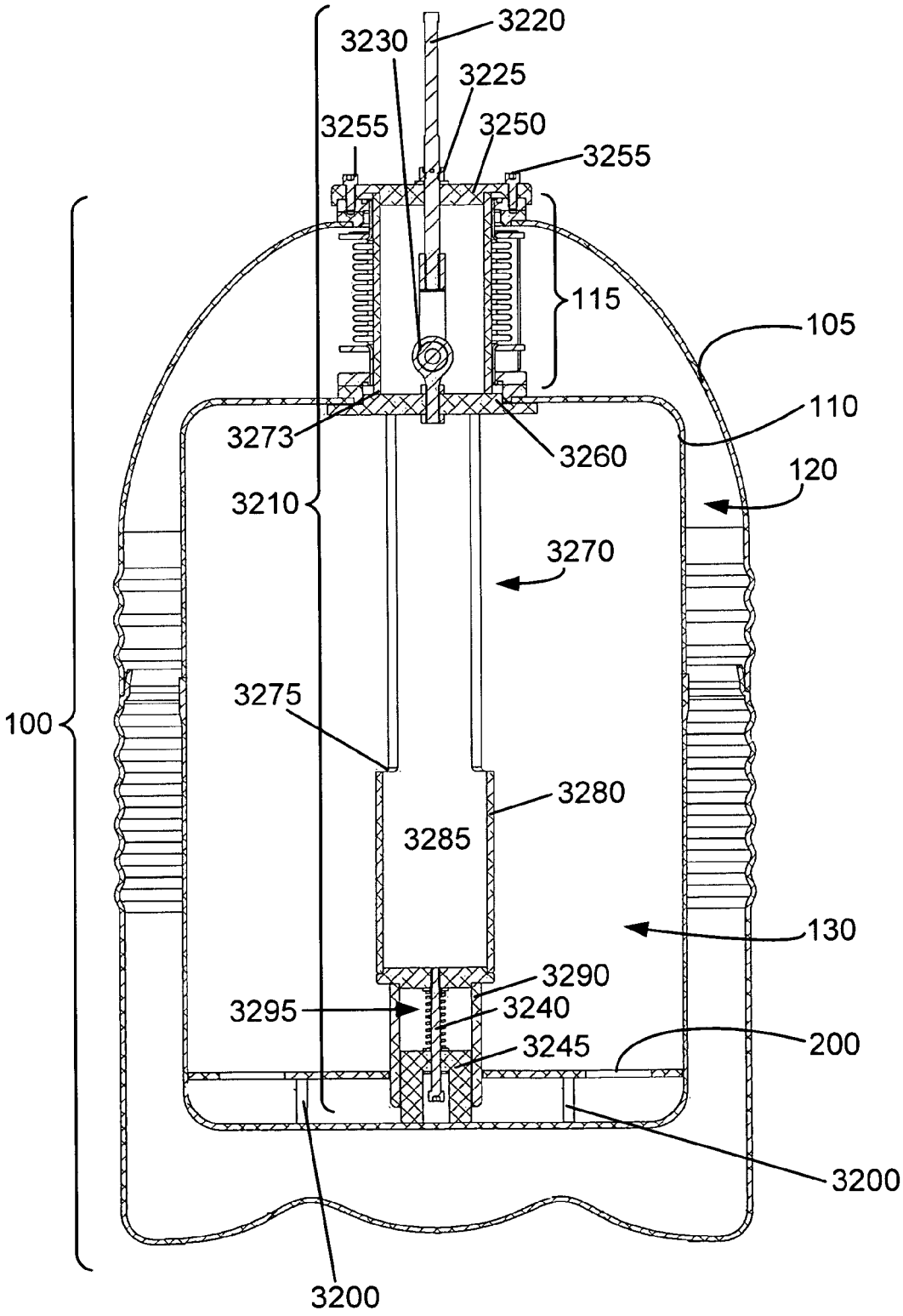
FIG. 32 depicts, in cross-section, a substantially thermally sealed storage container with a flexible conduit and a stabilizer unit.

FIG. 32 depicts a transport stabilizer 3210 illustrated in association with a substantially thermally sealed container 100 in a vertical cross-section view. The transport stabilizer 3210 is intended for use in a substantially thermally sealed container 100 including a connector 115 that is a flexible connector. The transport stabilizer 3210 is configured to assume some of the force associated with the connector 115 flexing or moving, particularly in situations when the substantially thermally sealed container 100 is subject to substantial motion. The transport stabilizer 3210 may be of use, for example, during shipment or transport of a substantially thermally sealed container 100. The transport stabilizer 3210 is configured of a size and shape to reversibly mate with the interior of a substantially thermally sealed container 100 including a connector 115 that is a flexible connector. The dimensions of a transport stabilizer 3210 correspond to the dimensions of the interior of a substantially thermally sealed container 100 including a connector 115 that is a flexible connector.

FIG. 32 depicts a substantially thermally sealed container 100 including a connector 115 that is a flexible connector. The substantially thermally sealed container 100 includes an outer wall 105 and an inner wall 110, with a gap 120 between the outer wall 105 and the inner wall 110. The interior surface of the inner wall 110 substantially defines the boundary of a substantially thermally sealed storage region 130. The interior of the substantially thermally sealed storage region 130 includes a storage structure 200 attached to the interior surface of the inner wall 110. Although not clearly visible in the cross-section view shown in FIG. 32, the storage structure includes a plurality of apertures 220, 210 (see FIG. 2). A center aperture 210 is positioned in the center of the support structure 200, with the edges of the center aperture 210 approximately corresponding to the sides of the conduit 125 (see FIG. 2). As illustrated in FIG. 32, one or more support structures 3200 maintain the relative position of the substantially planar storage structure 200 relative to the interior surface of the inner wall 110.

FIG. 32 depicts a transportation stabilizer unit 3210 in association with the substantially thermally sealed container 100. In the configuration illustrated, the substantially thermally sealed container 100 and the transportation stabilizer unit 3210 are positioned so that the transportation stabilizer unit 3210 assumes a substantial proportion of the force exerted on the flexible connector 115 by the mass and motion of the inner wall 110 and any contents of the substantially thermally sealed storage region 130, including the mass of the storage structure 200. The transportation stabilizer unit 3210 includes a lid 3250 of a size and shape configured to substantially cover an external opening in the outer wall 105 of the substantially thermally sealed storage container 100. The lid 3250 includes a surface configured to reversibly mate with an external surface of the outer wall 105 of the substantially thermally sealed storage container 100 adjacent to an external opening in the outer wall 105. The lid 3250 may be fabricated of a material with sufficient strength to maintain the flexible connector in a compressed position when the reversible fastening unit is attached to the positioning shaft. For example, the lid 3250 may be fabricated from stainless steel. The lid 3250 includes one or more apertures configured to attach a fastener 3255 to the exterior surface of the container 100. The lid includes a central aperture, the aperture configured in a substantially perpendicular direction relative to the plane of the lid 3250. A reversible fastening unit 3225 is attached to the lid 3250 at a position adjacent to the central aperture in the lid 3250. The reversible fastening unit 3225 is positioned to fasten a positioning shaft 3220 within the central aperture in the lid. The reversible fastening unit 3225 is positioned to fasten a positioning shaft 3220 in a fixed position relative to the lid 3250. The transportation stabilizer unit 3210 includes a wall 3280, the wall 3280 substantially defining a tubular structure with a diameter in cross-section less than a minimal diameter of the flexible connector 115 of the substantially thermally sealed storage container 100. The end of the wall 3280 substantially defining the tubular structure is operably attached to the lid 3250. As illustrated in FIG. 32, the wall 3280 is attached to the lid 3250 at a substantially right angle, or perpendicularly. The wall 3280 includes at least one aperture 3270. In the embodiments illustrated in FIGS. 32-39, the wall 3280 includes two apertures on opposing faces of the wall 3280. The two apertures illustrated are substantially equivalent in the depicted embodiments. The aperture 3270 has an upper edge 3273 and a lower edge 3275 relative to the view shown in FIG. 32. The upper edge 3273 of the aperture 3270 in the wall 3280 is positioned on the tubular structure at a location less than a maximum length of the flexible connector 115 from the end of the tubular structure operably attached to the lid 3250. The transport stabilizer 3210 includes a positioning shaft 3220. The positioning shaft 3220 has a diameter in cross-section less than a diameter in cross-section of the central aperture in the lid 3250. The positioning shaft 3220 is of a length greater than the thickness of the lid 3250 in combination with the length of the wall 3280 between the surface of the lid 3250 and the upper edge 3273 of the aperture 3270 in the wall 3280. The wall 3280 has an interior surface, the interior surface substantially defining an interior region 3285 of the tubular region. The transport stabilizer 3210 includes a pivot unit 3230, the pivot unit 3230 operably attached to a terminal region of the positioning shaft 3220 and positioned within the interior region 3285. The transport stabilizer 3210 includes a support unit 3260. The support unit 3260 is operably attached to the pivot unit 3230. The support unit 3260 is of a size and shape to fit within the interior region 3285 when the pivot unit 3230 is rotated in one direction, and to protrude through the aperture 3270 in the wall 3280 when the pivot unit 3230 is rotated approximately 90 degrees in the other direction (substantially horizontally as depicted in FIG. 32).

The transport stabilizer 3210 includes an end region 3290. The end region is of a size and shape configured to reversibly mate with the interior surface of an aperture 210 in a storage structure 200 within the substantially thermally sealed storage container 100. The transport stabilizer 3210 includes a base grip 3245 at the terminal end of the end region 3290. As illustrated in FIG. 32, the base grip 3245 is configured to reversibly mate with an interior surface of the inner wall 110 of the container 100 when the transport stabilizer 3210 is in use. The transport stabilizer 3210 includes a tensioning unit for the base grip 3245. The tensioning unit is configured to maintain pressure on the base grip 3245 against an interior wall 110 of the substantially thermally sealed storage container 100 in a direction substantially perpendicular to the surface of the lid 3250, or substantially downwards in the view of FIG. 32. The tensioning unit may include a tensioning shaft 3240 and a tensioning spring 3295 configured to maintain force along the long axis of the transport stabilizer 3210 to the end of the base grip 3245.

The parts of the transport stabilizer 3210 may be fabricated from a variety of materials as suitable for the embodiment. Materials may be selected for cost, density, strength, thermal conduction properties and other attributes as suitable for the embodiment. In some embodiments, the transport stabilizer 3210 is substantially fabricated from metal parts, such as stainless steel, brass or aluminum parts. In some embodiments, part of the transport stabilizer 3210 is fabricated from durable plastic materials, including glass-reinforced plastics. In some embodiments, the positioning shaft 3220 is fabricated from a plastic material of suitable durability. In some embodiments, the base grip 3245 is fabricated from a plastic material with suitable coefficient of friction. For example, the base grip 3245 may be fabricated from a material with a coefficient of friction greater than 0.5 with the surface of the interior wall at temperatures between approximately 2 degrees and 8 degrees Centigrade. For example, the base grip 3245 may be fabricated from a material with a coefficient of friction greater than 0.7 with the surface of the interior wall at temperatures between approximately 2 degrees and 8 degrees Centigrade. For example, the base grip 3245 may be fabricated from a material with a coefficient of friction greater than one with the surface of the interior wall at temperatures between approximately 2 degrees and 8 degrees Centigrade. For example, the base grip 3245 may be fabricated from a material with a coefficient of friction greater than 1.2 with the surface of the interior wall at temperatures between approximately 2 degrees and 8 degrees Centigrade. For example, the base grip 3245 may be fabricated from a material with a coefficient of friction greater than 1.5 with the surface of the interior wall at temperatures between approximately 2 degrees and 8 degrees Centigrade.

Figure 33:
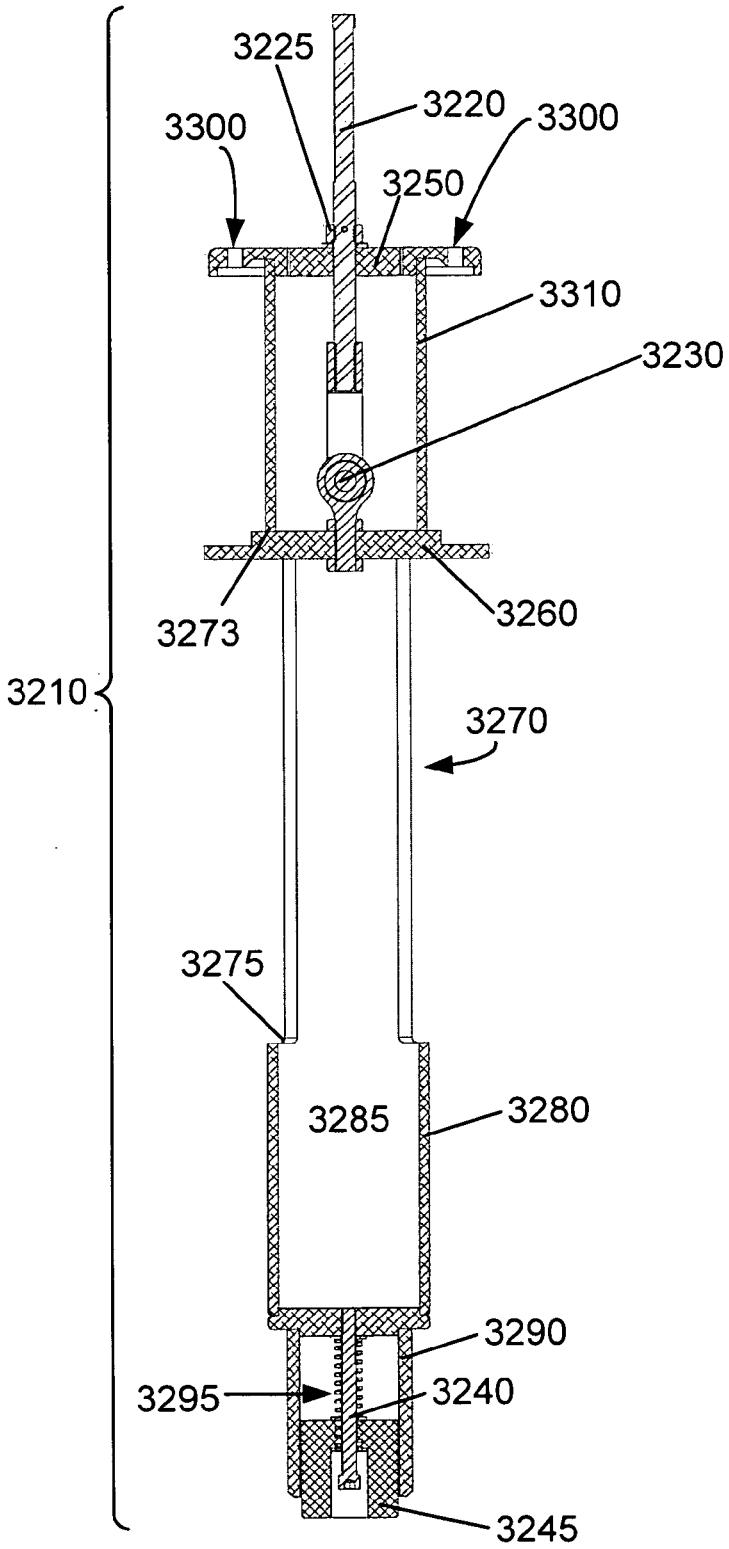
FIG. 33 shows, in cross-section, a transportation stabilizer unit.

FIG. 33 illustrates aspects of a transport stabilizer 3210 such as shown in FIG. 32. In the view illustrated in FIG. 33, the transport stabilizer 3210 is in a configuration as it would be implemented within a substantially thermally sealed storage container 100, although the substantially thermally sealed storage container 100 is not illustrated in FIG. 33. In the view illustrated in FIG. 33, the transport stabilizer 3210 is in a configuration as shown in FIG. 32, without the substantially thermally sealed storage container 100 illustrated in FIG. 32. As illustrated in FIG. 32, a transport stabilizer 3210 is of a size and shape to fit a substantially thermally sealed storage container 100 of specific dimensions.

The transportation stabilizer unit 3210 includes a lid 3250 of a size and shape configured to substantially cover an external opening in the outer wall 105 of a substantially thermally sealed storage container 100. The lid 3250 includes one or more apertures 3300 configured to attach a fastener to the exterior surface of the container 100. The lid includes a central aperture, the aperture configured in a substantially perpendicular direction relative to the plane of the lid 3250. A reversible fastening unit 3225 is attached to the lid 3250 at a position adjacent to the central aperture in the lid 3250. The reversible fastening unit 3225 is positioned to fasten a positioning shaft 3220 within the central aperture in the lid. The transportation stabilizer unit 3210 includes a wall 3280, the wall 3280 substantially defining a tubular structure with a diameter in cross-section less than a minimal diameter of the flexible connector 115 of the substantially thermally sealed storage container 100. The wall 3280 includes a region 3310 configured to fit within the minimum interior of a conduit 125 in a flexible connector 115. The region 3310 is shorter than the minimum length of the flexible connector 115. The end of the region 3310 in the wall 3280 is fixed to the lid 3250. As illustrated in FIGS. 32 and 33, the wall 3280 is attached to the lid 3250 at a substantially right angle, or perpendicularly. The wall 3280 includes at least one aperture 3270. In the embodiments illustrated in FIGS. 32-39, the wall 3280 includes two apertures on opposing faces of the wall 3280. The two apertures illustrated are substantially equivalent in the depicted embodiments. The aperture 3270 has an upper edge 3273 and a lower edge 3275 relative to the view shown in FIG. 32. The upper edge 3273 of the aperture 3270 in the wall 3280 is positioned on the tubular structure at a location less than a maximum length of the flexible connector 115 from the end of the tubular structure operably attached to the lid 3250. The upper edge 3273 of the aperture 3270 defines the length of the region 3310 configured to fit within the minimum interior of a conduit 125 in a flexible connector 115. The length of the region 3310 configured to fit within the minimum interior of a conduit 125 in a flexible connector 115 is defined by the edge of the lid 3250 on one end and the upper edge 3273 of the aperture 3270 at the opposing end. The transport stabilizer 3210 includes a positioning shaft 3220. The wall 3280 has an interior surface, the interior surface substantially defining an interior region 3285 of the tubular region. The transport stabilizer 3210 includes a pivot unit 3230, the pivot unit 3230 operably attached to a terminal region of the positioning shaft 3220 and positioned within the interior region 3285. The transport stabilizer 3210 includes a support unit 3260. The support unit 3260 is operably attached to the pivot unit 3230. The support unit 3260 is of a size and shape to fit within the interior region 3285 when the pivot unit 3230 is rotated in one direction, and to protrude through the aperture 3270 in the wall 3280 when the pivot unit 3230 is rotated approximately 90 degrees in the other direction (substantially horizontally as depicted in FIGS. 32 and 33). In the view illustrated in FIG. 33, the support unit 3260 is rotated by the pivot unit 3230 in a position substantially parallel to the plane of the lid 3250. In the view shown in FIG. 33, the support unit 3260 is rotated by the pivot unit 3230 in a position substantially parallel to the upper edge 3273 of the aperture 3270, and fixed in a position against the upper edge 3273 of the aperture 3270 by the positioning shaft 3220 fixed to the fastener 3225 at a suitable location.

The transport stabilizer 3210 includes an end region 3290. The end region is of a size and shape configured to reversibly mate with the interior surface of an aperture 210 in a storage structure 200 within the substantially thermally sealed storage container 100. The transport stabilizer 3210 includes a base grip 3245 at the terminal end of the end region 3290. The transport stabilizer 3210 includes a tensioning unit for the base grip 3245. The tensioning unit may include a tensioning shaft 3240 and a tensioning spring 3295 configured to maintain force along the long axis of the transport stabilizer 3210 to the end of the base grip 3245.

Figure 34:
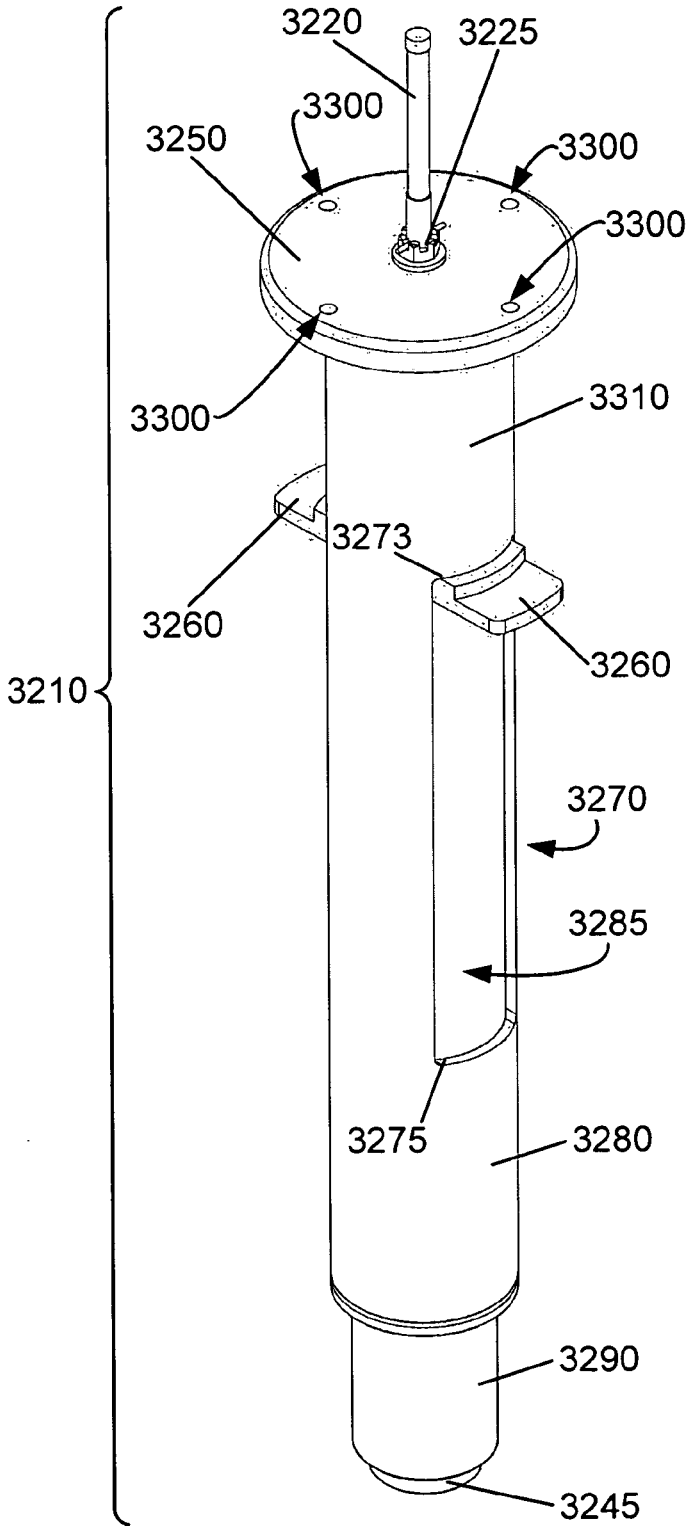
FIG. 34 illustrates aspects of a transportation stabilizer unit such as that shown in FIG. 33.

FIG. 34 depicts an external view of a transport stabilizer 3210 such as illustrated in FIGS. 32 and 33 in cross-section. FIG. 34 illustrates that the transport stabilizer 3210 includes a positioning shaft 3220 and an adjacent fastener 3225 attached to the lid 3250. The lid 3250 illustrated includes a plurality of apertures 3300 configured to allow fasteners to attach the lid 3250 to an exterior wall 105 in a substantially thermally sealed storage container 100. The transportation stabilizer unit 3210 includes a wall 3280, the wall 3280 substantially defining a tubular structure. The interior surface of the wall 3280 substantially defines an interior region 3285 in the tubular structure. The wall 3280 includes a region 3310 configured to fit within the minimum interior of a conduit 125 in a flexible connector 115. The transportation stabilizer unit 3210 illustrated includes two apertures 3270 in the wall 3280. The ends of a single support unit 3260 are visible projecting away from the outer edge of the wall 3280 through the two apertures 3270. The center portion of the support unit 3260 (not shown) is within the interior region 3285 in the tubular structure. The aperture 3270 shown includes an upper edge 3273 and a lower edge 3275 relative to the view shown in FIG. 34. The upper surface of the support unit 3260 is in a fixed position against the upper edge 3273. The transport stabilizer 3210 includes an end region 3290. The transport stabilizer 3210 includes a base grip 3245 at the terminal end of the end region 3290.

Figure 35:
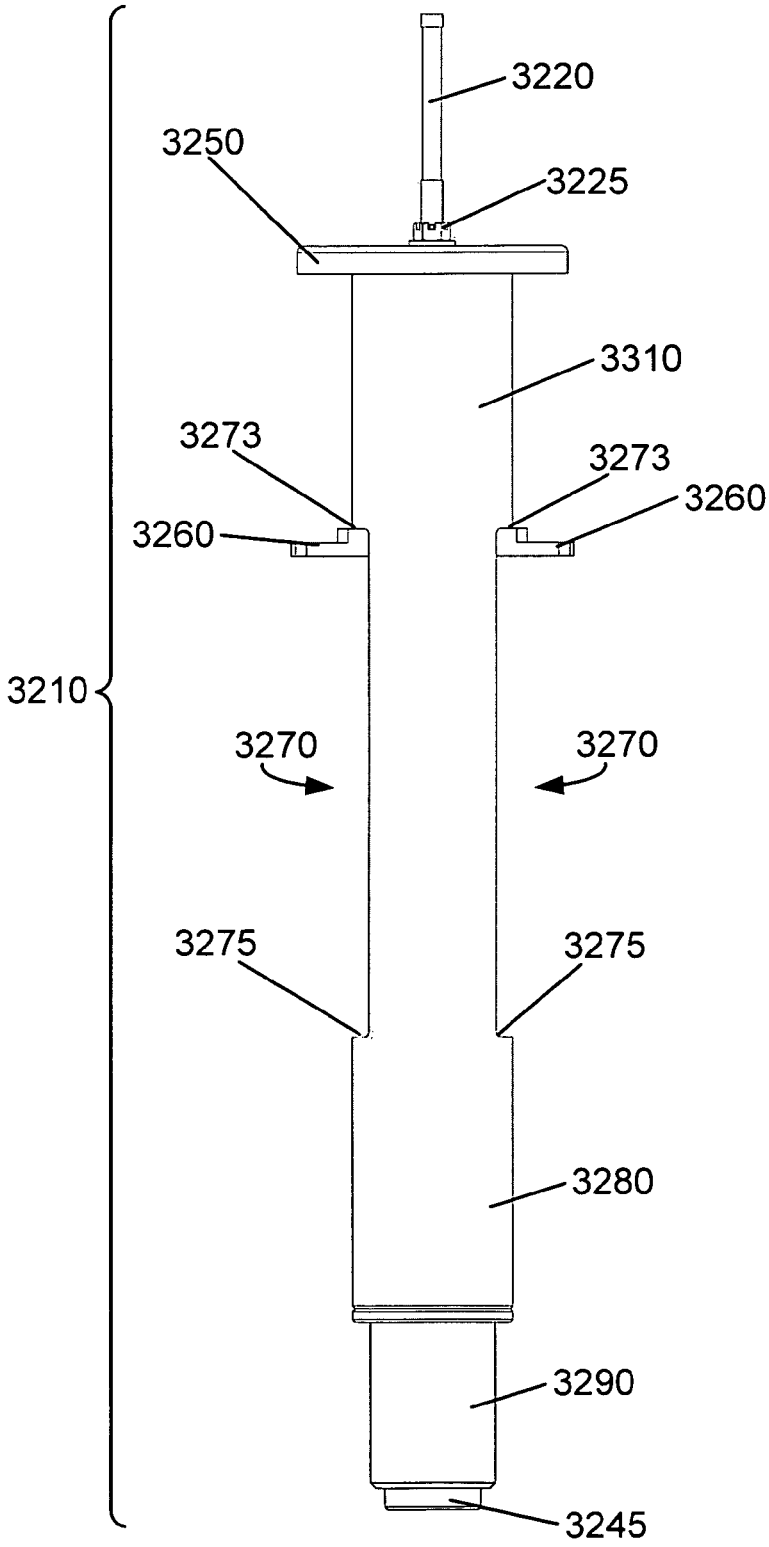
FIG. 35 depicts aspects of a transportation stabilizer unit such as that shown in FIG. 33.

FIG. 35 illustrates aspects of a transportation stabilizer unit 3210. The transportation stabilizer unit 3210 shown in FIG. 35 is similar to that depicted in FIG. 34. In FIG. 35 the transportation stabilizer unit 3210 is shown in a substantially horizontal exterior view. The transport stabilizer 3210 includes a positioning shaft 3220 and an adjacent fastener 3225 attached to the lid 3250. The transportation stabilizer unit 3210 includes a wall 3280, the wall 3280 substantially defining a tubular, structure. The wall 3280 includes a region 3310 configured to fit within the minimum interior of a conduit 125 in a flexible connector 115. The transportation stabilizer unit 3210 illustrated includes two apertures 3270 in the wall 3280. The ends of a single support unit 3260 are visible projecting away from the outer edge of the wall 3280 through the two apertures 3270. The apertures 3270 depicted include upper edges 3273 and lower edges 3275 relative to the view shown in FIG. 35. The upper surface of the support unit 3260 is in a fixed position against the upper edges 3273. The transport stabilizer 3210 includes an end region 3290. The transport stabilizer 3210 includes a base grip 3245 at the terminal end of the end region 3290.

Figure 36:
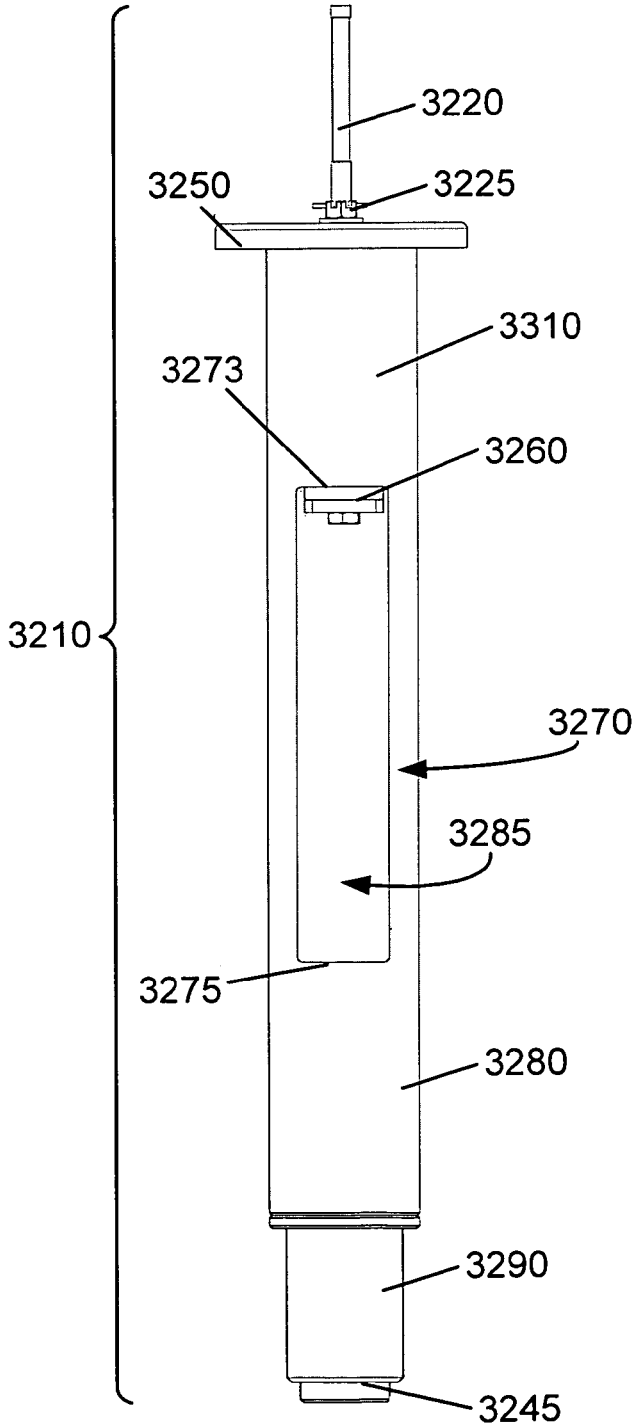
FIG. 36 shows aspects of a transportation stabilizer unit such as that shown in FIG. 33.

FIG. 36 illustrates aspects of a transportation stabilizer unit 3210. The transportation stabilizer unit 3210 shown in FIG. 36 is similar to that depicted in FIG. 35. In FIG. 36, the transportation stabilizer unit 3210 is shown in a substantially horizontal exterior view, but facing the side of the view illustrated in FIG. 35. The transport stabilizer 3210 includes a positioning shaft 3220 and an adjacent fastener 3225 attached to the lid 3250. The transportation stabilizer unit 3210 includes a wall 3280, the wall 3280 substantially defining a tubular structure. The wall 3280 includes a region 3310 configured to fit within the minimum interior of a conduit 125 in a flexible connector 115. The view of the transportation stabilizer unit 3210 shown in FIG. 36 includes an aperture 3270 in the wall 3280. The end of a single support unit 3260 is visible projecting away from the outer edge of the wall 3280 through the aperture 3270. The center portion of the support unit 3260 is within the interior region 3285 in the tubular structure. The aperture 3270 depicted includes an upper edge 3273 and a lower edge 3275 relative to the view shown in FIG. 36. The upper surface of the support unit 3260 is in a fixed position against the upper edge 3273. The transport stabilizer 3210 includes an end region 3290. The transport stabilizer 3210 includes a base grip 3245 at the terminal end of the end region 3290.

Figure 37:
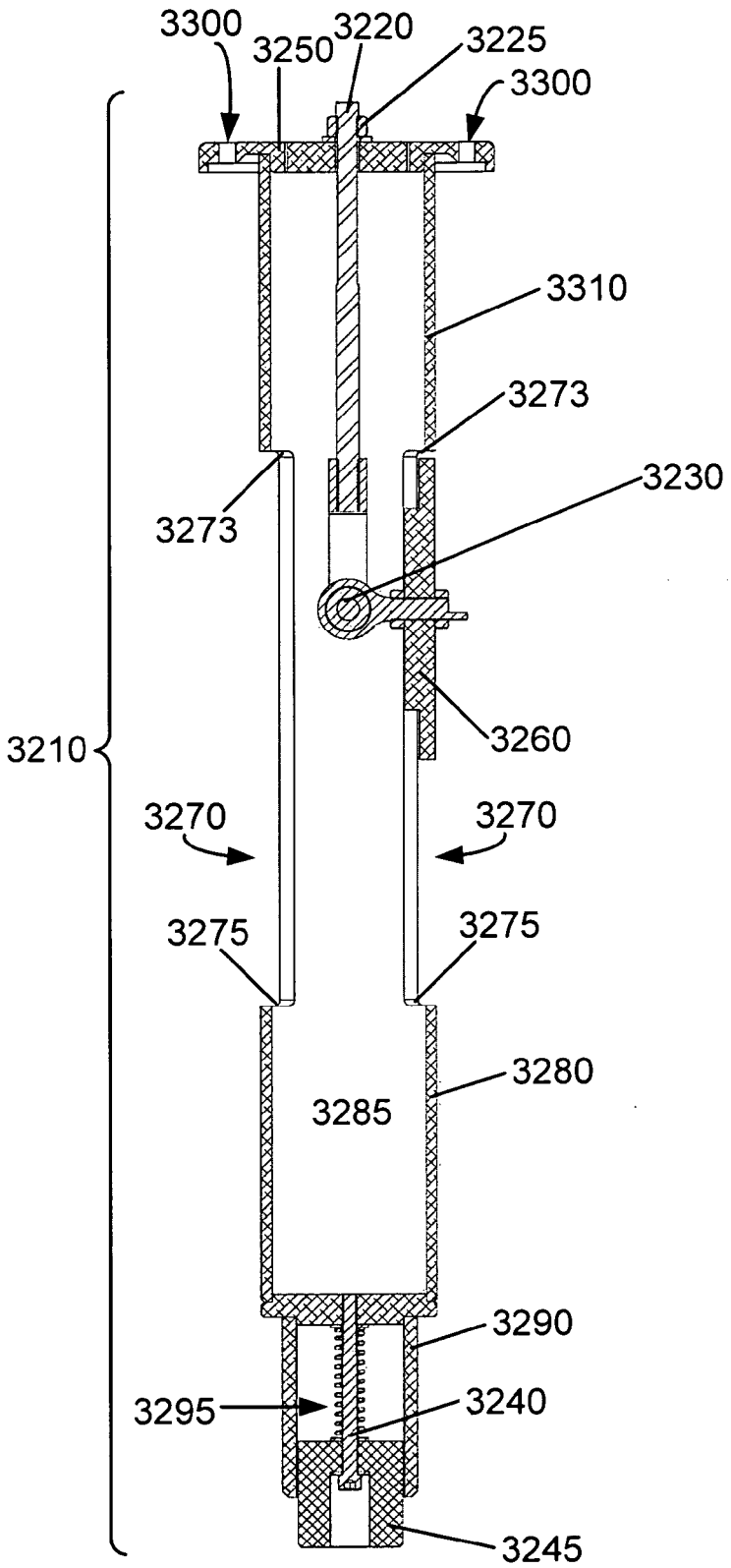
FIG. 37 illustrates, in cross-section, aspects of a transportation stabilizer unit such as that shown in FIG. 33.

FIG. 37 depicts a transportation stabilizer unit 3210 in a vertical cross-section view. As shown, a transportation stabilizer unit 3210 includes a lid 3250. The lid 3250 includes one or more apertures 3300 configured to accommodate fasteners to attach the lid 3250 to the exterior of a substantially thermally sealed container 100 (not shown in FIG. 37). The lid 3250 has an attached fastener 3225 positioned adjacent to a central aperture in the lid 3250. The fastener 3225 is configured to reversibly attach to a positioning shaft 3220. The positioning shaft 3220 has the potential to move through the central aperture in the lid 3250 when not fixed in position by the fastener 3225. The positioning shaft 3220 is connected to a pivot 3230 within the interior 3285 of the transportation stabilizer unit 3210. The pivot 3230 is attached to a support unit 3260. The transportation stabilizer unit 3210 includes a wall 3280, the wall 3280 substantially defining a tubular structure. The wall 3280 includes a region 3310 configured to fit within the minimum interior of a conduit 125 in a flexible connector 115 (not shown in FIG. 37). The transportation stabilizer unit 3210 depicted in FIG. 37 includes two apertures 3270 in the wall 3280 on opposing faces of the tubular structure. The apertures 3270 each include an upper edge 3273 and a lower edge 3275 relative to the position illustrated (i.e. a substantially vertical transport stabilizer unit 3210). The transport stabilizer 3210 includes an end region 3290. The transport stabilizer 3210 includes a base grip 3245 at the terminal end of the end region 3290.

In the view illustrated in FIG. 37, the support unit 3260 is rotated by the pivot 3230 so that the support unit 3260 is positioned substantially parallel to the surface of the wall 3280. As illustrated, the pivot unit 3230 is configured to allow movement of the support unit 3260 approximately 90 degrees along a single axis. The support unit 3260 is in a substantially vertical position corresponding to the vertical position of the main axis of the transport stabilizer 3210. The support unit 3260 is of a size and shape to fit substantially within one of the apertures 3270. The support unit 3260 and the pivot unit 3230 are configured to position the support unit 3260 substantially within the outer diameter of the tubular structure defined by the wall 3280. In this position, the transport stabilizer unit 3210 is configured to fit within a conduit 125 of a substantially thermally sealed container 100.

After the transport stabilizer unit 3210 is positioned with the surface of the lid 3250 in contact with the outer wall 105 of a substantially thermally sealed container 100, the positioning shaft 3220 may be moved by an user of the apparatus to rotate the pivot unit 3230 and thus to move the support unit 3260 in a substantially horizontal position relative to the transport stabilizer 3210 (e.g. as shown in FIG. 33). The transport stabilizer 3210 may then be positioned to provide support to a flexible connector 115 by a user pulling the positioning shaft 3220 through the central aperture in the lid 3250 to a degree required to for the surface of the support unit 3260 to come into contact with the edge of the flexible connector 115 at the inner wall 110 of the container 100 (e.g. as illustrated in FIG. 32). The positioning shaft 3220 may then be fixed in place with the fastener 3225 attached to the lid 3250.

Figure 38:
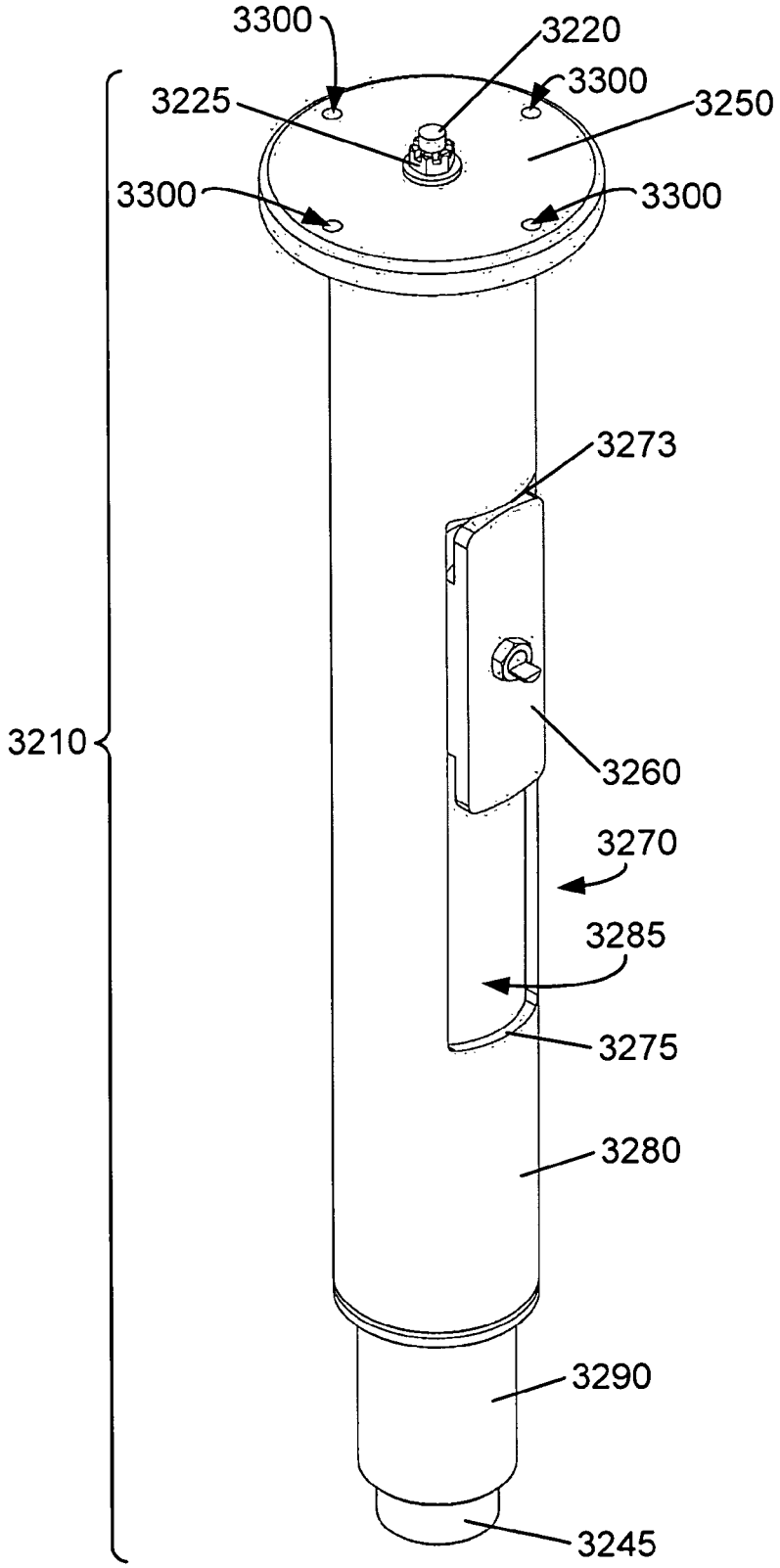
FIG. 38 depicts aspects of a transportation stabilizer unit such as that shown in FIG. 33.

FIG. 38 illustrates a transport stabilizer unit 3210 with a support unit 3260 rotated to fit within an aperture 3270 in the wall 3280. This view is similar to an external view of the embodiment illustrated in FIG. 37. The transport stabilizer unit 3210 includes a lid 3250. The lid 3250 includes a plurality of apertures 3300 configured to reversibly attach fasteners to the exterior surface of a substantially thermally sealed container 100. The lid 3250 includes a central aperture and an adjacent fastener 3225 attached to the lid 3250. The central aperture provides a space for a positioning rod 3220 to traverse the lid 3250. The positioning rod 3220 is connected to a pivot unit 3230 (not shown) in the interior 3285 of the wall 3280 of the transport stabilizer unit 3210. The support unit 3260 is shown in a substantially vertical position corresponding to the vertical position of the main axis of the transport stabilizer 3210. The support unit 3260 is of a size and shape to fit substantially within the aperture 3270. The aperture 3270 includes an upper edge 3273 and a lower edge 3275. In the position shown in FIG. 38, the transport stabilizer unit 3210 is configured to fit within a conduit 125 of a substantially thermally sealed container 100. The edge of the support unit 3260 is braced against the upper edge 3273 of the aperture 3270 in the illustration. This position may minimize potential rotation of the support unit 3260 when the transport stabilizer unit 3210 is lowered into a substantially thermally sealed container 100. The transport stabilizer 3210 includes an end region 3290. The transport stabilizer 3210 includes a base grip 3245 at the terminal end of the end region 3290.

Figure 39:
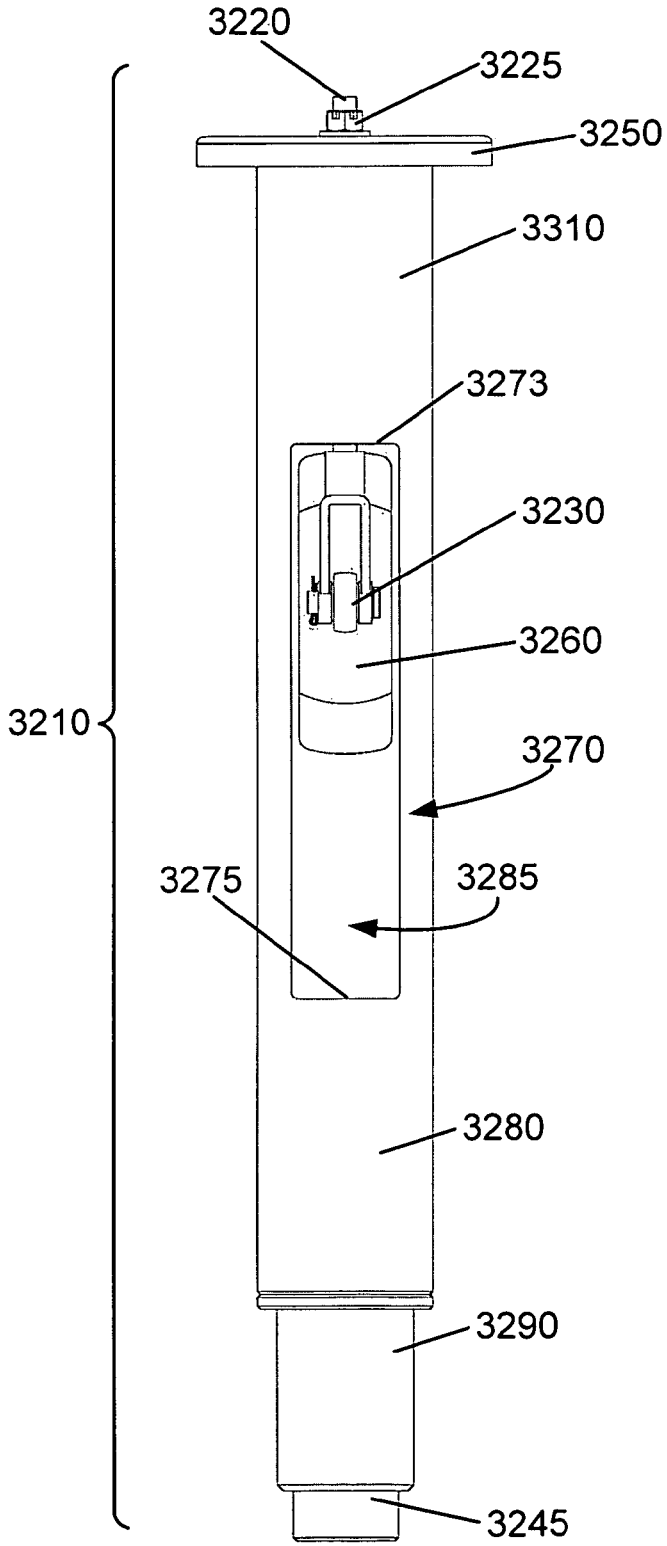
FIG. 39 shows aspects of a transportation stabilizer unit such as that shown in FIG. 33.

FIG. 39 illustrates a transport stabilizer unit 3210 like that depicted in FIG. 37, in an external view. The view shown in FIG. 39 is of a transport stabilizer unit 3210 at a substantially perpendicular view from that depicted in FIG. 37. The transport stabilizer unit 3210 includes a lid 3250 attached at a substantially perpendicular angle to the wall 3280 of the transport stabilizer unit 3210. The wall 3280 defines a substantially tubular structure of the transport stabilizer unit 3210. The lid 3250 includes a central aperture and a fastener 3225 attached to the exterior surface of the lid adjacent to the central aperture. The central aperture is of a size and shape to allow a positioning shaft 3220 to traverse through the lid 3250. The transport stabilizer unit 3210 includes a region 3310 configured to fit within the minimum interior of a conduit 125 in a flexible connector 115 (not depicted in FIG. 39). The wall 3280 includes two apertures 3270 of substantially similar size and shape on opposing faces of the wall 3280. In the view shown in FIG. 39, the apertures 3270 are aligned to appear substantially overlapping. The apertures 3270 each have an upper edge 3273 and a lower edge 3275. As shown in FIG. 39, the lower end of the positioning rod 3220 is attached to a pivot unit 3230. The pivot unit 3230 is attached to a surface of a support unit 3260. The view of FIG. 39 shows the pivot unit 3230 and the support unit 3260 through the overlapping apertures 3270 and the interior region 3285. The face of the support unit 3260 is the opposite face to that shown in FIG. 38.

In some embodiments, one or more sensors may be attached to the transport stabilizer unit 3210. A sensor may be positioned, for example, within the interior 3285 of the transport stabilizer unit 3210. A transport stabilizer unit 3210 may include an indicator, such as a visual indicator like an LED light emitter. An electronic system may be operably connected to a transport stabilizer unit 3210. An electronic system may be operably connected to a sensor and an indicator attached to the transport stabilizer unit 3210. For example, a temperature sensor may be attached to the interior surface of transport stabilizer unit 3210. A LED light emitting indicator may be attached to the outer surface of the lid 3250. An electronic system, including a controller and wire connections, may be attached to the temperature sensor and the indicator. The electronic system may be configured, for example, to light the indicator when the temperature sensor senses a temperature within the transport stabilizer unit 3210 which is out of a predetermined temperature range. For example, electronic system may be configured to light the indicator when the temperature sensor senses a temperature outside of the range of approximately 0 degrees Centigrade and 10 degrees Centigrade. For example, electronic system may be configured to light the indicator when the temperature sensor senses a temperature outside of the range of approximately 2 degrees Centigrade and 8 degrees Centigrade. For example, electronic system may be configured to light the indicator when the temperature sensor senses a temperature outside of the range of approximately 5 degrees Centigrade and 15 degrees Centigrade. For example, electronic system may be configured to light the indicator when the temperature sensor senses a temperature outside of the range of approximately 20 degrees Centigrade and 30 degrees Centigrade. For example, electronic system may be configured to light the indicator when the temperature sensor senses a temperature below approximately 0 degrees Centigrade. For example, electronic system may be configured to light the indicator when the temperature sensor senses a temperature above approximately 30 degrees Centigrade.

Figure 40A:
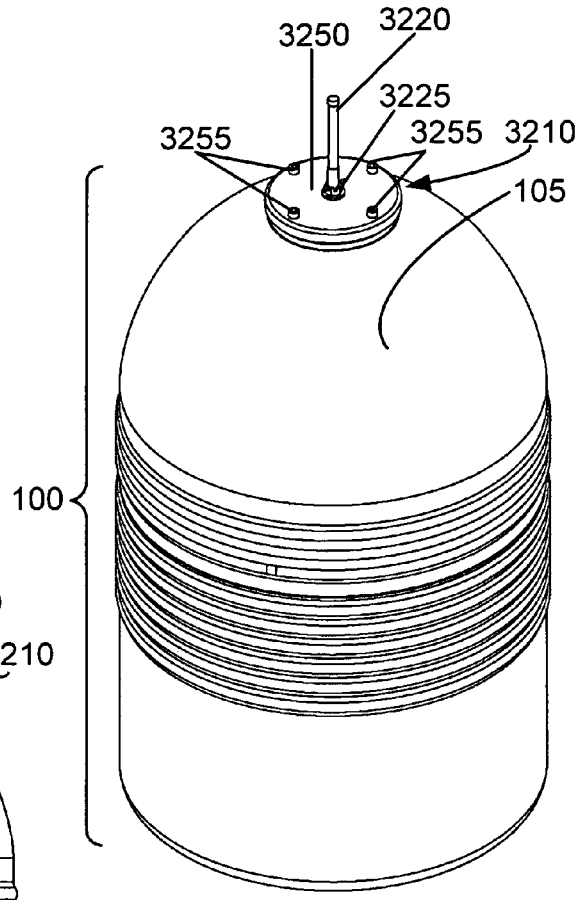
FIG. 40A illustrates a substantially thermally sealed storage container with a transportation stabilizer unit.

FIG. 40A depicts an external view of a substantially thermally sealed container 100 with an attached transport stabilizer unit 3210. FIG. 40A depicts an angled top down view of a substantially thermally sealed container 100 with an attached transport stabilizer unit 3210. The transport stabilizer unit 3210 includes a lid 3250. A plurality of fasteners 3255 secure the lid 3250 to the exterior wall 105 of the container 100. The lid 3250 includes a central aperture which includes a positioning shaft 3220. The positioning shaft 3220 is fixed in a stable position relative to the lid 3250 by a fastener 3225 attached to the surface of the lid 3250.

Figure 40B:
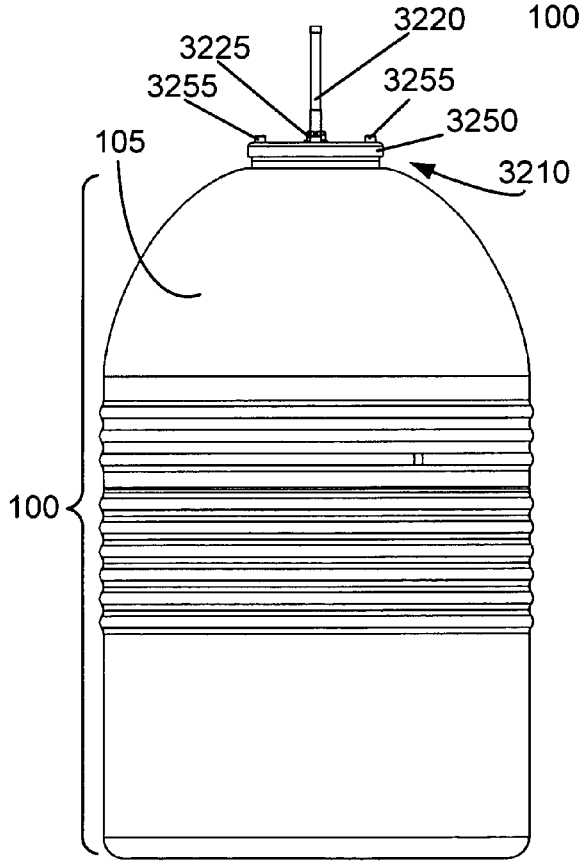
FIG. 40B depicts a substantially thermally sealed storage container with a transportation stabilizer unit such as illustrated in FIG. 40A.

FIG. 40B depicts an external view of a substantially thermally sealed container 100 with an attached transport stabilizer unit 3210. FIG. 40B depicts vertical side view of a substantially thermally sealed container 100 with an attached transport stabilizer unit 3210. The transport stabilizer unit 3210 includes a lid 3250. Fasteners 3255 secure the lid 3250 to the exterior wall 105 of the container 100. The lid 3250 includes a central aperture which includes a positioning shaft 3220. The positioning shaft 3220 is fixed in a stable position relative to the lid 3250 by a fastener 3225 attached to the surface of the lid 3250.

All of the above U.S. patents, U.S. patent application publications, U.S. patent applications, foreign patents, foreign patent applications and non-patent publications referred to in this specification and/or listed in any Application Data Sheet, are incorporated herein by reference, to the extent not inconsistent herewith.

One skilled in the art will recognize that the herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken limiting.

In a general sense, those skilled in the art will recognize that the various aspects described herein which can be implemented, individually and/or collectively, by a wide range of hardware, software, firmware, and/or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of memory (e.g., random access, flash, read only, etc.)), and/or electrical circuitry forming a communications device (e.g., a modem, communications switch, optical-electrical equipment, etc.). Those having skill in the art will recognize that the subject matter described herein may be implemented in an analog or digital fashion or some combination thereof.

Those skilled in the art will recognize that at least a portion of the devices and/or processes described herein can be integrated into an image processing system. Those having skill in the art will recognize that a typical image processing system generally includes one or more of a system unit housing, a video display device, memory such as volatile or non-volatile memory, processors such as microprocessors or digital signal processors, computational entities such as operating systems, drivers, applications programs, one or more interaction devices (e.g., a touch pad, a touch screen, an antenna, etc.), control systems including feedback loops and control motors (e.g., feedback for sensing lens position and/or velocity; control motors for moving/distorting lenses to give desired focuses). An image processing system may be implemented utilizing suitable commercially available components, such as those typically found in digital still systems and/or digital motion systems.

Those skilled in the art will recognize that at least a portion of the devices and/or processes described herein can be integrated into a data processing system. Those having skill in the art will recognize that a data processing system generally includes one or more of a system unit housing, a video display device, memory such as volatile or non-volatile memory, processors such as microprocessors or digital signal processors, computational entities such as operating systems, drivers, graphical user interfaces, and applications programs, one or more interaction devices (e.g., a touch pad, a touch screen, an antenna, etc.), and/or control systems including feedback loops and control motors (e.g., feedback for sensing position and/or velocity; control motors for moving and/or adjusting components and/or quantities). A data processing system may be implemented utilizing suitable commercially available components, such as those typically found in data computing/communication and/or network computing/communication systems.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An apparatus, comprising:

a stored material module including a plurality of storage units configured for storage of one or more medicinal units, the stored material module including a surface configured to reversibly mate with a surface of a storage structure within a substantially thermally sealed storage container and including a surface configured to reversibly mate with a surface of a stabilizer unit;

a storage stabilizer unit configured to reversibly mate with the surface of the stored material module, wherein the storage stabilizer unit includes at least two tubes of different internal diameters, the tubes positioned one inside the other, the tubes sized to slide relative to each other, and an aperture along a partial length of each of the tubes, wherein the apertures form a conduit when the tubes are in a specific position relative to each other, the conduit substantially perpendicular to the axis of the tubes;

a stored material module cap configured to reversibly mate with a surface of at least one of the plurality of storage units within the stored material module and configured to reversibly mate with a surface of the at least one storage stabilizer unit; and a central stabilizer unit configured to reversibly mate with a surface of the stored material module cap, wherein the central stabilizer unit is of a size and shape to substantially fill a conduit in the substantially thermally sealed storage container.

2. An apparatus, comprising:

a stored material module including a plurality of storage units configured for storage of one or more medicinal units, the stored material module including a surface configured to reversibly mate with a surface of a storage structure within a substantially thermally sealed storage container and including a surface configured to reversibly mate with a surface of a stabilizer unit;

a storage stabilizer unit configured to reversibly mate with the surface of the stored material module, wherein the storage stabilizer unit includes an inner tube and at least one exterior tube of different internal diameters, the tubes positioned as at least one interior and at least one exterior tube relative to each other, the tubes sized to slide relative to each other, an aperture along a partial length of the inner tube and each of the at least one exterior tube, wherein the apertures form a conduit when the tubes are in a specific position relative to each other, the conduit substantially perpendicular to the axis of the tubes, and retaining units fixed to an internal surface of the inner tube at a region adjacent to the aperture in the inner tube, the retaining units including ends projecting through the apertures in each of the tubes;

a stored material module cap configured to reversibly mate with a surface of at least one of the plurality of storage units within the stored material module and configured to reversibly mate with a surface of the at least one storage stabilizer unit; and a central stabilizer unit configured to reversibly mate with a surface of the stored material module cap, wherein the central stabilizer unit is of a size and shape to substantially fill a conduit in the substantially thermally sealed storage container.

3. An apparatus, comprising:

a stored material module including a plurality of storage units configured for storage of one or more medicinal units, the stored material module including a surface configured to reversibly mate with a surface of a storage structure within a substantially thermally sealed storage container and including a surface configured to reversibly mate with a surface of a stabilizer unit;

a storage stabilizer unit configured to reversibly mate with the surface of the stored material module, wherein the storage stabilizer unit includes an exterior frame of a size and shape to substantially surround the stored material module, a surface of the exterior frame substantially conforming to a surface of the stored material module, a plurality of apertures in the exterior frame, one or more protrusions from the surface of the exterior frame at an edge facing the stored material module, the one or more protrusions corresponding to edge surfaces of apertures within a stored material module base;

a stored material module cap configured to reversibly mate with a surface of at least one of the plurality of storage units within the stored material module and configured to reversibly mate with a surface of the at least one storage stabilizer unit; and a central stabilizer unit configured to reversibly mate with a surface of the stored material module cap, wherein the central stabilizer unit is of a size and shape to substantially fill a conduit in the substantially thermally sealed storage container.

4. An apparatus, comprising:

a stored material module including a plurality of storage units configured for storage of one or more medicinal units, the stored material module including a surface configured to reversibly mate with a surface of a storage structure within a substantially thermally sealed storage container and including a surface configured to reversibly mate with a surface of a stabilizer unit;

a storage stabilizer unit configured to reversibly mate with the surface of the stored material module;

a stored material module cap configured to reversibly mate with a surface of at least one of the plurality of storage units within the stored material module and configured to reversibly mate with a surface of the at least one storage stabilizer unit, wherein the stored material module cap includes a first substantially hollow tube with one end fixed to a surface of the stored material module cap, a second substantially hollow tube with a smaller diameter than the first tube, the second tube positioned within the first tube with an exterior surface adjacent to the interior surface of the first tube, the surfaces configured to allow the second tube to slide within the first tube, at least one aperture in the stored material module cap configured to accommodate one or more wires joining circuitry within the second tube to circuitry located exterior to the second tube; and a central stabilizer unit configured to reversibly mate with a surface of the stored material module cap, wherein the central stabilizer unit is of a size and shape to substantially fill a conduit in the substantially thermally sealed storage container.

5. A substantially thermally sealed storage container, comprising:

an outer assembly, including:

an outer wall substantially defining a substantially thermally sealed storage container, the outer wall substantially defining a single outer wall aperture;

an inner wall substantially defining a substantially thermally sealed storage region, the inner wall substantially defining a single inner wall aperture;

the inner wall and the outer wall separated by a distance and substantially defining a gap;

at least one section of ultra efficient insulation material disposed within the gap;

a connector forming a conduit connecting the single outer wall aperture with the single inner wall aperture; and a single access aperture to the substantially thermally sealed storage region, wherein the single access aperture is defined by an end of the connector; and an inner assembly within the substantially thermally sealed storage region, including:

a storage structure configured for receiving and storing a plurality of modules, wherein the plurality of modules includes both at least one heat sink module and at least one stored material module;

a stored material module including a plurality of storage units, the stored material module including a surface configured to reversibly mate with the storage structure within a substantially thermally sealed storage container;

at least one storage stabilizer unit configured to reversibly mate with a surface of the stored material module;

a stored material module cap configured to reversibly mate with at least one of the plurality of storage units within the stored material module and configured to reversibly mate with the at least one stabilizer unit; and a central stabilizer unit operably connected to the stored material module cap, wherein the central stabilizer unit is positioned to substantially fill the conduit.

6. The substantially thermally sealed storage container of claim 5, wherein the connector is a flexible connector.

7. The substantially thermally sealed storage container of claim 5, wherein the gap comprises:

substantially evacuated space with a pressure less than or equal to $5\times10^{-4}$ torr.

8. The substantially thermally sealed storage container of claim 5, wherein the at least one section of ultra efficient insulation material includes multilayer insulation material ("MLI").

9. The substantially thermally sealed storage container of claim 5, wherein the storage structure is affixed to an interior of the substantially thermally sealed storage region in a position substantially parallel to a diameter of the conduit.

10. The substantially thermally sealed storage container of claim 5, wherein each of the plurality of storage units within the stored material module are configured to store medicinal vials.

11. The substantially thermally sealed storage container of claim 5, wherein each of the plurality of storage units within the stored material module are configured to store one or more prefilled medicinal syringes.

12. The substantially thermally sealed storage container of claim 5, wherein the plurality of storage units comprise:

at least one tab on at least one edge of the storage units; and at least one indentation on at least one opposing edge of the storage units, wherein the at least one tab on each of the storage units is reversibly mated with the at least one indentation on an adjacent storage unit.

13. The substantially thermally sealed storage container of claim 5, wherein the plurality of storage units comprise:

at least one indentation configured to reversibly mate with an exterior surface of the at least one stabilizer unit.

14. The substantially thermally sealed storage container of claim 5, wherein the plurality of storage units are arranged in a vertical stack within the stored material module.

15. The substantially thermally sealed storage container of claim 5, comprising:

a stored material module base operably attached to the stored material module at an end of the stored material module distal to the stored material module cap, wherein the stored material base includes one or more apertures with edges configured to reversibly mate with an external surface of the storage stabilizer unit.

16. The substantially thermally sealed storage container of claim 5, wherein the at least one stabilizer unit comprises:

at least two tubes of different internal diameters, the tubes positioned one inside the other, the tubes sized and positioned for their surfaces to slide relative to each other, and including an aperture along a partial length of each of the tubes, wherein the apertures form a conduit when the tubes are in a specific position relative to each other.

17. The substantially thermally sealed storage container of claim 5, wherein the at least one stabilizer unit comprises:

at least two tubes of different internal diameters, the tubes positioned as at least one interior tube and at least one exterior tube relative to each other, the tubes sized and positioned for their surfaces to slide relative to each other;

an aperture along a partial length of each of the tubes, wherein the apertures form a conduit when the tubes are in a specific position relative to each other; and one or more retaining units fixed to an internal surface of the at least one inner tube at a region adjacent to the aperture in the inner tube, the retaining units including ends projecting through the apertures in each of the tubes.

18. The substantially thermally sealed storage container of claim 5, wherein the storage stabilizer unit comprises:

an exterior frame of a size and shape to substantially surround the stored material module, an inner surface of the exterior frame substantially conforming to an outer surface of the stored material module;

a plurality of apertures in the exterior frame;

one or more protrusions from a surface of the exterior frame at a surface facing the stored material module, the protrusions corresponding to one or more edge surfaces of an aperture within a stored material unit.

19. The substantially thermally sealed storage container of claim 5, wherein the stored material module cap comprises:

at least one aperture with a surface configured to reversibly mate with the surface of a tab of a stored material unit.

20. The substantially thermally sealed storage container of claim 5, wherein the stored material module cap comprises:

a connection region, including a base and a rim, the surface of the connection region configured to reversibly mate with a surface of the central stabilizer unit.

21. The substantially thermally sealed storage container of claim 5, wherein the stored material module cap comprises:

a connection region, including an aperture; and a circuitry connector within the aperture, the circuitry connector configured to reversibly mate with a corresponding circuitry connector on a surface of the central stabilizer unit.

22. The substantially thermally sealed storage container of claim 5, wherein the stored material module cap comprises:

at least one aperture configured to attach a fastener between the stored material module and the stored material module cap.

23. The substantially thermally sealed storage container of claim 5, wherein the stored material module cap comprises:

a first substantially hollow tube with one end fixed to a surface of the stored material module cap;

a second substantially hollow tube with a smaller diameter than the first tube, the second tube positioned within the first tube with an exterior surface adjacent to an interior surface of the first tube, the surfaces configured to allow the second tube to slide within the first tube;

at least one aperture in the first tube and at least one aperture in the second tube, the apertures positioned to form a conduit when the tubes are in a specific position relative to each other;

a shaft configured to move in response to pressure from a surface of the central stabilizer unit;

a force transmission unit configured to transfer force from movement of the shaft to a rod;

an end of the rod of a size and shape to substantially fill the conduit formed from the at least one aperture in the first tube and the at least one aperture in the second tube when the tubes are in the specific position relative to each other.

24. The substantially thermally sealed storage container of claim 5, wherein the stored material module cap comprises:

a first substantially hollow tube with one end fixed to a surface of the stored material module cap;

a second substantially hollow tube with a smaller diameter than the first tube, the second tube positioned within the first tube with an exterior surface adjacent to an interior surface of the first tube, the surfaces configured to allow the second tube to slide within the first tube;

at least one aperture in the stored material module cap configured to accommodate wires joining circuitry within the second tube to circuitry located exterior to the second tube.

25. The substantially thermally sealed storage container of claim 5, wherein the central stabilizer unit comprises:

a base including at least one surface configured to reversibly mate with a surface of the stored material module cap.

26. The substantially thermally sealed storage container of claim 5, wherein the central stabilizer unit comprises:

a fastener positioned to reversibly attach the central stabilizer unit to the stored material module cap; and a mechanical release operably attached to the fastener, the release positioned for access from an exterior surface of the central stabilizer unit.

27. The substantially thermally sealed storage container of claim 5, comprising:

a lid attached to an end of the central stabilizer unit, the lid of a size and shape conforming with an outer surface of the substantially thermally sealed storage container in a region adjacent to an exterior end of the conduit.

28. The substantially thermally sealed storage container of claim 5, comprising:

a lid attached to an end of the central stabilizer unit at a site distal to the stored material module cap;

a handle attached to the lid on a surface distal to the end of the central stabilizer unit;

a display unit integral to the lid;

an electronic system operably attached to the lid; and a user input device operably attached to the electronic system.

29. The substantially thermally sealed storage container of claim 5, comprising:

a lid attached to an end of the central stabilizer unit, the lid of a size and shape conforming with an outer surface of the substantially thermally sealed storage container in a region adjacent to an exterior end of the conduit;

an electromechanical switch operably attached to the lid, the electromechanical switch positioned on the surface of the lid adjacent to the outer surface of the substantially thermally sealed storage container in the region adjacent to the exterior end of the conduit;

an electronic system operably attached to the electromechanical switch; and an indicator operably attached to the lid.

30. A transportation stabilizer unit with dimensions corresponding to a substantially thermally sealed storage container with a flexible connector, comprising:

a lid of a size and shape configured to substantially cover an external opening in an outer wall of a substantially thermally sealed storage container including a flexible connector, the lid including a surface configured to reversibly mate with an external surface of the substantially thermally sealed storage container adjacent to the external opening in the outer wall;

a central aperture in the lid;

a reversible fastening unit adjacent to the central aperture in the lid, the reversible fastening unit positioned to fasten a shaft within the central aperture in the lid;

a wall substantially defining a tubular structure with a diameter in cross-section less than a minimal diameter of the flexible connector of the substantially thermally sealed storage container, an end of the tubular structure operably attached to the lid;

an aperture in the wall, wherein the aperture includes an edge at a position on the tubular structure less than a maximum length of the flexible connector from the end of the tubular structure operably attached to the lid;

a positioning shaft with a diameter in cross-section less than a diameter in cross-section of the central aperture in the lid, the positioning shaft of a length greater than the thickness of the lid in combination with the length of the wall between the surface of the lid and the edge of the aperture in the wall;

an interior surface of the wall, the interior surface substantially defining an interior region;

a pivot unit operably attached to a terminal region of the positioning shaft and positioned within the interior region;

a support unit operably attached to the pivot unit, the support unit of a size and shape to fit within the interior region when the pivot unit is rotated in one direction, and to protrude through the aperture in the wall when the pivot unit is rotated approximately 90 degrees in the other direction;

an end region of a size and shape configured to reversibly mate with the interior surface of an aperture in a storage structure within the substantially thermally sealed storage container;

a base grip at the terminal end of the end region; and a tensioning unit for the base grip, configured to maintain pressure on the base grip against an interior wall of the substantially thermally sealed storage container in a direction substantially perpendicular to the surface of the lid.

31. The transportation stabilizer unit of claim 30, wherein the lid comprises:

at least one aperture configured for a fastener to reversibly attach the lid to the outer wall of the substantially thermally sealed storage container.

32. The transportation stabilizer unit of claim 30, wherein the pivot unit is configured to allow movement of the support unit approximately 90 degrees along a single axis.

33. The transportation stabilizer unit of claim 30, wherein the positioning shaft is positioned within the aperture in the lid.

34. The transportation stabilizer unit of claim 30, wherein the reversible fastening unit attaches to the positioning shaft with sufficient tension to maintain the flexible connector in a compressed position.

35. The transportation stabilizer unit of claim 30, wherein the base grip comprises:

a surface with a coefficient of friction greater than one with the surface of the interior wall at temperatures between approximately 2 degrees and 8 degrees Centigrade.

36. An apparatus, comprising:

a substantially thermally sealed storage container with a flexible connector; and a stabilizer unit with dimensions corresponding to the substantially thermally sealed storage container, the stabilizer unit including:

a lid of a size and shape configured to substantially cover an external opening in an outer wall of the substantially thermally sealed storage container, the lid including a surface configured to reversibly mate with an external surface of the outer wall adjacent to the external opening;

a central aperture in the lid;

a wall substantially defining a tubular structure with a diameter in cross-section less than a minimal diameter of the flexible connector of the substantially thermally sealed storage container, an end of the tubular structure operably attached to the lid;

an aperture in the wall, wherein the aperture includes an edge at a position on the tubular structure less than a maximum length of the flexible connector from the end of the tubular structure operably attached to the lid;

a positioning shaft with a diameter in cross-section less than a diameter in cross-section of the central aperture in the lid, the positioning shaft of a length greater than a thickness of the lid in combination with a length of the wall between the surface of the lid and an edge of the aperture in the wall;

a reversible fastening unit operably attached to the lid in a region adjacent to the aperture in the lid and positioned to operably attach to the positioning shaft;

an interior surface of the wall, the interior surface substantially defining an interior region;

a pivot unit operably attached to a terminal region of the positioning shaft and positioned within the interior region;

a support unit operably attached to the pivot unit, the support unit of a size and shape to fit within the interior region when the pivot unit is rotated in one direction, and to protrude through the aperture in the wall when the pivot unit is rotated in the other direction;

an end region of a size and shape configured to reversibly mate with an interior surface of an aperture in a storage structure within the substantially thermally sealed storage container;

a base grip at a terminal end of the end region, including a surface with a coefficient of friction greater than one with a surface of an interior wall of the container at temperatures between 2 degrees and 8 degrees Centigrade;

a tensioning unit for the base grip, configured to maintain pressure on the base grip against the interior wall of the container in a direction substantially perpendicular to the surface of the lid.

* * * * *